US012320113B2

(12) United States Patent
LeBlang

(10) Patent No.: US 12,320,113 B2
(45) Date of Patent: Jun. 3, 2025

(54) METAL FRAMING SELF-LOCKING CONNECTORS

(71) Applicant: Dennis LeBlang, La Quinta, CA (US)

(72) Inventor: Dennis LeBlang, La Quinta, CA (US)

( * ) Notice: Subject to any disclaimer, the term of this patent is extended or adjusted under 35 U.S.C. 154(b) by 0 days.

(21) Appl. No.: 15/430,781

(22) Filed: Feb. 13, 2017

(65) Prior Publication Data

US 2019/0242111 A1 Aug. 8, 2019
US 2023/0093777 A9 Mar. 23, 2023

Related U.S. Application Data

(63) Continuation-in-part of application No. 15/295,172, filed on Oct. 17, 2016, now Pat. No. 10,364,566, which is a continuation-in-part of application No. 15/090,460, filed on Apr. 4, 2016, now Pat. No. 11,060,281, which is a continuation-in-part of (Continued)

(51) Int. Cl.

| | |
|---|---|
| ***E04B 1/24*** | (2006.01) |
| ***E04B 2/58*** | (2006.01) |
| ***E04C 3/07*** | (2006.01) |
| ***E04C 3/09*** | (2006.01) |
| ***E04C 3/32*** | (2006.01) |
| *E04C 3/02* | (2006.01) |
| *E04C 3/04* | (2006.01) |

(52) U.S. Cl.

CPC ..... *E04B 1/2403* (2013.01); *E04B 2/58* (2013.01); *E04C 3/07* (2013.01); *E04C 3/09* (2013.01); *E04C 3/32* (2013.01); *E04B 2001/2409* (2013.01); *E04B 2001/2415* (2013.01); *E04B 2001/2436* (2013.01); *E04B 2001/2457* (2013.01); *E04B 2001/2469* (2013.01); *E04C 2003/026* (2013.01); *E04C 2003/0473* (2013.01)

(58) Field of Classification Search

CPC ..... E04C 3/07; E04C 3/292; E04C 2003/026; E04C 2003/0473; E04C 3/09; E04B 1/40; E04B 2/58; E04B 1/7608; E04B 1/7654; E04B 2001/405; E04B 2/707; E04B 2001/2415; E04B 2001/2496; E04B 1/2403; E04B 2001/2409; E04B 2001/2436; E04B 2001/2457; E04B 2001/2469

USPC ... 52/653.1, 654.1, 667, 712, 243, 317, 349, 52/481.1, 655.1, 696, 715

See application file for complete search history.

(56) References Cited

U.S. PATENT DOCUMENTS 3,653,172 A * 4/1972 Schwartz ..... E04B 2/62 52/669
3,708,941 A 1/1973 Cuckson
(Continued)

OTHER PUBLICATIONS

Simpson Strong-Tie Company Inc., Pleasant, CA Title of Catalog: BBR & DBR Spacer Bracers, dated Jan. 1, 2017.
(Continued)

*Primary Examiner* — Beth A Stephan

(57) ABSTRACT

The present invention relates to metal framed wall components with self-locking fixed and sliding connections between support members and crossing connecting members without using fasteners to connect the two crossing metal framing members together. Different variations of the shapes of the connecting members as well as the location and shape of the notches, ledges, tabs and notched-tabs are used between the members at the holes, punch-outs or indentations all determine the self-locking connections.

14 Claims, 51 Drawing Sheets

Related U.S. Application Data application No. 14/946,378, filed on Nov. 19, 2015, now Pat. No. 11,391,038, said application No. 14/946,378 is a continuation-in-part of application No. 13/398,243, filed on Feb. 16, 2012, now abandoned, said application No. 13/398,243 is a continuation-in-part of application No. 12/456,707, filed on Jun. 22, 2009, now Pat. No. 8,161,699.

(60) Provisional application No. 62/385,932, filed on Sep. 9, 2016, provisional application No. 62/378,615, filed on Aug. 23, 2016, provisional application No. 62/369,041, filed on Jul. 30, 2016, provisional application No. 62/345,153, filed on Jun. 3, 2016, provisional application No. 62/308,520, filed on Mar. 15, 2016, provisional application No. 62/298,762, filed on Feb. 23, 2016, provisional application No. 62/143,097, filed on Apr. 4, 2015, provisional application No. 62/170,269, filed on Jun. 3, 2015, provisional application No. 62/175,191, filed on Jun. 12, 2015, provisional application No. 62/208,766, filed on Aug. 23, 2015, provisional application No. 62/242,705, filed on Oct. 16, 2015, provisional application No. 62/139,916, filed on Mar. 30, 2015, provisional application No. 62/083,276, filed on Nov. 23, 2014, provisional application No. 62/244,135, filed on Oct. 20, 2015, provisional application No. 62/264,033, filed on Dec. 7, 2015, provisional application No. 62/274,134, filed on Dec. 31, 2015, provisional application No. 62/294,756, filed on Feb. 12, 2016, provisional application No. 61/629,552, filed on Nov. 22, 2011, provisional application No. 61/628,044, filed on Oct. 24, 2011.

(56) References Cited

U.S. PATENT DOCUMENTS

| | | | | | |
|---|---|---|---|---|---|
| 3,969,865 | A | | 7/1976 | Anderson | |
| 3,998,620 | A | | 12/1976 | Kuhr | |
| 4,007,570 | A | | 2/1977 | Hunter | |
| 4,089,146 | A | | 5/1978 | Martinez | |
| 4,106,251 | A | | 8/1978 | Nelsson | |
| 4,160,344 | A | | 7/1979 | Brugman | |
| 4,545,166 | A | | 10/1985 | Kielmeyer | |
| 4,791,766 | A | * | 12/1988 | Egri, II | E04B 1/941 52/696 |
| 4,793,113 | A | | 12/1988 | Bodnar | |
| 4,805,364 | A | | 2/1989 | Smolik | |
| 4,840,005 | A | * | 6/1989 | Cochrane | E04B 7/024 52/696 |
| 4,809,476 | A | | 7/1989 | Satchell | |
| 5,081,812 | A | | 6/1992 | Reynolds | |
| 5,127,760 | A | | 7/1992 | Brady | |
| 5,155,962 | A | * | 10/1992 | Burkstrand | E04B 2/763 52/243 |
| 5,157,883 | A | | 10/1992 | Meyer | |
| 5,177,929 | A | | 1/1993 | Reynolds | |
| 5,207,045 | A | | 5/1993 | Bodnar | |
| 5,274,973 | A | | 1/1994 | Liang | |
| 5,321,924 | A | | 6/1994 | Smolik | |
| 5,325,651 | A | | 7/1994 | Meyer | |
| 5,394,665 | A | | 3/1995 | Johnson | |
| 5,515,660 | A | * | 5/1996 | Hanks | E04B 2/58 52/481.2 |
| 5,720,138 | A | | 2/1998 | Johnson | |
| 5,749,192 | A | | 5/1998 | Menchetti | |
| 5,797,233 | A | | 8/1998 | Hascall | |
| 5,884,448 | A | | 3/1999 | Pellock | |
| 5,899,042 | A | | 5/1999 | Pellock | |
| 5,943,838 | A | | 8/1999 | Madsen | |
| 5,964,071 | A | * | 10/1999 | Sato | E04B 2/7457 403/316 |
| 6,164,028 | A | | 12/2000 | Hughes | |
| 6,199,336 | B1 | | 3/2001 | Poliquin | |
| 6,260,318 | B1 | | 7/2001 | Herren | |
| 6,301,854 | B1 | | 10/2001 | Daudet | |
| 6,374,558 | B1 | | 4/2002 | Surowiecki | |
| 6,401,423 | B1 | | 6/2002 | Bergeron | |
| 6,557,254 | B1 | | 5/2003 | Johnson | |
| 6,578,335 | B2 | | 7/2003 | Poliquin | |
| 6,647,691 | B2 | | 11/2003 | Becker | |
| 6,694,695 | B2 | | 2/2004 | Collins | |
| 6,701,689 | B2 | | 3/2004 | diGirolamo | |
| 6,708,460 | B1 | * | 3/2004 | Elderson | E04B 2/7457 403/375 |
| 6,843,035 | B1 | | 1/2005 | Glynn | |
| 6,854,237 | B2 | | 2/2005 | Surowiecki | |
| 6,983,569 | B1 | | 1/2006 | Rosenberg | |
| 7,017,310 | B2 | * | 3/2006 | Brunt | E04B 2/763 52/220.1 |
| 7,073,757 | B2 | | 7/2006 | Johnson | |
| 7,259,365 | B2 | | 1/2007 | Colen | |
| 7,428,804 | B2 | | 9/2008 | Surowiecki | |
| 7,451,573 | B2 | | 11/2008 | Orszulak | |
| 7,596,921 | B1 | | 10/2009 | diGirolamo | |
| 7,770,348 | B2 | | 8/2010 | Tollenaar | |
| 7,823,350 | B2 | | 11/2010 | Valle | |
| 7,836,657 | B1 | * | 11/2010 | diGirolamo | E04B 2/765 52/317 |
| 7,866,112 | B2 | | 1/2011 | Edmondson | |
| 7,975,448 | B2 | | 7/2011 | Jahn | |
| 8,011,160 | B2 | | 9/2011 | Rice | |
| 8,205,402 | B1 | * | 6/2012 | diGirolamo | E04B 2/765 52/669 |
| 8,245,466 | B2 | | 8/2012 | Wright | |
| 8,453,989 | B2 | | 6/2013 | Kunishita | |
| D692,746 | S | * | 11/2013 | Lawson | E04B 2/763 D8/394 |
| 8,615,959 | B2 | | 12/2013 | Ferguson | |
| 8,733,044 | B2 | | 5/2014 | Dollerup | |
| 9,045,898 | B2 | | 6/2015 | Ravnaas | |
| 9,127,456 | B2 | | 9/2015 | Dollerup | |
| 9,849,497 | B2 | * | 12/2017 | Daudet | B21D 35/002 |
| D823,095 | S | * | 7/2018 | Stahl | D8/382 |
| 10,214,902 | B1 | | 2/2019 | Wheeler | |
| 10,590,647 | B2 | * | 3/2020 | Haba | E04B 1/2403 |
| 2006/0191236 | A1 | * | 8/2006 | Surowiecki | E04B 2/763 52/481.1 |
| 2007/0199274 | A1 | * | 8/2007 | Rice | E04B 2/7457 52/712 |
| 2008/0006002 | A1 | * | 1/2008 | Strickland | E04C 3/07 29/897 |
| 2016/0069072 | A1 | * | 3/2016 | Rice | E04B 2/62 52/696 |
| 2017/0191254 | A1 | * | 7/2017 | Daudet | E04B 2/763 |

OTHER PUBLICATIONS

Flex-Ability Concepts, Snap Lock, Horizontal Brace Between Metal Studs, 3840 N. Tulsa Ave., Oklahoma City, OK USA, Received at Trade Show, Build 23, on Mar. 15, 2023.

Soundaway Corporation, Titled: Drywall Furring Hat Channel 20-Pack web: https://www.soundaway.com/drywall-furring-hat-channel-20pk-p/13203.htm?gclid=CjwKCAiAwomeBhBWEiwAM43YIJziF7xBtUmE3s-a04LK4ma4jnAJyRG_7z1uT1mhncGRwFnwyEFBqhoCwSEQAvD_BwE& @ Copyright 2019 SoundAway Corporation. All Rights Reserved. Built by Volusion.

MP Metal Products, Titled: Roll Form Hats, web: mpmetals.com, p. 1 of 17, copyright 2020; W1250 Elmwood Ave. Ixonia, WI 53036 USA.

Suncor Stainless, Titled: What is Swedging; web; www.suncorestainless.com/knowledgebase/swedging/ USA@ 1996-2022 O'Donnell Metal Deck, LLC. All rights reserved.

* cited by examiner

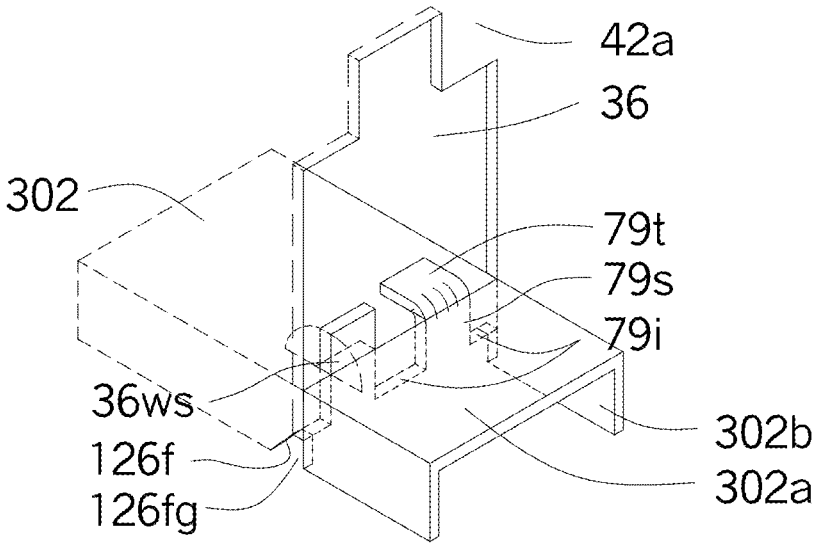
FIG. 5
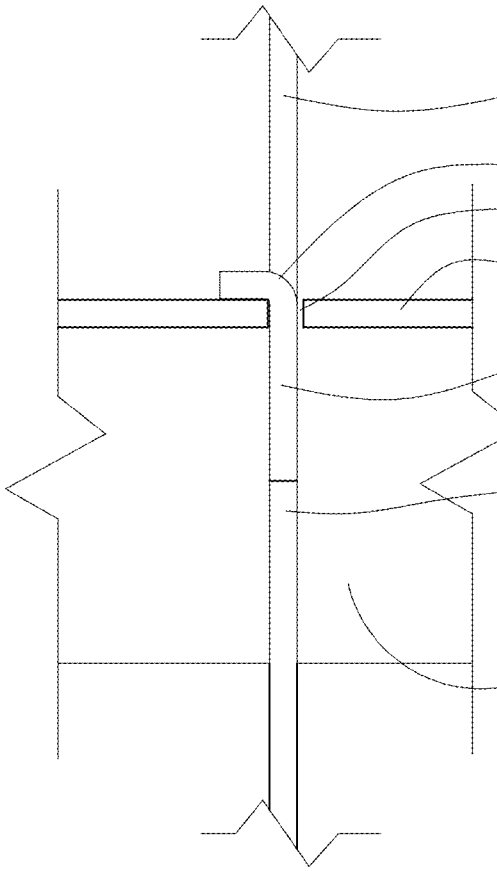
FIG. 6
FIG. 7

METAL FRAMING SELF-LOCKING CONNECTORS

CROSS REFERENCED TO RELATED APPLICATION

This application is a continuous-in-part application U.S. Ser. No. 12/456,707, filed on Jun. 22, 2009, now U.S. Pat. No. 8,161,699 and this application claims priority to the following:

continuous-in-part application U.S. Ser. No. 15/430,781 filed Feb. 13, 2017 which claims benefit to:

provisional application U.S. 62/339,434 filed Sep. 25, 2016 and, provisional application U.S. 62/385,932 filed Sep. 9, 2016 and, provisional application U.S. 62/378,615 filed Aug. 23, 2016 and, provisional application U.S. 62/369,041 filed Jul. 30, 2016 and, provisional application U.S. 62/345,153 filed Jun. 3, 2016 and, provisional application U.S. 62/308,520 filed Mar. 15, 2016 and, provisional application U.S. 62/298,762 filed Feb. 23, 2016 and, provisional application U.S. 62/294,756 filed Feb. 12, 2016 and, Application Ser. No. 15/295,172 is a continuation-in-part of application Ser. No. 15/090,460, filed Apr. 4, 2016 now U.S. Pat. No. 11,060,281, issued Jul. 13, 2021, which claims benefit to;

provisional application U.S. 62/242,705 filed Oct. 16, 2015 and, provisional application U.S. 62/244,135 filed Oct. 20, 2015 and, provisional application U.S. 62/264,033 filed Dec. 7, 2015 and, provisional application U.S. 62/274,134 filed Dec. 31, 2015 and, provisional application U.S. 62/345,153 filed Jun. 3, 2016 and, Application Ser. No. 15/090,460 is a continuation-in-part of application Ser. No. 14/946,378 filed Nov. 19, 2015, now U.S. Pat. No. 11,391,038, issued Jul. 19, 2022, which claims benefit to;

provisional application U.S. 62/242,705 filed Nov. 16, 2015 and, provisional application U.S. 62/208,766 filed Aug. 23, 2015 and, provisional application U.S. 62/143,097 filed Apr. 4, 2015 and, continuous-in-part of application U.S. Ser. No. 14/946,378 filed Mar. 3, 2015, now U.S. Pat. No. 11,391,038 issued Jul. 19, 2022 which claims benefit to;

provisional application U.S. 62/175,191 filed on Jun. 12, 2015 and, provisional application U.S. 62/170,269 filed Jun. 3, 2015 and, provisional application U.S. 62/139,916 filed Mar. 30, 2015 and, provisional application U.S. 62/083,276 filed Nov. 23, 2014 and, continuous-in-part of application U.S. Ser. No. 13/398,243 filed on Feb. 16, 2012, now abandoned claims benefit to:

provisional application U.S. 61/629,552 filed on Nov. 22, 2011 and, provisional application U.S. 61/628,044 filed on Oct. 24, 2011 and, said application Ser. No. 13/398,243 is a continuation-in-part of application U.S. Ser. No. 12/456,707 filed on Jun. 22, 2009 now U.S. Pat. No. 8,161,699 and, the disclosures of the above cited US Patent Applications and US Provisional Applications of the Applicant, including all drawings and all the specifications, are hereby incorporated by reference in their entireties into this US Patent Application. The four applications prior to Mar. 16, 2013: include (U.S. Ser. No. 13/398,243; U.S. 61/629,552; U.S. 61/628,044; and U.S. Ser. No. 12/456,707).

FEDERALLY SPONSORED RESEARCH OR DEVELOPMENT

Not applicable

PARTIES OR JOINT RESEARCH

Not applicable

FIELD OF THE INVENTION

The present invention relates to forming self-locking fixed or self-locking sliding connections using various shaped connectors between the first framing elements referred to as support members and second framing elements referred to as spacer braces and support members without using fasteners to connect the two crossing metal framing members. Different variations of the shapes of the connecting members as well as the location and shape of the notches, ledges, tabs and notch-tabs are used between the members at the holes, punch-outs or indentations all determine the self-locking connections.

BACKGROUND OF THE INVENTION

Light gauge metal framing have been used in the construction of buildings for many years, however interior and exterior metal framing has always been difficult to assemble as well as construct horizontal and diagonal bracing between support framing members because of the configuration of the support members like a C channel and poor energy efficient shear wall construction. The lip and flange of the C channel protrudes from the web making it difficult to make connections. When bracing members are installed between support members for additional strength, insulation can become even more difficult to install as well as form a better insulated wall.

When assembling metal framed walls, the vertical support members are not rigid until the bracing members or fasteners are added to help stabilize the support members from moving. In the past there have been attempts to stiffen support members by providing lateral bracing, drywall backing or bracing members between vertical support members.

The bracing members within the wall forming structure are generally required to connect support members together, however horizontal bracing members can be very long and next to impossible to connect horizontal bracing members to individual spacer blocks located between support members. In addition the bracing members are not used to form shear walls or diagonal framing with the walls or have the flexibility to form trusses having diagonally framing members.

Metal framing has developed computer systems to form pre-punched screw holes to designate how and where to install fasteners between metal framing members. Different types of notches or shapes of bracing members have helped speed up framing assembly. There have been little to no innovation developed to allow metal framing to be connected without using fasteners and nothing has been developed where the spacer brace connects support members together using clips, U clips, punch-out tables and ledges that form a self-lock connectors that fit together to form a fast an easy connection means to form metal framed wall panels without using fasteners at the support members. The unique wall construction allows wall panels to be fabricated quickly and easily without using fasteners thereby saving money on labor and material.

DESCRIPTION OF PRIOR ART

The horizontal and diagonal connections between metal support members do not form continuous bracing that interlocks between each other but rather are individual components. Individual mounting brackets are used to support trusses or horizontally brace support members. Many different shapes of horizontal bracing members are used to connect metal framing members together and include various grooves, tabs, bridging backing, notches to connect the metal framing members together. Some types of connections between support members use bent hooks, bent flanges, clamping tabs, anchoring handrail system, adjustable braces or extended tabs to connect trusses. Different types of brackets, shapes, leg supporting connections and blocking are used to install support members together. Slotted holes and bent tabs at the top base plate have been used to compensate for vertical movement between vertical and horizontal support members. Spacer braces do use various types of clips with fasteners to interlock between support members to prevent vertical and horizontal movement. There is no prior art for U or W shaped clips with spacer braces to secure support members together. Some support members have been shown to have a rim around the hole for extra strength or to reduce thermal conductivity through the support member, but not used a part of a self-locking connector. Punch out tabs have been used as spacers or as tabs where the tabs have been used to support another object. A ceiling suspension system uses clips to secure a crossing channels by using tabs and hooks and a demountable attachment for modular construction uses hooks to install a crossing channel or hooks to install electric junction boxes and ceiling base plates use bendable tabs.

SUMMARY OF THE INVENTION

The present invention relates to forming a connector between first and second metal framing members are self-locking fixed or self-locking sliding connections between spacer braces and support members without requiring fasteners to connect the two crossing metal framing members. Various shapes or configurations of spacer braces intersect the support members at the top or bottom of the support member and through the holes in the webs. The metal framing member holes can have rims or ledges that extend from the side edges of holes to form ledge shafts or tabs. The tab ends can be bent to form bent tabs or notches can be installed in the tab to form notch-tabs. The notches, ledges, tabs and notch-tabs used in the metal framing members can be used to form many variations of self-locking connections between spacer braces intersecting support members as well as between the tongue ends and receiver ends of various shaped spacer braces. The spacer braces have a web with flames extending upward or downward toward the bottom edge of the holes having various shapes including a U-shaped along with bulges that have notches in the bulges or notches in the web, slide gaps, lips or holes to secure the spacer braces and support member together without having fasteners to secure the member together. The vertical, diagonal, curvilinear or horizontal direction of the notches in the spacer braces as well as the notches within the hole of the support members and the longitudinal direction of the spacer braces to also crisscross other spacer braces to form self-locking screw-less connections between framing members.

The edge or perimeter of the hole, also known as a rim, extends from the hole side edges of the support member. The perimeter has notches so the perimeter edge becomes a shaft or tab to extended through slot hole in the spacer braces. The ledge shafts or tab end can be bent to form a self-locking fixed connection or the ledge shaft can have an indentation or notch installed so the web of the crossing member gets inserted into the notch also forming a self-locking connection by using a notch-tab.

Another version is to have the ledger shafts be longer so that the ledger shafts can have a tab which is just the extension of the longer ledger shaft. These tabs can be pre-bent at a manufacturing plant or can be bent at the job site after the spacer braces are installed into the ledger shafts. The ends of the ledger shafts where the ledger tabs are located can have ledge caps installed over the ends of the ledger shafts or ledger tabs. The ledge caps serve a similar function as bending the tabs over the spacer braces webs to secure the spacer braces to the support member. The slot holes can be notches so the ledger shafts fit into notches at the sides of the web of the spacer braces for a faster and easier installation.

In addition, the rims (perimeters) at the top, bottom and sides of the hole in the web of the support member intersect the crossing spacer braces so the extensions of the webs of the spacer braces engage the hole, rims or the ledge shafts and ledge tabs. The rims at the sides of the hole can have rim notches that engage the spacer brace on three sides that prevent the spacer brace or clips from moving. The spacer braces as previously explained, span between support members and the spacer braces have a receiver end and a tongue that fits into a receiver end of an adjacent spacer brace. On the other hand, a clip oednly has two one receiver ends and/or a finger end and a receiver end than engages the web of a support member where the tongue ends fit into the receiver ends. The rim notches at the rims or hole notches engage the extensions that cross the web of the support members. The notch-tabs are also formed by ledge shafts, web tabs or hooked tongue tabs that extend from the web along with the ledge tabs that extend over the ledge shafts that also secure the space braces to the support members by indentations or bending of the tabs. The edge of the rims can be considered as the width of the hole and the rims are notched instead of the web of the support member. The edge of the rims can be considered as the width of the hole and the rims are notched instead of the web of the support member, but in both cases the notches engage the spacer braces. Sometimes the spacer braces can have flange slot holes where notch-tabs have ledges tabs with ledge shafts that penetrate the flange slot holes in the spacer braces again securing the spacer braces to the support member. The notch-tabs at the webs can interlock into the hole notches and extended by adding another spacer brace when being connected between the holes of the support members. The various types of notches act as fasteners when connecting to crossing spacer braces. The notches or tabs with shafts allow the spacer braces to be oriented horizontally, vertically or installed at diagonals. The receiver ends can have receiver notches for the notch-tabs at the tongue ends to engage one another interlocking the receiver and tongue ends.

The self-locking connections do not always have to be secured to the support members and spacer braces, but can be connected to one another so the support member can slid vertically within a wall structure so that the top and bottom spacer braces are secured to the floor and ceiling above and still have the floor structure move vertically when additional floor loads occur from additional live loads or dead loads add additional weight causing the floor structure to bend. In this case the tabs of the punch out tabs and the side edges of the flanges in the spacer braces plus the side edges of a web indentation in the support members allow the support member to remain in place when then additional floor structure above the wall framing moves. When the flame of the spacer brace has an acute angle to the web, that angle flanges of the first angle flange spacer brace retain the second angle spacer brace from moving vertically due to the overhanging angle of the flame of the first spacer brace.

The reverse lip spacer braces has many hat channel configurations with longitudinal webs with two flanges with extending web with external extending lips where the lips have lip notches that engage the web of support members. The reverse lip spacer braces can be fixed as to not move in a vertical direction when the lip notches engage the hole notches interlocking the two notches together or can slide in a vertical direction when the lip notches engage the hole side edges or an indentation in the web so the cross member can move vertically within the support members. The reverse lip spacer braces can be oriented having the U-shape facing upward or downward so the stacked webs or lips can be connected together. The webs being connected by overlapping lip notches, curved or bugle flanges with and without notches, flanges having angled flanges being connected into the same hole notches at both sides of the hole opening or notch-tab intersections with slot holes.

Another aspect of the invention relates to forming self-locking fixed and self-locking sliding connection between spacer braces and support members without using fasteners to connect the two crossing metal framing members. The spacer braces intersect the support members at the top or bottom of the support member and through the holes in the webs. The spacer braces have U-shaped spacer braces or reverse lip spacer braces and curvilinear flanges, flange bulges, multiple flanges, angle flanges various other shapes and where the various shapes have notches at the distal ends of the flanges and lips or being in the middle of the spacer brace or having continuous notches or have notches in the bulges or web notches, slide gaps, lip notches to secure the spacer braces and support member together without having fasteners to secure the member together. The vertical or horizontal notches in the spacer braces. The support member have notches in the perimeter side edges of the hole small enough for the lips and lip notches and large enough for the entire spacer brace to fit between the notches, and where the perimeter notches are tapered converging at a point having a blunt end, and where the hole perimeter is angled, and where the perimeter notches are angled.

Another aspect of the invention relates to forming self-locking fixed connections between spacer braces and support members without using fasteners to connect the two crossing metal framing members. The spacer braces intersect the support members at the top or bottom of the support member and through the holes in the webs. Various types of bent tabs form self-locking connections between spacer braces intersecting support members as well as between the tongue and various types of receiver ends. The spacer braces have various shapes along with bulges that have notches in the bulges or notches in the web, slide gaps, lips and lip notches or holes to secure the spacer braces and support member together without having fasteners to secure the member together. The vertical or horizontal direction of the notches and the longitudinal direction of the spacer braces crisscross one another to form self-locking screw-less connections between framing members.

The description of the drawings and the description via the claims sound different but are similar. At the end of the figure description is a figure table of contents noting the embodiments to a number. After that figure table of contents is a claim glossary of terms relating to the figure numbers. Since the spacer brace can be used in so many different configurations and orientations, but are installed the same, the interlocking connections need to be claimed in a different manner.

BRIEF DESCRIPTION OF THE DRAWINGS

FIG. 5 has a ledge shafts penetrate the slot holes, and the ledge tabs are bent after the shafts penetrates the slot holes.

FIG. 6 is a cross section of FIG. 5.

FIG. 7 is a plan view of FIG. 5.

FIG. 29 shows an isometric view of the tabs passing through the web slot holes of the reverse lip spacer braces then getting bent after passing through.

FIG. 32 shows a wall section at the ceiling with a U-shaped spacer brace where the flange bulge has a flange bulge notch for the support channel to slide through.

FIG. 33 shows a wall section at the floor with a U-shaped Spacer Brace where the flange bulge has a flange bulge notch for the support channel to slide through.

FIG. 94 shows an isometric view of the U-shaped spacer brace passing through the hole of the support member having the bottom edge as a ledge engaging the U-shaped spacer brace at the notch gap in the flanges.

DESCRIPTION OF THE PREFERRED EMBODIMENTS

Figure 1:
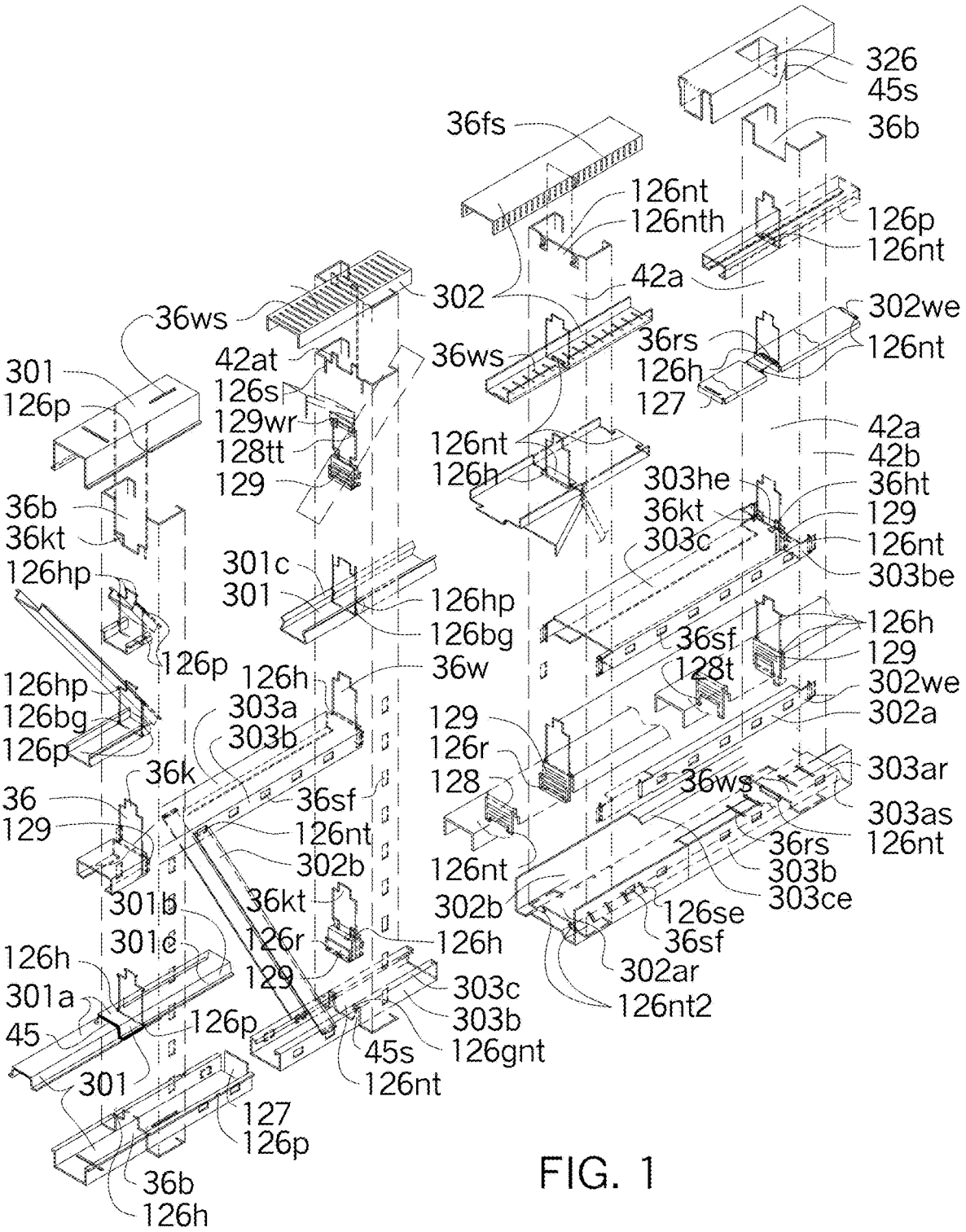
FIG. 1 shows an isometric view of four support members having various configurations and crossing members all having various self-locking connections using support tabs, notch-tabs and openings with notches. The support tabs can be ledge tabs, hole tabs, web tabs, L-shaped tabs, hook receiver tabs, key tabs, punch-out tabs, wrap-around tabs, notch-tabs or bent tabs that can be installed in holes, slot holes, hole notches, lip notches, flanges slot holes, web slot holes, raised slot holes, receiver slot holes, bracing holes, tab holes, rim notches, bulge notches, slide notches, clip notches and that can be installed vertically, horizontally or diagonally using the different configured support members and crossing members.

FIG. 1 shows an isometric view of four support members having various types of connections using interlocking support members crossing spacer braces and bracing clips, hook clips all having various self-locking connections using support tabs, notch-tabs and openings with notches. The support tabs can be ledge tabs 79*t*, hole tabs 36*tb*, web tabs 42*at*, J-shaped gap tabs 45*jt* (not shown), hook receiver tabs 129*t*, key tabs 36*kt*, punch-out tabs 326, wrap-around tabs 326*tw*, holes 36, slot holes 36*s*, hole notches 126*h*, lip notches 126*p*, flanges slot holes 36*fs*, web slot holes 36*ws*, receiver slot holes 36*rs*, bracing holes 36*b*, tab holes 36*tb*, rim notches 126*rm*, bulge notches 126*bg*, slide notches 126*s*, clip notches 126*c*, lip notches 126*p*, receiver notches 126*r* and that can be installed vertically, horizontally or diagonally using the different configured support members and crossing members.

Figure 2:
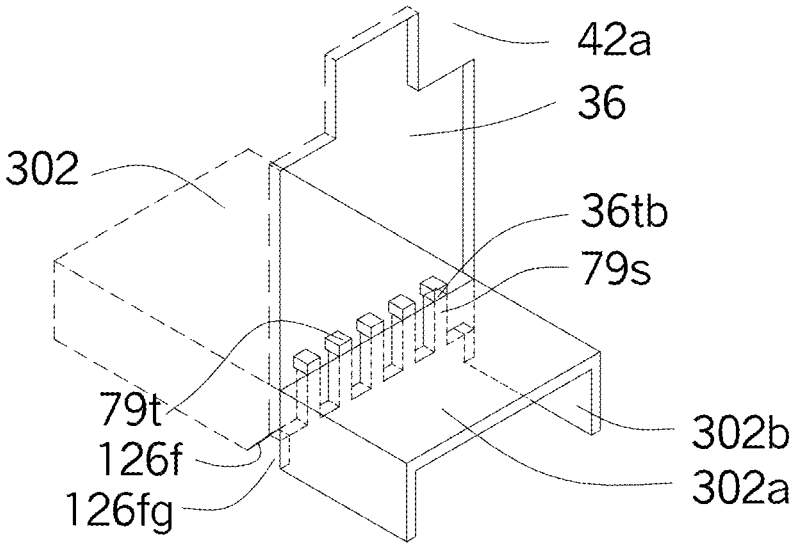
FIG. 2 is an isometric of the ledge or its components consisting of a tooth shaft extending through the tab hole in the web of the U-shaped spacer brace allowing the end of the ledge tab to extend above the web.
Figure 3:
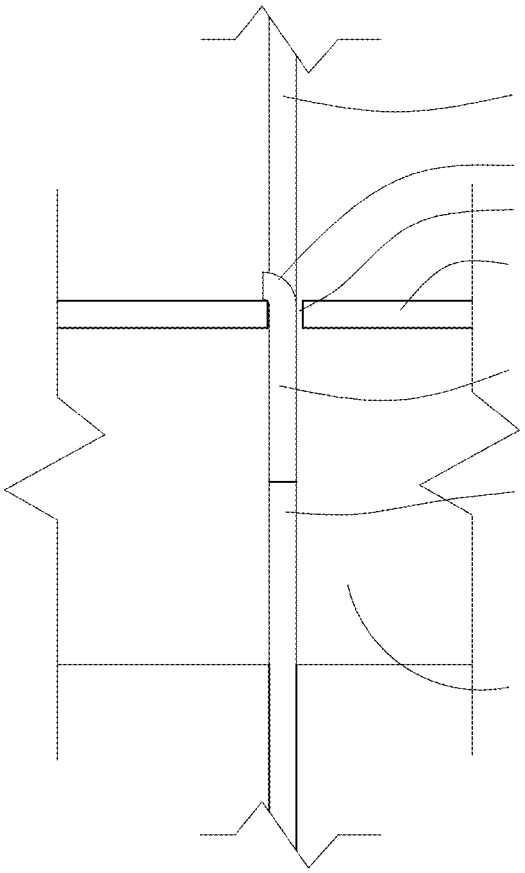
FIG. 3 shows a vertical section through the hole shown in FIG. 2.
Figure 4:
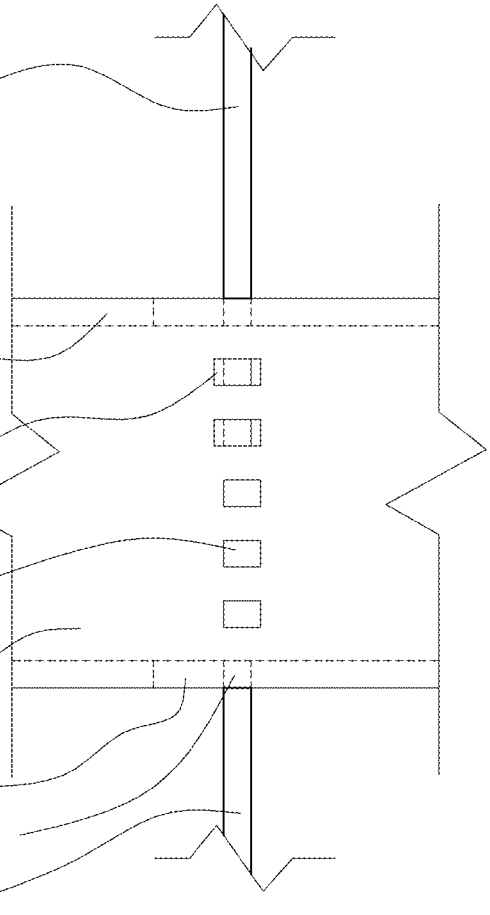
FIG. 4 shows a plan view of the U-shaped spacer brace shown in FIG. 197.

FIG. 2-4 shows another tongue and receiver combination where ledge tabs 79*t* extends from the bottom edge of the tab holes 36*tb* in the web 42*a* of a support member. An array of ledge tabs 79*t* extend upward forming a ledge shaft 79*s* that extends through the tab holes 36*tb* in the web 302*a* of the U-shaped spacer brace 302. The ends of the ledge tabs 79*t* are slightly larger than the tab holes 36*tb* so the ends can extend over the tab holes 36*tb* allowing the ends of the ledge tabs 79*t* to retain the U-shaped spacer brace 302 from moving vertically. On the other hand, the flanges 302*b* have flange notches126*fg* that extend halfway the length of the flanges 302*b* of the U-shaped spacer brace 302. When the U-shaped spacer brace 302 is inserted into the hole 36 which is the same width as the hole 36, the flanges 302*b* are resting on the flange notches126*fg* and the ends of the ledge tabs 79*t* are extending above the web 302*a*. The flange notches126*fg* are shown have a flared edge 126*f* so the U-shaped spacer brace 302 can bend and easily slide-into place. The flange notches 126*fg* in the side walls keep the longitudinal U-shaped spacer brace 302 from moving horizontally as the flange notches 126*fg* extend approximately half the height of the flanges 302*b*. The flange notches 126*fg* reduce the height of the ledge shafts 79*s* to reduce the horizontal bending stress of the ledge shafts 79*s*. FIG. 3 shows a vertical cross section with the ledge shafts 79*s* extend through the tab holes 36*tb* allow the wider end of the ledge tab 79*t* to secure the web 302*a*. FIG. 4 shows a plan view of the tab holes 36*tb* which are slightly larger than the ledge shafts 79*s* in order for the ledge-shafts 79*s* can bend slightly to allow for the wider end of the ledge tabs 79*t* to secure the web 302*a*.

FIG. 5 shows an isometric view of a U-shaped spacer brace 302 extending the width of the hole 36 having the internal side facing downward toward the bottom edge of the hole 36 at the web 42 of the support member. The flanges 302*b* have flange notches126*fg* with flare edges 126*f* so the U-shaped spacer brace 302 rests at the end of the flange notches126*fg*. The bottom edge of the hole 36 has two ledge shafts 79*s* with ledge indentation 79*i* on either side so the ledge shafts 79*s* can extend through the web slot hole 36*ws* in the web 302*a* of the U-shaped spacer brace 302. The ledge shaft 79*s* is long enough so the end of the ledge shaft 79*s* can be bent to form ledge tab 79*t*. The ledge tab 79*t* can be bent in both directions so the ledge tabs 79*t* cannot move side to side and the ledge tabs 79*t* with its bent side fitting firmly against the web 302*a* secures the U-shaped spacer brace 302 from moving in a vertical movement between the bent edge of the ledge tabs 79*t* and the flange notches126*fg* forming a self-locking connection. FIGS. 2 & 5 are similar as the U-shaped spacer brace 302 is installed at an angle allowing the side walls of the flanges 302*b* with the flange notches 126*fg* side into the hole side edges 36*se* for a faster easier connection to the hole 36. The flanges 302*b* are installed first then the ledge shafts 79*s* are installed through the web slot holes 36*ws*. FIG. 6 shows the cross section and FIG. 7 shows a plan view of the self-locking connection. Since the ledge shafts 79*s* are long the excess length that extends through the web slot holes 36*ws* are bent after the ledge shaft 79*s* has been installed into the web slot holes 36*ws*.

Figure 8:
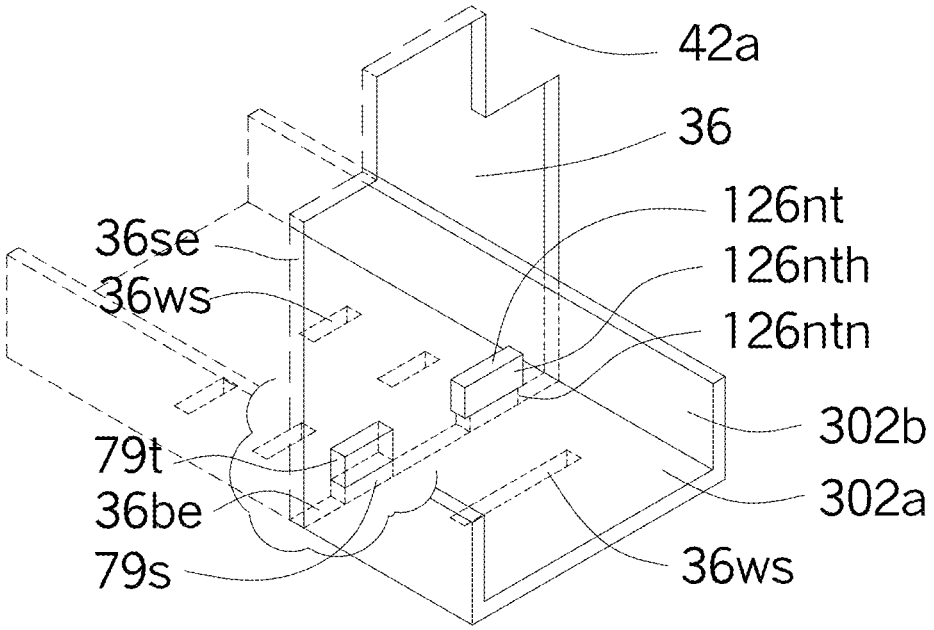
FIG. 8 is similar to FIG. 5 except the web of the spacer brace rests on the hole bottom edge and the left tab has an indentation in the tab to form a notch creating a notch-tab securing the horizontal spacer brace at the hole.

FIG. 8 is similar to FIG. 5 however in FIG. 8 the U-shaped spacer brace 302 has the side walls of the flanges 302*b* extending away from the hole bottom edge 36*be* has the external side facing downward onto the bottom edge of the hole 36 located in the web 42*a* of the support member referred to as a C shape channel 42. The web 302*a* is shown having web slot holes 36*ws* where the left web slot hole 36*ws* shows a ledge shaft 79*s* that extend from the hole bottom edge 36*be*. The left ledge shaft 79*s* is described as a ledge shaft 79*s* also shown in FIGS. 5-7. The right ledge shaft 79*s* is described as a notch-tab notch 126*ntn* when extending through the web slot holes 36*ws* and the ledge tabs 79*t* that extend above the web slot holes 36*ws* are the end or heads external 126*nth* of the notch-tab 126*nt*. The head 126*nth* of a notch-tab 126*nt* is wider than the length of the web slot hole 36*ws* that forms the notch-tab notch 126*ntn*. The hole side edges 36*se* engage the of the flanges 302*b* of the U-shaped spacer brace 302 from moving horizontally between the hole side edge 36*se* and the notch-tab notch 126*ntn* secures the internal and external planes the web 302*b* from moving vertically within the hole 36 and vertically being secured by the head 126*nth* of the notch-tab 126*nt*. The notch-tab notch 126*ntn* of the notch-tab 126*nt* function the same as the ledge shaft 79*s*, except the ledge shaft 79*s* is only the height of the notch 126*ntn* therefore reducing any horizontal bending stress at the notch 126*ntn*. The ledge shafts 79*s* or notch-tabs 126*nt* from the first framing element of the web 42*a* can extend through the web slot holes 36*ws* of FIG. 5 then continue through the web slot holes 36*ws* of FIG. 8 to the underside of the head 126*nth* and/or bending the ledge shafts 79*s* after extending through the web slot holes 36*ws* of the second U-shaped spacer brace 302 thereby securing both members together both horizontally and vertically. The lower the notches 126*ntn* are in relation to the hole bottom edge 36*be* the greater the leverage to produce a stronger notch-tab 126*nt* to reduce horizontal movement between support members.

Figure 9:
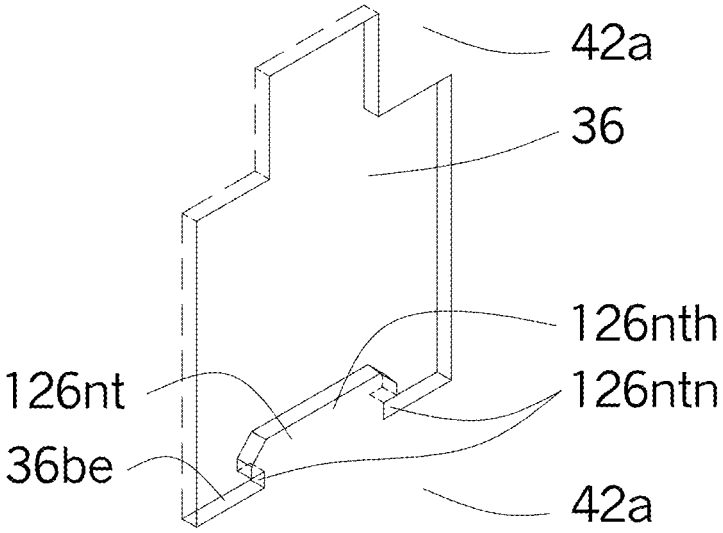
FIG. 9 shows the hole having only one notch-tab where head of the notch-tab with rounded edges

FIG. 9 is similar to FIG. 8 except only one notch-tab 126*nt* without showing the U-shaped spacer brace 302. The notch-tab 126*nt* is shown having rounded edges at the head 126*nth* in order to more easily slide through the web slot holes 36*ws*. Since the head 126*nth* has rounded edges, the U-shaped spacer brace 302 might have to be installed at a slight angle in order for the head 126*nth* to pass through the web slot hole 36*ws*. When only one notch-tab 126*nt* is used as in FIG. 8 only one web slot hole 36*ws* is required which is easier and faster to install. The notch 126*n* of the notch-tab 126*nt* does not have a ledge shaft 79*s* but extends directly from the hole bottom edge 36*be* also referred to as the bottom shoulder of the hole notch 36*be*. Therefore, the notch 126*n* has a configuration consisting of the hole bottom edge 36*be*, the depth of notch 126*nt* within the notch-tab and the notch-tab head 126*nth* of the notch-tab 126*nt* forming the three side planes of the notch 126*ntn*.

Figure 10:
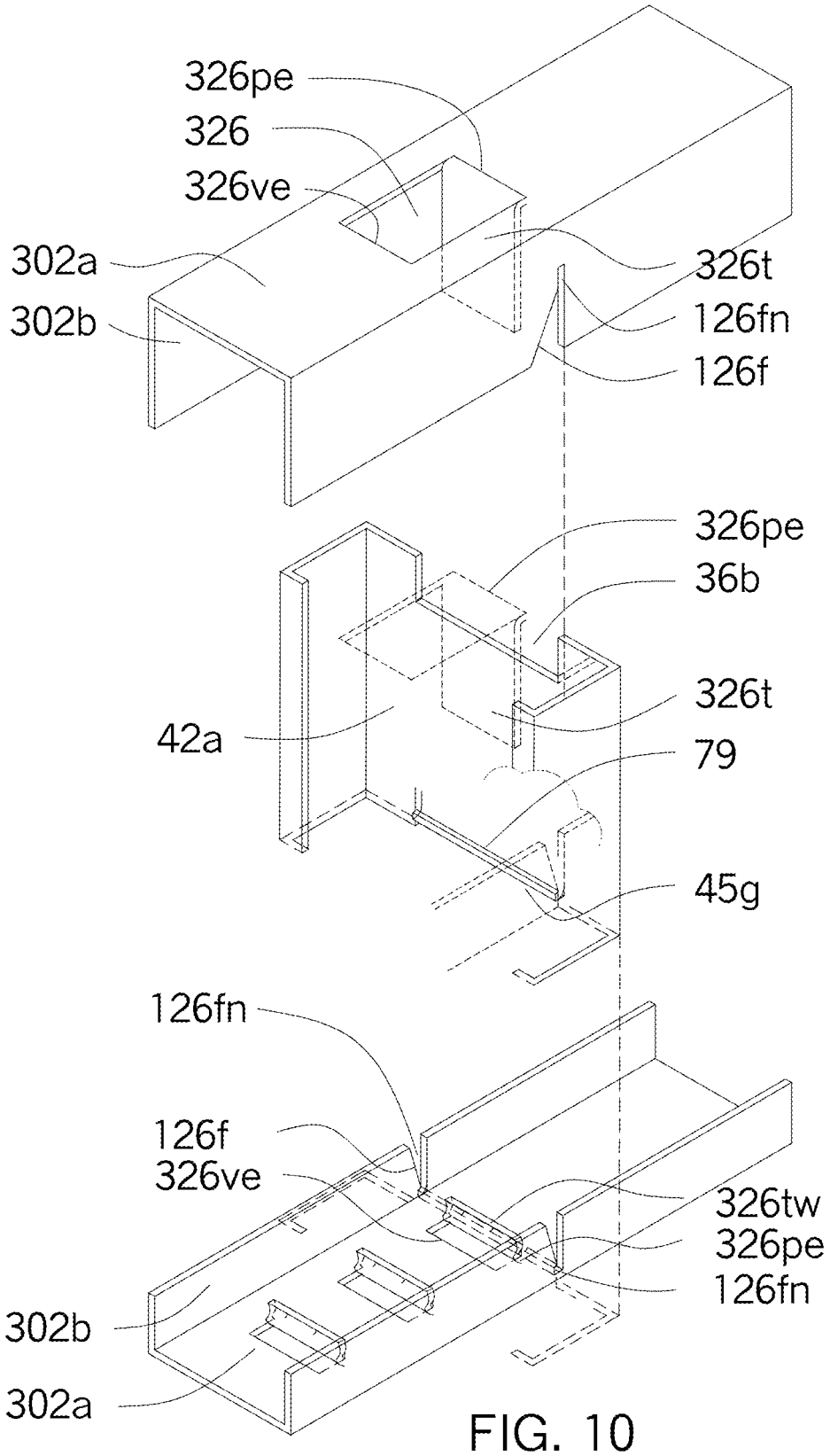
FIG. 10 shows the tabs in the punch out tabs are shown allowing vertical movement at intermediate support members along the space brace at the top of a framing structure.

FIG. 10 shows the U-shaped spacer brace at the floor with its external planar surface facing the floor and the internal side shows the flanges 302*b* extending upward from the web 302*a*. At the center of the U-shaped spacer brace 302 shows a wrap-around tab 326*tw* extending from the pivot edge 326*pe* of the punch out tab 326 wrapping around the ledge 79 extending from the web 42*a* of the support member shown as a C channel 42. The ledge 79 is shown the same width as the U-shaped spacer brace 302. The ends of the ledge 79 are inserted into the flange notches 126*fg* on both flanges 302*b* and the end of the ledge 79 is inserted into a notch gap 126*ng*. The one side of the flange notches 126*fg* has flare edges126*f* so the web 42*a* can more easily fit into the flange notches 126*fn*. The wrap-around tab 326*tw* wraps around the ledge 79 just enough so that the inner side closed the web 42*a* can extend pass the ledge 79 than veer away from the ledge 79 leaving a sort of angular shape so the web 42*a* can extend past the wrap-around tab allowing the wrap-around tab to slight bend so the ledge 79 can become lodged into the flange notches 126*fg* and the notch gap 126*ng*. After the U-shaped spacer brace 302 is installed at the floor another U-shaped spacer brace 302 can be installed at the top end of the support members. The upper U-shaped spacer brace 302 is shown so the support member can move vertically within the wall framing structure unless a fastener (not shown) is attached to the tab 326*t* and the web 42*a*. The top end of the C channel 42 shows the web 42*a* having a bracing hole 36*b* which is the same width as the U-shaped spacer brace 302. The U-shaped spacer brace 302 shows its flanges 302*b* extending internally downward from the web 302*a*. The flanges 302*b* have flange notches 126*fg* extending into the flanges 302*b* with one side having a flare edge 126*f* and the straight edge on the opposite side for a simple and easy connection. The U-shaped spacer brace 302 is inserted into the bracing hole 36*b* so that the flanges 302*b* are inserted between the side edges of the bracing hole 36*b*, so the flange notches 126*fg* engage the bottom edge of the bracing hole 36*b*. When inserting the U-shaped space brace 302, the web 302*a* has a punch out tab 326 with the tab 326*t* extending internally downward so that the tab 326*t* is against the web 42*a* on one side and the opposing side of the web 42*a* rests against the straight edge of the notch 126. When the U-shaped spacer brace 302 has the external side web 302*a* secured to a floor joist above, the floor joist above (not shown) can bend due to earthquakes or increase floor loading (by live or dead loads) the U-shaped spacer brace 302 will slid up and down between the tab 326*t* and the straight edge of the flange notch 126*fg* and will also not move sideways as the U-shaped spacer brace 302 is wedged between the side edges of the bracing hole 36*b* of the support member. If the tab 326*t* was longer in length at the punch-out hole 326, fasteners (not shown) could secure the tabs 326*t* to the web 42*a* and if the wall framing structure would be panelized.

Figure 11:
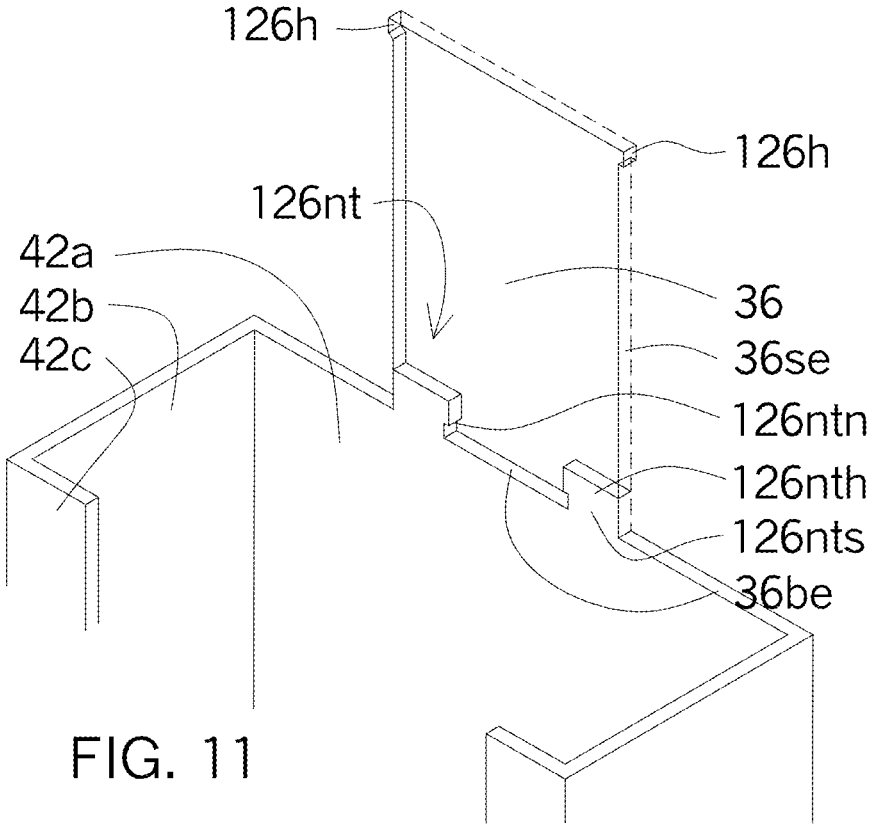
FIG. 11 shows a hole at the web with a web shaft and web tab where the web tab is longer than the web shaft.

FIG. 11 shows an isometric view of a support member shown as a C channel 42 with a rectilinear shaped hole 36 at the web 42*a* also shown with hole notches 126*h* at the hole side edges 36*se*. The hole bottom edge 36*be* has two vertical oriented notch-tab shafts 126*nts* that extend above the hole bottom edge 36*be* with a notch-tab head 126*nth* above. The notch-tab head 126*nth* are slightly longer so that the notch-tab shafts 126*nts* forms a notch-tab notch 126*ntn* forming an indentation between the hole bottom edge 36*be* and the notch-tab head 126*nth*. The longer the notch-tab head 126*nth* the easier the notch-tab head 126*nth* are to bend as shown in FIG. 5.

Figure 12:
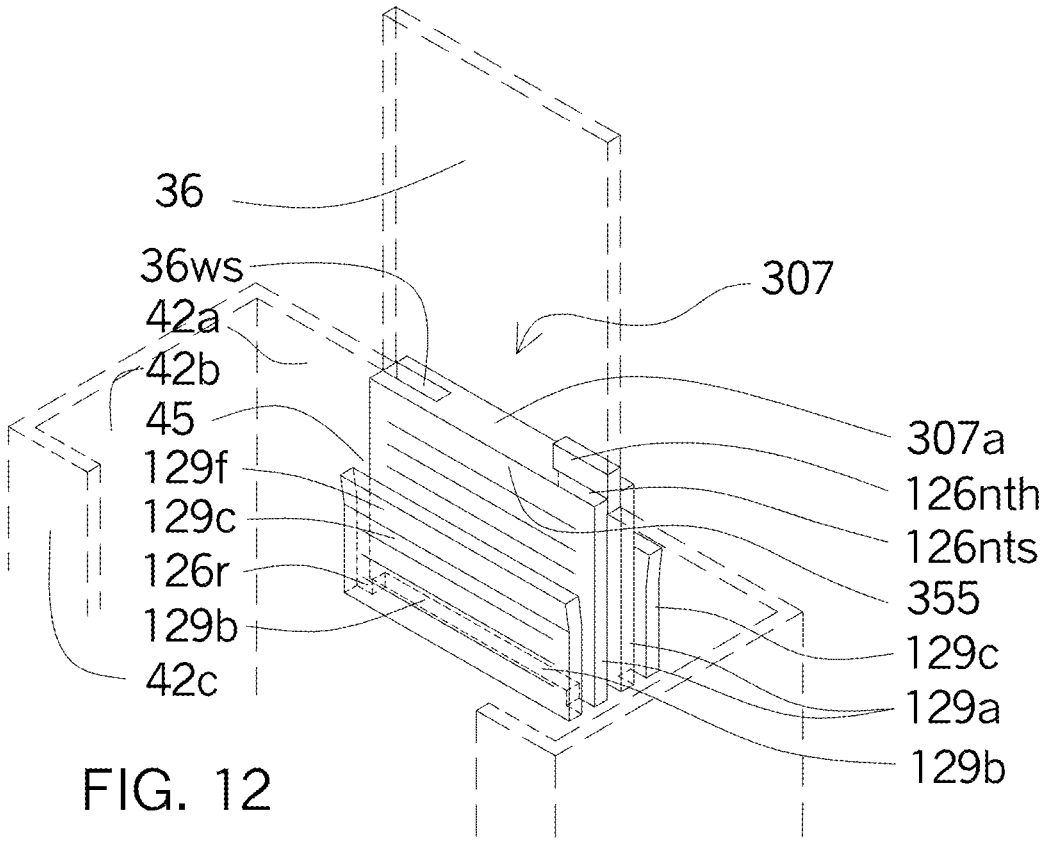
FIG. 12 shows the W shaped clip with the hook receiver end on both sides of the hole having a notch at the web for the web shaft and web tab to fit into.

FIG. 12 shows the notch-tab 126*nt* described in FIG. 11 on the right side of hole 36. The hole bottom edge 36*be* is shown without the notch-tab 126*nt* as described above, however the right side shows the notch-tab 126*nt* extend above a W shaped clip 307. When a W shaped clip 307 is used at a hole 36 having the notch-tab 126*nt*, the web 307*a* of the W shaped clip 307 has a clip notch 126*c* at both sides of the web 307*a* at the vertical side edges of the hole bottom edge 36*be*. The notch-tab shafts 126*nts* and notch-tab heads 126*nth* shown in FIG. 11 extending from the hole bottom edge 36*be*, however the notch-tab shafts 126*nts* and notch-tab heads 126*nth* could also originate at the hole side edges 36*se*. The W shaped clip 307 has an anchor space 355 on the internal side of the web 307*a* at the hole bottom edge 36*be* where the two hook receiver 129 ends extend downward with the first leg 129*a* extending parallel to the web 42*a* of the support member then bending outward at the second leg 129*b* then back upward forming a gap 45 between the first leg 129*a* and the third leg 129*c*. When the internal side of the W shaped clip 307 is installed into the hole 36 the first legs 129*a* of each hook receiver 129 straddle the hole bottom edge 36*be* and the side edge of the web 307*a* gets inserted into the side edges of the notch-tab notches 126*ntn* with the notch-tab head 126*nth* extending over the side of external the web 307*a* securing the web 307*a* to the notch-tab 126*nt* and the hole bottom edge 36*be*. In FIGS. 2 & 5 the U-shaped spacer brace 302 are installed at an angle allowing the side walls of the flanges 302*b* and the flange notches 126*fg* to slide into the hole side edges 36*se* for an easier connection to the hole 36. The ledge shafts 79*s* as well as the notch-tab heads 126*nth* are located adjacent to the hole side edges 36*se*. FIG. 12 shows web slot holes 126*ws* so the U-shaped spacer brace 302 with the notch-tabs 126*nt* or ledge shaft 79*s* fit directly into the web slot holes 126*ws*. The three-sided notch-tabs 126*nts* allow the flange notches 126*fg* to slide directly into the holes side edges 36*se*. The web slot hole 36*ws* at the hole side edge 36*se* shows the opening having only three-sided edges at the web 307*a* allowing for an easier connection into the hole 36.

Figure 13:
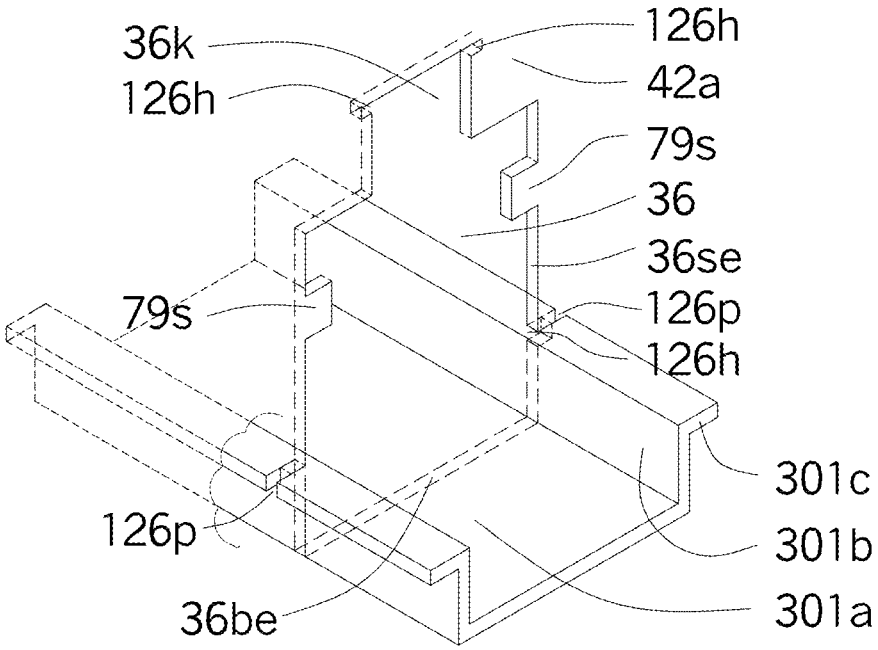
FIG. 13 shows two holes notches in the keyhole and two ledge shafts in the middle of the larger hole along with two-hole notches that intersect a reverse lip spacer brace with lip notches.
Figure 77:
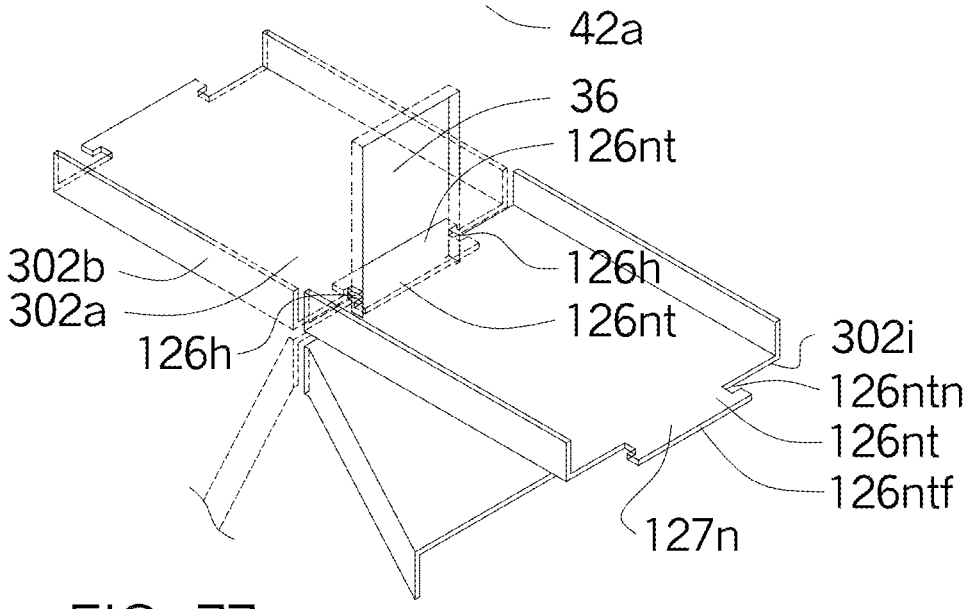
FIG. 77 shows two spacer braces having notch-tab ends overlapping and intersecting at a notched hole.

FIG. 13 shows a reverse lip spacer brace 301 with the external side of the web 301*a* resting on the hole bottom edge 36*be* with the flanges 301*b* extending upward and the lip 301*c* extending outward. Above the hole 36 shows a smaller size hole referred to as a key hole 36*k* where the key hole 36*k* becomes part of the hole 36. The side edges of the key hole 36*k* shows hole notches 126*h* cut into the web 42*a* where one edge of the hole notch 126*h* is an extension of the top edge of the key hole 36*k*. At the upper side of hole 36 shows two ledge shafts 79*s* in FIG. 14 below. In addition, two additional hole notches 126*h* are installed on both hole side edge 36*se* at the intersection of the lips 301*c* which have lip notches 126*p* installed at the outside side edges of the lip 301*c*. The reverse lip spacer brace 301 shows the horizontal oriented lip 301*c* with its lip notch 126*p* installed into the hole notch 126*h* where the hole side edges 36*se* are in a vertical orientation. The depth of the lip notch 126*p* is longer engaging both planes of the web 42*a* and the hole notch 126*h* engages both top and bottom plane of the lip 301*c* thereby interlocking both vertically and horizontally forming a self-locking connection between the two notches. Before one the two notches are totally secure, the lip notch 126*p* on the opposing side lip 302*c* is engaged against the hole side edges 36*se* so the second lip notch 126*p* is continually being forced into the hole notch 126*h* until both lip notches 126*p* are secured into both the hole notches 126*h* by completing the self-locking connection of all four notches. The flanges 301*b* will bend until the lip notches 126*p* are installed into the hole notches 36*h* and then return back to their original configuration after being installed into the hole notches 36*h*. FIG. 1 shows many solutions for connecting adjacent spacer braces together. In FIG. 13 has hole notches 126*h* that are shown at the key hole 36*k* as well as at the hole side edges 36*se*. Additional pairs of holes notches 126*h* can be added at a hole 36 or in other locations so adjacent spacer braces can also connect support members together. By adding additional holes notches 126*h* within the same hole 36, two adjacent reverse lip spacer braces 301 can have their lip notches 126*p* connected to the same hole 36 using a separate pair of hole notches 126*h*. On the other hand, if the hole notch 126*h* is larger, two adjacent reverse lip spacer braces 301 with their lip notches 126*p* can be inverted with the lip notches 126*p* installed into a wider hole notch 126*h* opening. In FIG. 77 the hole notches 126*h* are noted as double height in order to have two horizontal notch-tabs 126*nt* to be inserted into the same hole. In addition, the hole 36 can vary in size and smaller or larger width reverse lip spacer braces 301 can each have the lip notches 126*p* inserted into the same holes.

Figure 14:
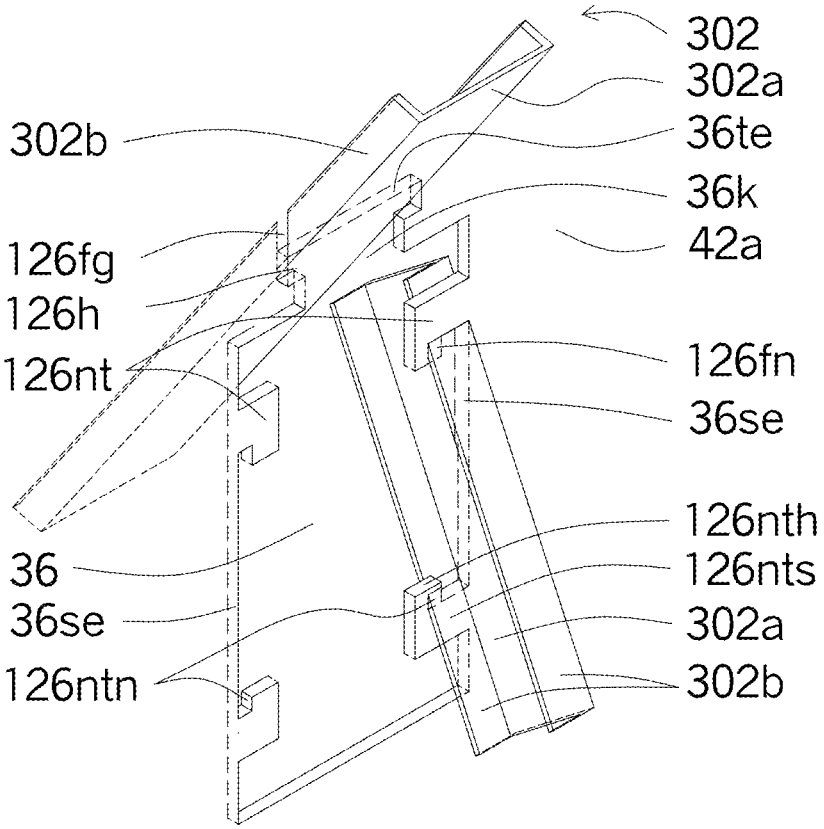
FIG. 14 is similar to FIG. 13 except a U-shaped spacer brace is installed at a diagonal in the hole notches at the keyhole and a vertical oriented U-shaped spacer brace is installed at a diagonal between the notch-tabs on the right side of the hole.

FIG. 14 shows a hole 36 and a key hole 36*k* near the hole top edge 36*te*. The hole notches 126*h* on both sides of the key hole 36*k* shows the width of the hole notch 126*h* slightly wider to accommodate the flange 302*b* having an angular orientation of the U-shaped spacer brace 302. In addition, the U-shaped spacer brace 302 at the key hole 36*k* shows the flange notches 126*fg* engaging the hole top edge 36*te* having the flange notch 126*fg*. The angular flanges notches 126*fg* have the back edge of the flange notches 126*fg* inset into the hole top edge 36*te* or the top edge of the hole notch 126*h* and the back edge of the web 42*a* resting on the bottom edge of the hole notch 126*h* The web will bend longitudinally to connected to the hole notch 126*h*. The self-locking connection is again made, but this time the top and bottom edges of the hole notches 126*h* at the key hole 36*k* and the outside plane of the flanges 302*b* form the self-locking connection. The hole 36 shows two notch-tabs 126*nt* at each of the vertical hole side edges 36*se*. A diagonally oriented U-shaped spacer brace 302 is installed between the notched tab 126*nt* on the right side of the hole 36. The U-shaped spacer brace 302 has the external side of the web 302*a* abutting the hole side edge 36*se* and the head 126*nth* of the notched tab 126*nt* extending over the flange 302*b* and where the notch-tab notch 126*ntn* extend into the flange notch 126*fg* connecting the notch-tab 126*nt* against the hole side edge 36*se*. A flange notch 126*fg* shown in the flanges 302*b* so that flange 302*b* with its flange notch 126*fg* can be inserted into the ledge tab 79*t* and the opposing the web 302*a* & flange 301*b* can be pressured so the ledge tab 79*t* can be inserted into the flange notch 126*fg* forming another self-locking connection. The left key tab 36*k* shows a notch-tab notch 126*ntn* at side edge of the key hole 36*k* similar to FIG. 11 that shows the notch-tab 126*nt* with the notch-tab notch 126*ntn*. A key tab 36*k* is part of the web 42*a* along with the shape of the hole 36, while the notch-tab 126*nt* at the hole side edge 36*se* is the key tab 36*k* separated from the web 42*a*. The key tab 36*k* and the notch-tab 126*nt* at the corner of the hole 36 are similar as the key tab 36*k* is bent at a diagonal while—the notch-tab 126*nt* is bent horizontally.

Figure 15:
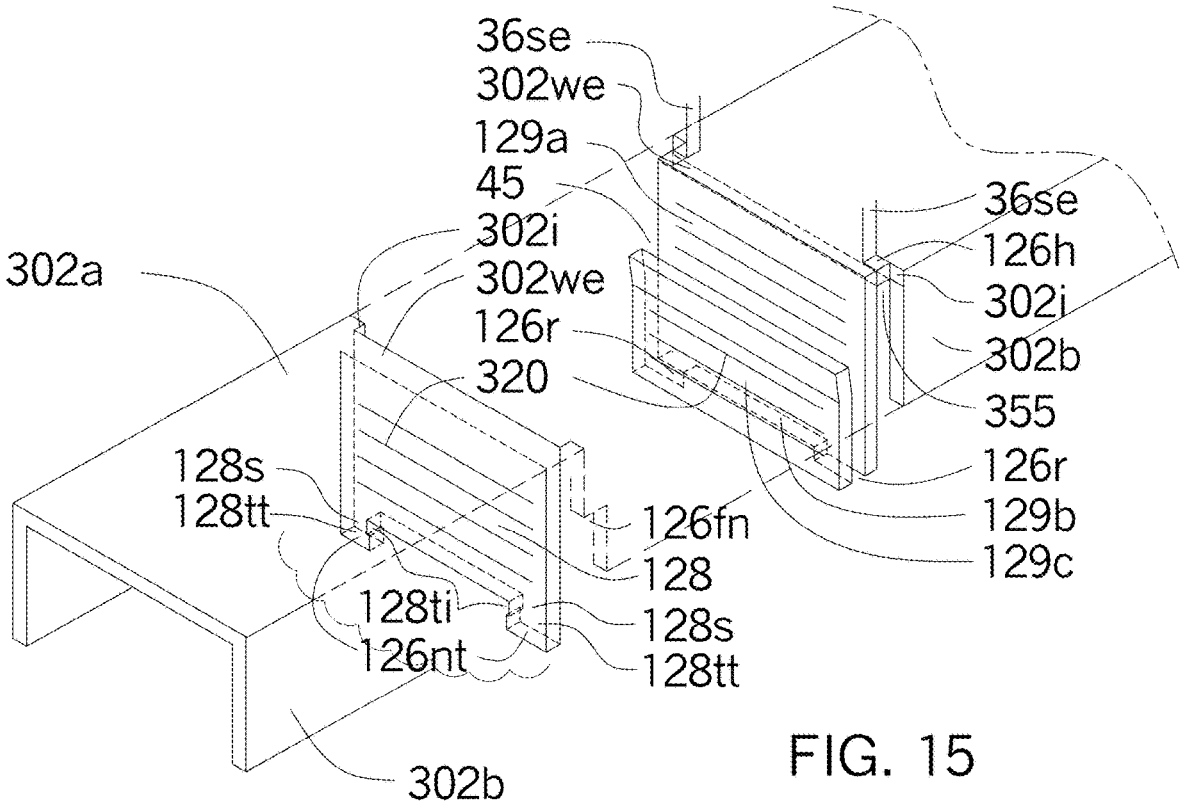
FIG. 15 shows an isometric view of a U-shaped spacer brace having its hook receiver end pass through the hole so the hole notch at the extension fits into hole notches at the side edges and the second leg of the hook receiver end shows receiver notches on both side edges so the tongue end of an adjacent U-shaped spacer brace can fit into the gap between the first and third leg of the hook receiver end and the hook tongue with the tongue shaft and the tongue tabs fit into the receiver notches at the second leg of the hook receiver end.

FIG. 15 shows the self-locking connection between the hook receiver 129 at one end of one U-shaped spacer brace 302 and the opposing end of another U-shaped spacer brace 302 having the hook tongue 128 at the opposing end. The isometric view shows the U-shaped spacer brace 302 abutting the hole 36 where the flanges 302 abut the web 42*a* on one planar surface at the indentation 302*i* in the hole side edge 36*se* and the web extension 302*we* passes through the hole notches 126*h* occurring at the bottom corners of the hole 36 than passes over the anchor space 355 which is the hole bottom edge 36*be* and extends downward at the hook receiver 129 which formed a self-locking connection with the hole notch 126*h*. Since the web extension 302*we* passes into the hole notches 36*h*, the U-shaped spacer brace 302 has to be installed where one side edge of the extension 302*e* fits into the one hole notch 36*h* then the opposing side edge of the web extension 302*we* is pressured to fit into the opposing hole notch 36*h* thereby securing the U-shaped spacer brace 302 from moving vertically as well as horizontally within the hole 36. The hook receiver 129 has the first leg 129*a* extending downward along the web 42*a* plane, then turning outwardly at the second leg 129*b* then back upward at the third leg 129*c* forming a gap 45 between the first and third leg 129*a* & 129*c*. The second leg 129*b* shows receiver notches 126*r* at both the side edges. The receiver notches 126*r* at both sides of the second led 129*b* function the same the web slot holes 36*ws* shown in FIG. 12 as they both have the head 126*nth* of a notch-tab 126*nt* extending through the holes. The adjacent U-shaped spacer brace 302 shows a hook tongue 128 extending downward from the web 302*a* so that the hook tongue 128 fits into the gap 45 of the hook receiver 129. The hook tongue 128 shows a notch-tab 126*nt* comprising of the hook tongue 128, two tongue shafts 128*s* with a tongue tab 128*tt* extending from the tongue shafts 128*s*. The hook tongue tab 128*tt* is slightly longer so the tongue tabs 128*tt* can fit into the receiver notches 126*r* at both sides of the second leg 129*b* allowing the hook tongue tabs 128*tt* to extend over the bottom edge of the second leg 129*b* forming a self-locking connection between the hook tongue 128 and the hook receiver 129. The hooked tongue tabs 128*tt* can be long so the hooked tongue tabs 128*tt* can be bent either at the first or third legs 129*a* or 129*c* of the hook receiver 129 or are shorter and have a hook tongue tab-indentation 128*ti* to connect the hook receiver 129 and hook tongue 128 together.

Figure 16:
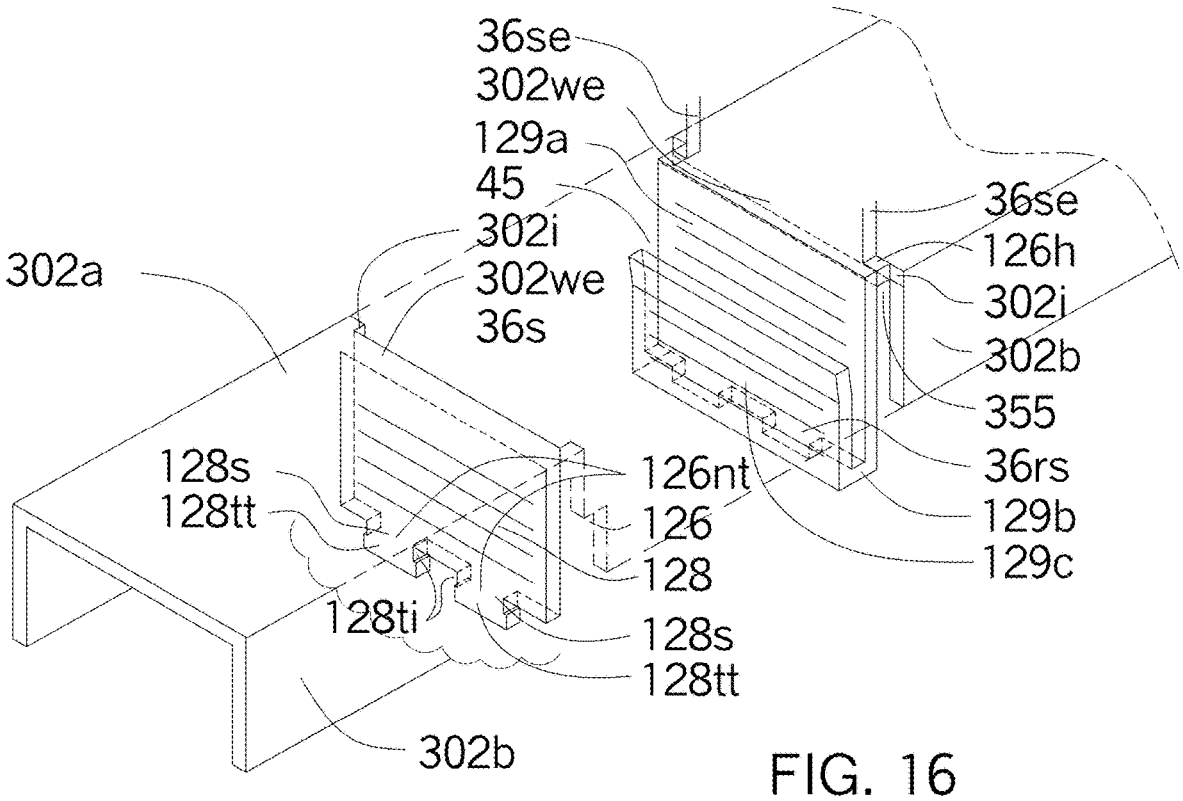
FIG. 16 shows a similar isometric view, however the U-shaped spacer brace has the bottom edge of the tongue end having two notch-tabs shown as tongue shafts with tongue tabs located near the middle so the two tongue tabs fit into the receiver slot holes in the second leg of the hook receiver end.
Figure 48:
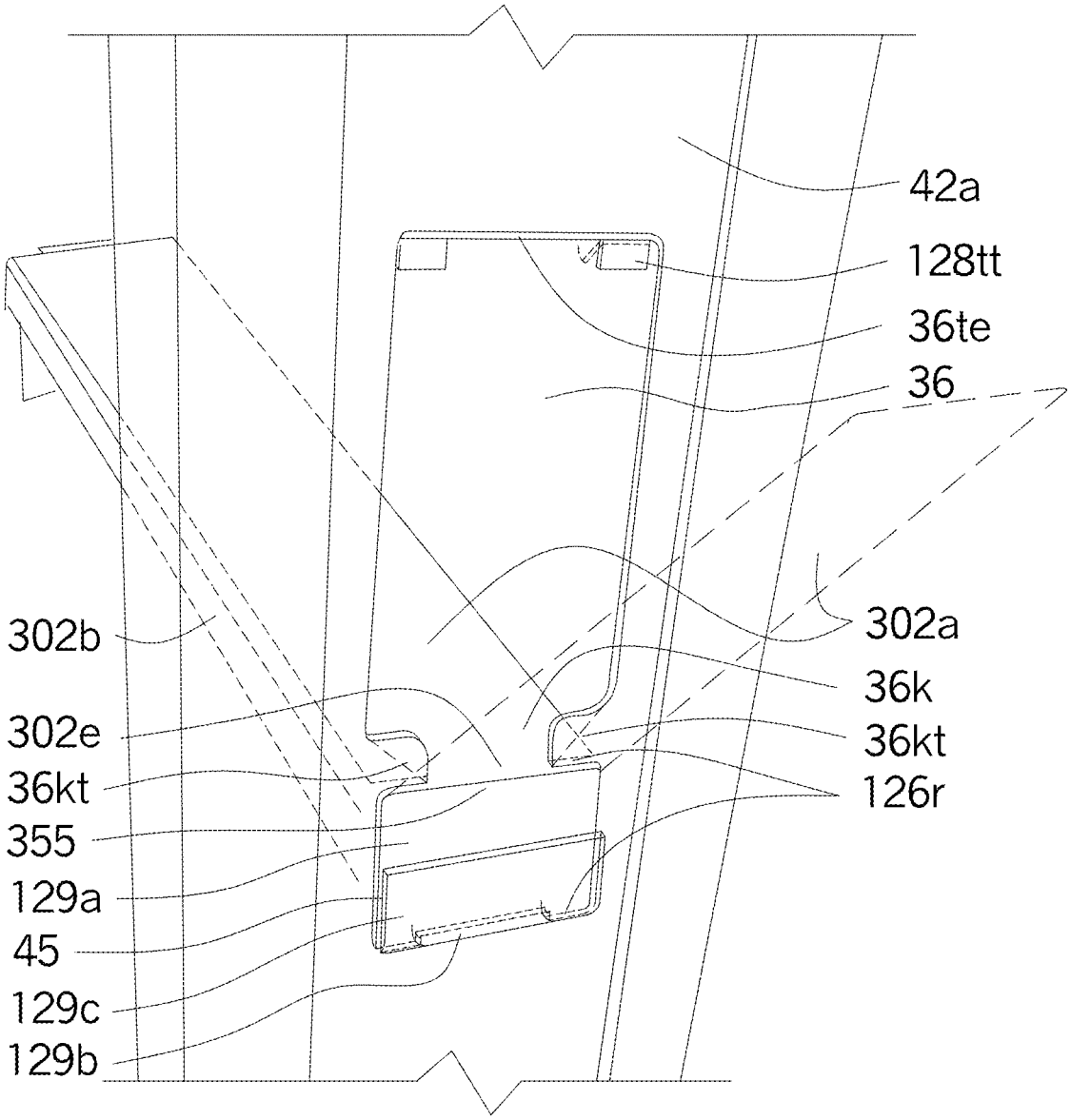
FIG. 48 shows a perspective view of the external side of the support member with the receiver end of the spacer brace extending through the receiver notch into the keyhole tabs at the key hole.

FIG. 16 is similar to FIG. 48 except the interlocking self-locking connection is slightly different. The second leg 129*b* has two receiver slot holes 36*rs* between the first leg 129*a* and the third leg 129*c* and the hook tongue 128 has two corresponding tongue shafts 128*s* and tongue tabs 128*tt* that fit into the receiver slot holes 36*rs*. The length of the hook tongue tab-indentation 128*ti* will depend how much pressure is required to insert the tongue tab 128*tt* through the receiver slot hole 36*rs*. When the tongue tabs 128*tt* are very long, the tongue tabs 128*tt* can be bent to secure the tongue tabs 128*tt* to the hook receiver 129 in lieu of using the hook tongue tab-indentations 128*ti* to secure the hook tongue 128 to the hook receiver 129. The notch-tab 126*nt* is slightly different than shown in FIG. 17 as the hooked tongue 128 has tongue shafts 128*s* having hook tongue tab-indentations 128*ti* on both sides of the hook tongue tabs 128*tt*.

Figure 17:
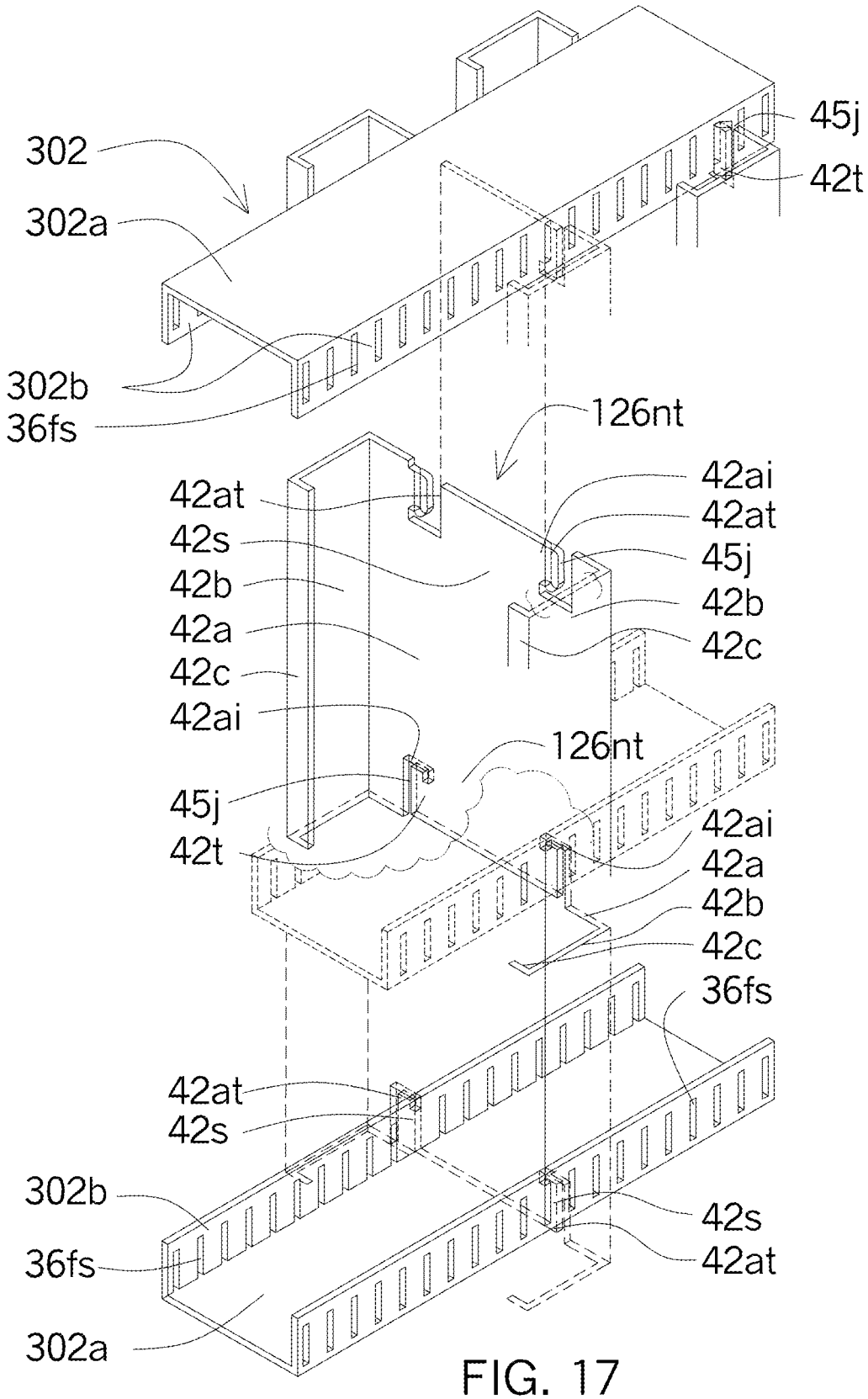
FIG. 17 shows a U-shaped spacer brace at the top and bottom ends of the support member where the lower U-shaped spacer brace has the external side against the floor and has slotted holes of the flanges where the slotted hole lower edge is level with the internal side of the web of the U-shaped spacer brace and the reverse occurs on the top U-shaped spacer brace. The top and bottom edge of the web of the support member shown as a C channel has a gap where the flange between and has a horizontal extension referred to as a web shaft with a web tab where the web tab has the gap between the web and the web tab. The web tab is longer so the web tab can be inserted into the slot holes having the longer edge bind against the slot hole. At the upper U-shaped spacer brace a web tab is shown extending through the slot hole and is bent at the slot hole for an even stronger connection.

FIG. 17 has a U-shape spacer brace 302 at the top and bottom of the support member have the same configuration that is they are both U-shaped having two flanges 302*b* extending from the web 302*a* with an array of flange slot holes 36*fs* where the narrow edge of the flange slot holes 36*fs* are flush with the plane of the internal side of the web 302*a*. The top and bottom ends of the web 42*a* of the support member have a J-shape gap 45*j* where the gap is a J-shaped. The vertical edge of the J-shape gap 45*j* is formed by the space occupied by the outside edge of the flange 302*b*. The internal side of the U-spaced spacer brace consists of a web shaft 42*s* and a web tab 42*at* where the web tab 42*at* forms edge of the J-shape gap 45*j* and the web shaft 42*s* forms the short vertical section of the J-shape gap 45*j* and where the web shaft 42*s* is connected to the web 42*a*. The J-shaped gap 45*j* forms a J-shape because the flange 302*b* fits into the vertical space of J-shaped gap 45*j* plus the web tab 42*at* fits into the slot hole 36*s* and when the first web tab 42*at* slides into the slot hole 36*s* the flange 302*b* will bend outwardly and the opposite J-shaped gap 45*j* will have the opposite side flange 302*b* also bend until both the web tabs 42*at* pass through the flange slot holes 36*fs* allowing the web indentation 42*ai* to be logged between the internal and external side of the flange slot holes 36*fs* in both flanges 302*b* forming a self-locking connection between the web tabs 42*at* in the support member and the slot holes 36*s* in the U-shaped spacer brace 302. If the web tabs 42*at* are long enough the web tabs 42*at* can be bent to form a stronger connection between the support member and the spacer brace.

Figure 18:
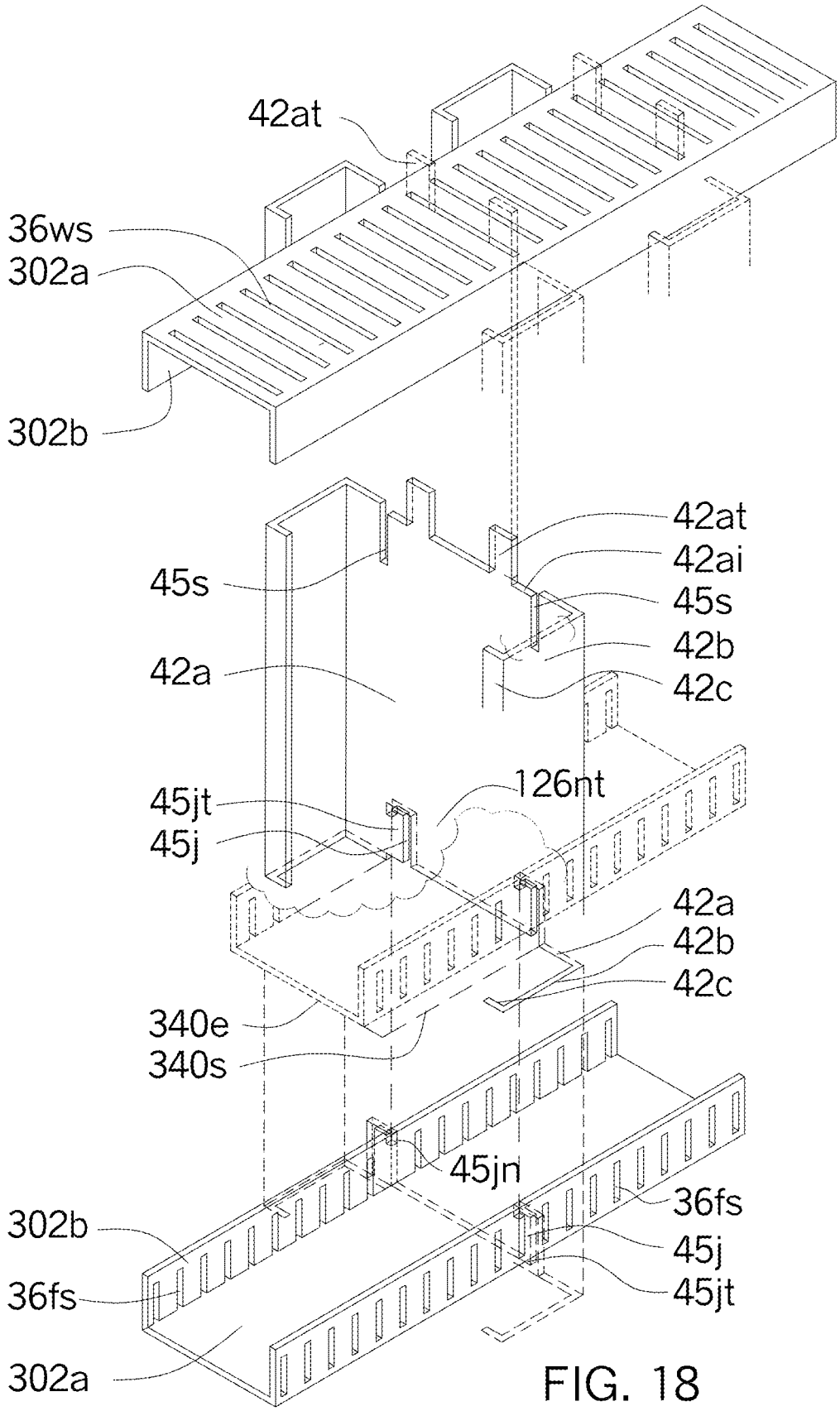
FIG. 18 shows the floor spacer brace similar to FIG. 17 however the top spacer brace shows slotted holes at the web and web tabs extending from the support member extending through the slot holes.

FIG. 18 shows several different ways to form bent tabs. At the top of the C channel web tabs 42*at* extend from the top edge of the web 42*a* and having a slight web indentation 42*ai* where the internal side of a horizontal U-shaped spacer brace 302 having web-slot holes 36*ws* in the web 302*a* for the web tabs 42*at* to pass through an be bent horizontally forming another self-locking connection. The bottom end of the C channel showing U-shaped spacer brace 302 (shown in solid lines) is the same configuration as FIG. 17 which only allows one J-shaped gap tab 45*jt* to be bent per U-shaped spacer brace 302. Another version of a notch-tab 126*nt* is shown as a dashed configuration, with the two J-shaped gap tabs 45*jt* having the J-shaped gaps 45*j* configured in the same direction. The U-shaped spacer brace 302 has the flange 302*b* inserted into the vertical portion of the J-shaped gap 45*j* and when the top edge of the flange slot holes 36*fs* becomes aligned with the hinged side of the J-shaped gap tabs 45*jt* are bent against the flange-slot holes 36*fs* forming a self-locking secured connection. The bottom flange and crossing member are shown and explained in FIG. 17.

Figure 19:
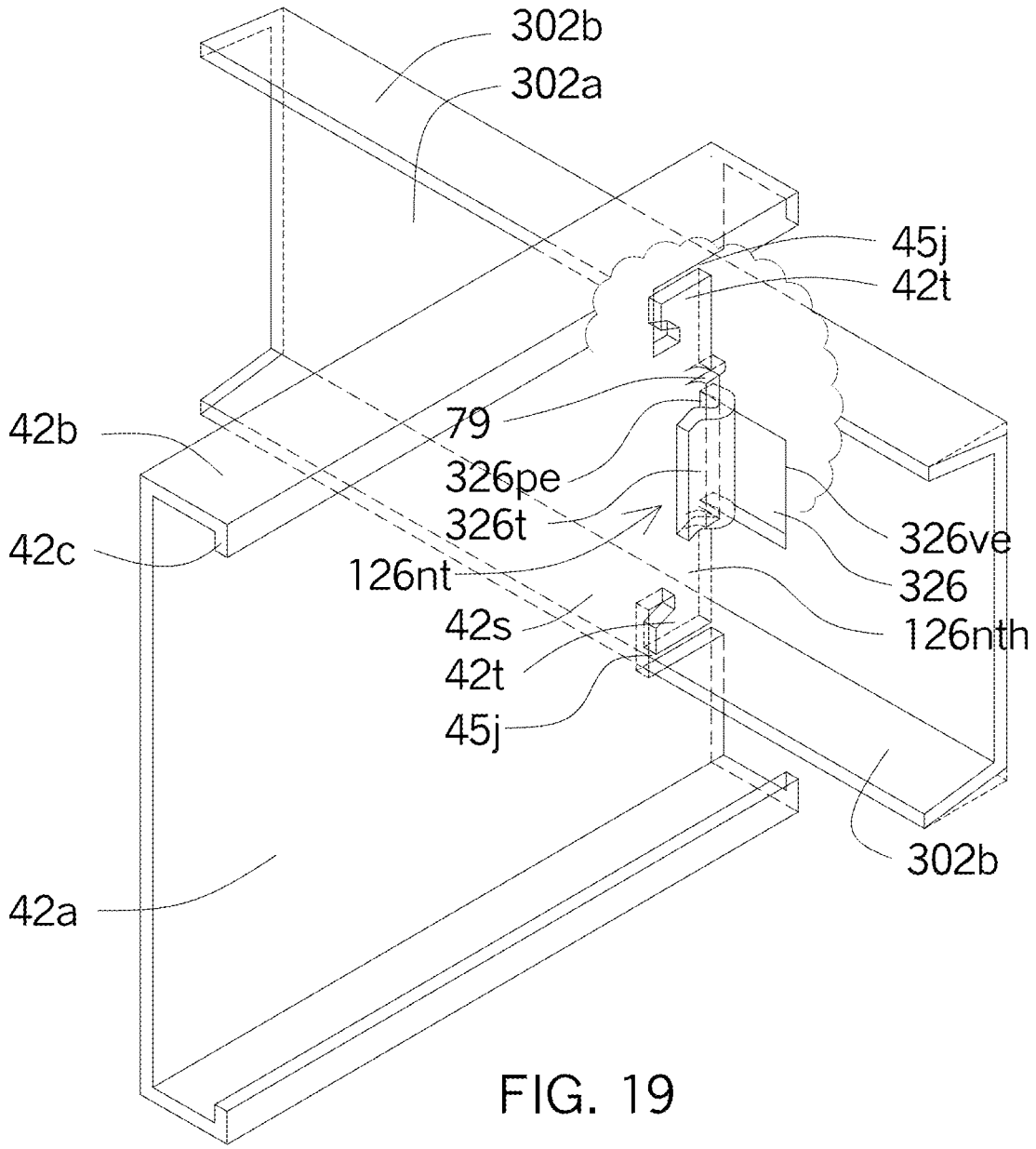
FIG. 19 shows a vertically oriented support channel also referred to as a floor joist intersecting a vertically oriented U-shaped spacer brace sometimes referred to as a rim joist where the webs of both members intersect at the web so that the web of the C channel has a pair of web shafts with web tabs that can fit through the slot holes of the U-shaped spacer brace so the gaps fits between the flanges of the U-shaped spacer braces.
Figure 30:
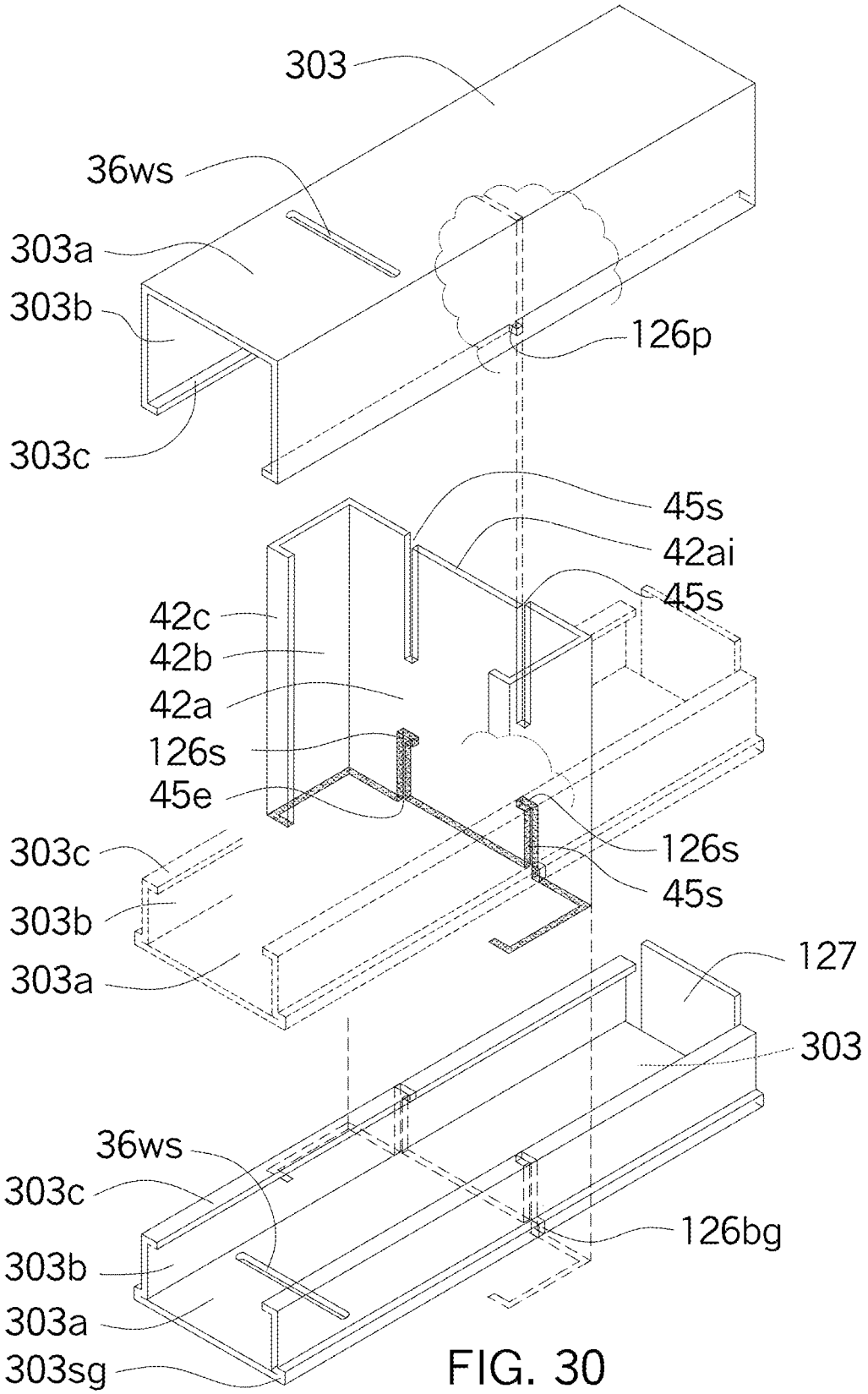
FIG. 30 shows an isometric of a C shaped spacer brace at the top and bottom of a wall using the self-locking slide and fixed connections.
Figure 31:
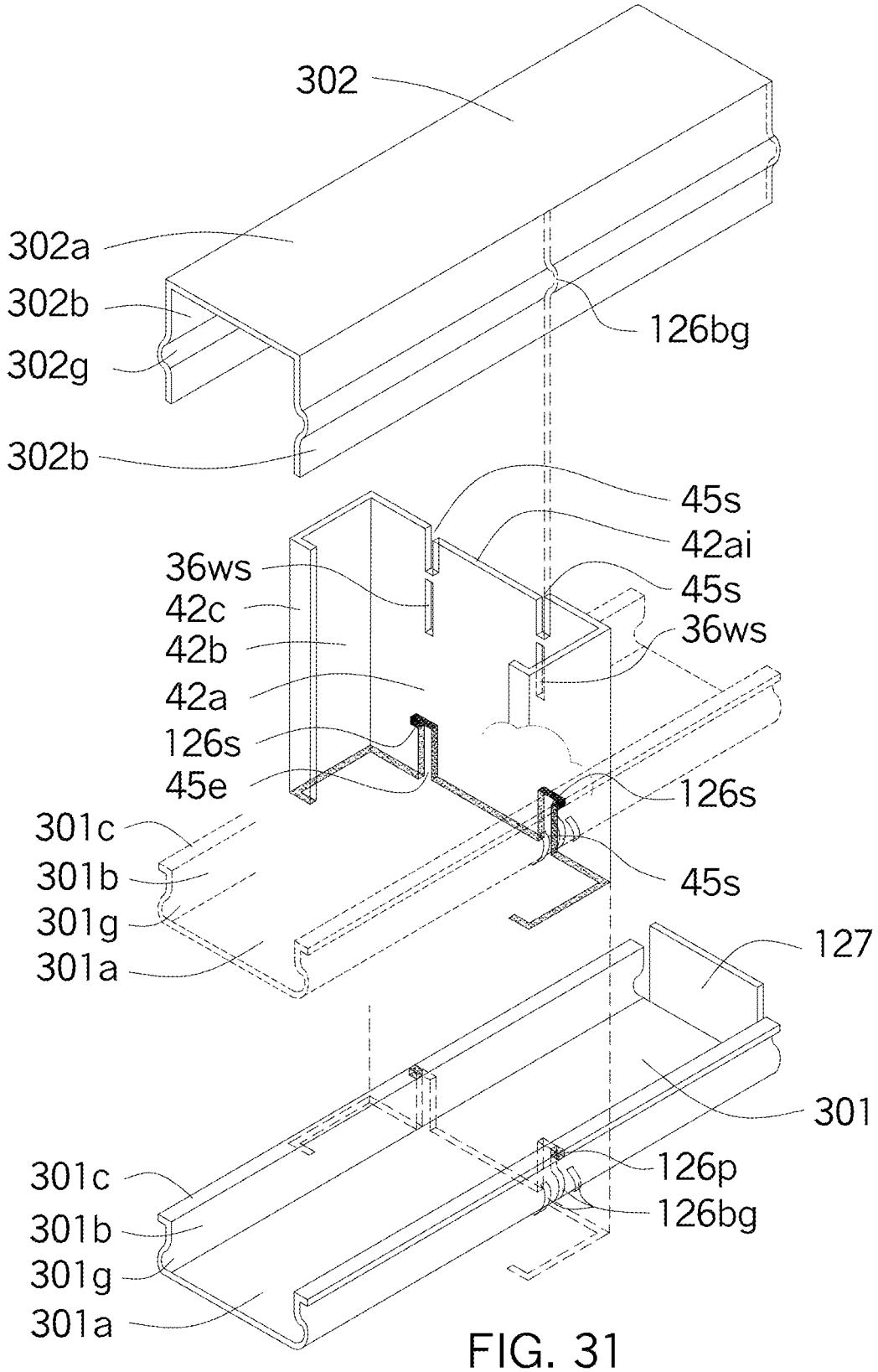
FIG. 31 shows an isometric of the U-shaped spacer brace at the ceiling using the flange bulge notch as the sliding connecting and the reverse lip spacer brace at the floor using the lip notch and the web notch to form a self-locking fixed connection.

FIG. 19 shows the C channel 42 as a horizontal support member having a web 42*a* with two flanges 42*b* and lips 42*c* with the web 42*a* having a punch-out tab 326*t* at its end intersecting a horizontally oriented stringer. The stringer is a U-shaped spacer brace 302 having a web 302*a* with slight canted flanges 302*b* extending outwardly at an angle. The notch-tab 126*nt* at the web 42*a* is a J-shape gap 45*j* as previously described in FIG. 18, however in FIG. 19 a ledge 79 has been added to the head 126*nth* of the notch-tab 126*nt*. The longitudinal edge of the web 42*a* is the end of the notch-tab 126*t* has a ledge 79 similar to the ledge 79 in FIG. 10. The ledge 79 corresponds to the wrap-around tab 326 in the web 302*a* so the pivot edge 326*pe* is under the ledge 79 and the punch-out tab 326*t* at the vented edge 326*ve* wraps around the ledge 79 securing the vented edge 326*ve* against the web 42*a*. Because the flanges 302*b* are slightly angled it will be visually easier to install the web tabs 42*at* into the flange slot holes 36*fs* in the flanges 302*b* which again forms the self-locking connections between a stringer shown here as the U-shaped spacer brace 302 and a floor or ceiling joist or support member shown here as a C channel 42. A similar L-shape gap 45*e* is shown in FIGS. 30 & 31 where a C shaped space brace 303 and reverse lip spacer brace 301 are used to secure the support member and stringer together.

Figure 20:
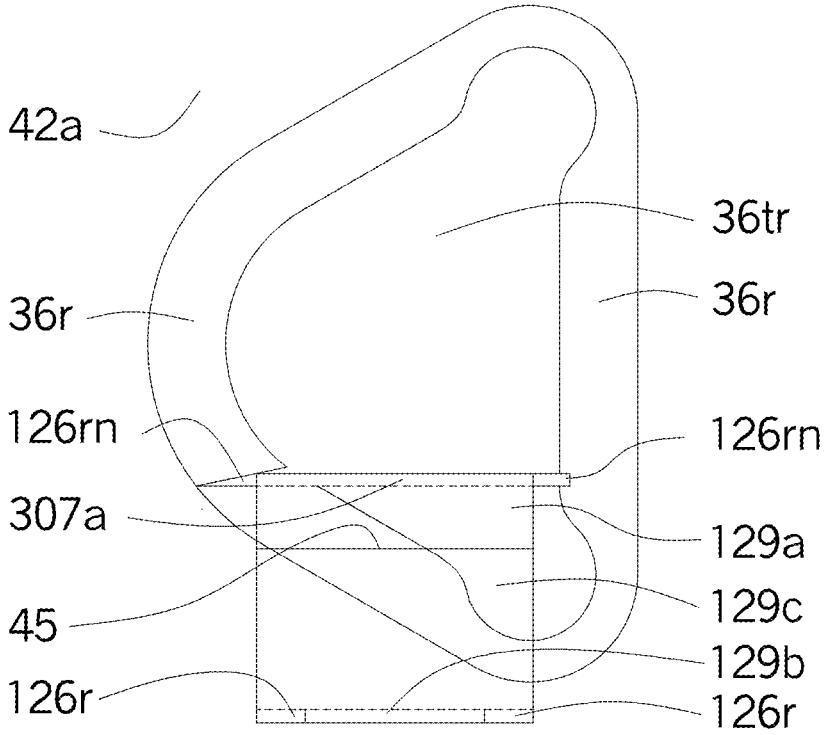
FIG. 20 shows a front elevation view of a W-shaped clip where the top side of the web is inserted into the notches of the rim of the triangular shaped hole along with the notches at both sides of the second leg.
Figure 21:
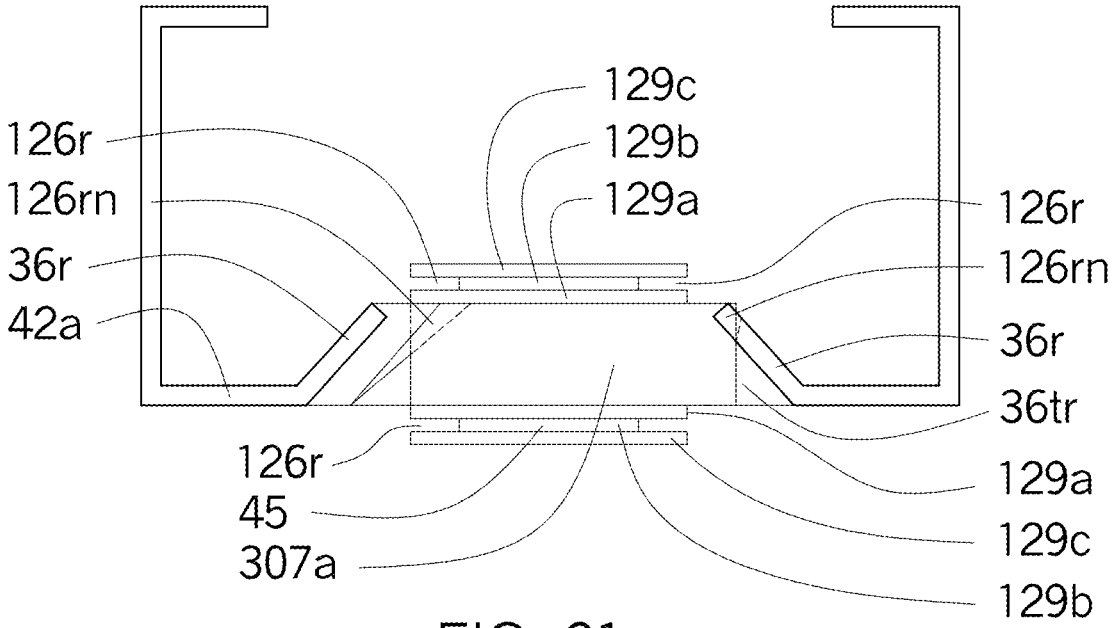
FIG. 21 shows a plan view of the W-shaped clip where the web is inserted into the notches on both sides of the rim with the notches on the outer edge of the second leg of the hook receiver end.

FIG. 20 shows a W-shape clip 307 having a web 308*a* that extends over the rim 36*r* at the triangular shaped hole 36*tr* having a hook receiver 129 shown extending over the internal and external side of the C channel 42. Both side edges of the web 307*a* are inserted into the rim notches 126*rn* at each side of the rim 36*r*. The hole 36 and the rim 36*r* are angular in shape making it difficult to be inserted into the rim notches 126*rm*, however once the side edge of the web 307*a* is inserted into the diagonal oriented rim 36*r* the opposite side edge of the web 307*a* will snap into the rim notch 36*rn* on the opposing side similar to the method used in FIG. 15. The first leg 129*a* is brace on the external side of the web 42*a* of the support member and the opposite first leg 129*a* extends over the rim 36*a*. Both side edges of the web 307*a* are inserted into the rim notches 126*rn* at each side of the rim 36*r*. The left notch is a rim notch 126*rn* as the rim notch 36*rn* is a V-shape having one edge of the rim notch 126*rn* having a diagonal edge so the closer the web 307*a* extends to the point end of the V-shape the tighter the connection will be, while the opposing notch is a perimeter notch 36*p* that has a normal rectilinear shape. The hole 36 and the rim 36*r* are angular in shape making it difficult to be inserted into the rim notches 126*rm*, however once the side edge of the web 307*a* is inserted into the diagonal oriented rim 36*r* the opposite side edge of the web 307*a* will snap into the rim notch 36*rn* on the opposing side similar to the method used in FIG. 15. FIG. 20 shows an elevation view of the triangular shaped hole 36*tr* and the rim 36*r* along with the hook receiver 129 passing through the triangular shaped hole 36*tr*. FIG. 21 shows a plane view of the W-shape clip 307 passing through the triangular shaped hole 36*tr* with the hook receiver 129 extending over the side plane of the web 42*a* and over the hole rim 36*r* at the first leg 129*a* then turning outward at the second leg 129*b* and then turning upward at the third leg 129*c* leaving a gap 45 between the first and third leg 129*a* & 129*c* where receiver notches 126*n* are located at their outside edges in FIGS. 15 & 16.

Figure 22:
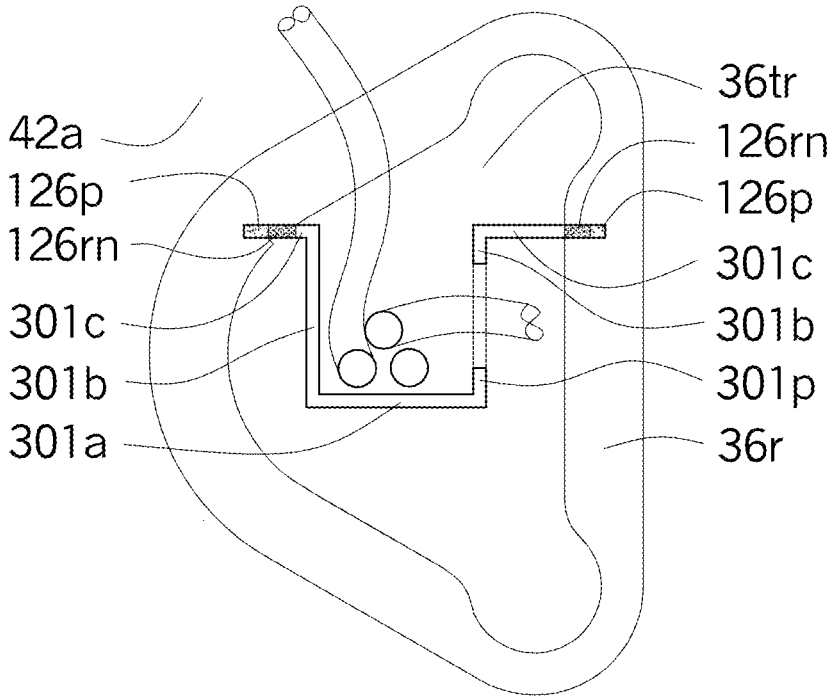
FIG. 22 shows an elevation of a triangular shaped hole with a reverse lip spacer brace where the lips have horizontally oriented notches of the reverse lip spacer brace meet the vertically oriented notches at hole rim have notches so that the horizontal oriented notches intersect the vertically orient notches with the protruding side edges the protruding side edges of the horizontal oriented side edges eliminating any horizontal and vertical movement between notches.
Figure 23:
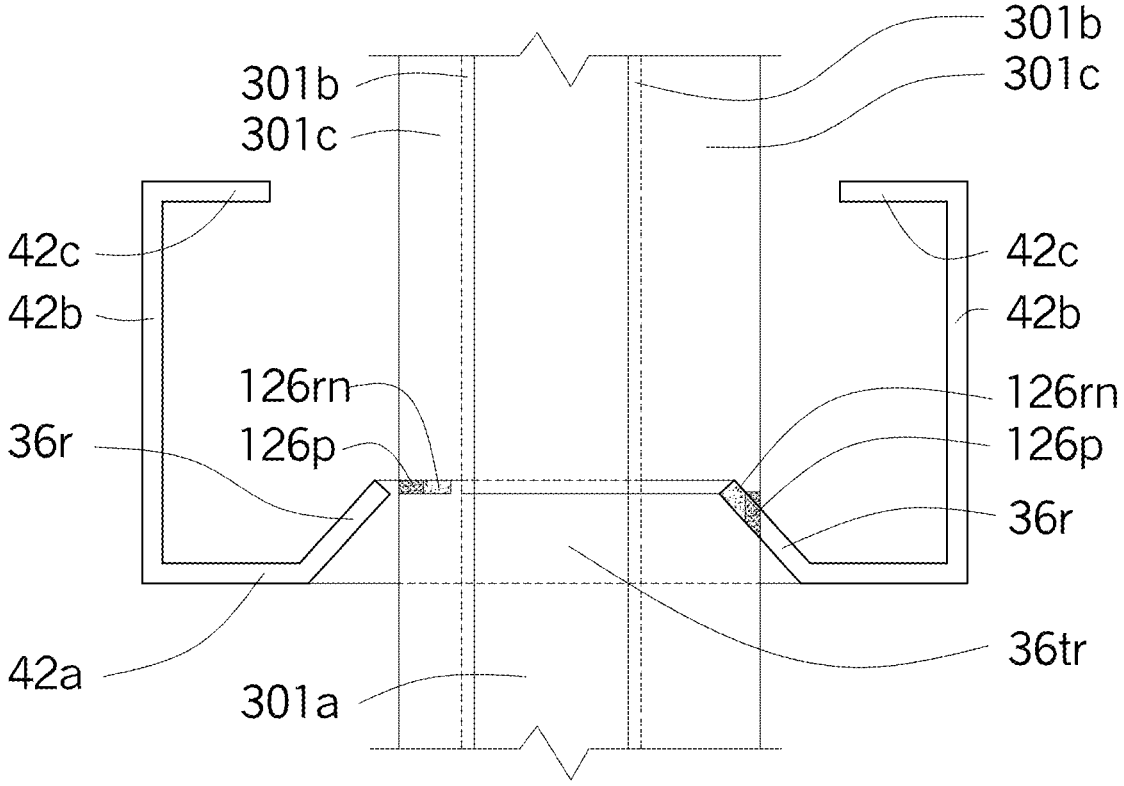
FIG. 23 shows the plan view where the reverse lip spacer brace passes through the triangular shape hole so that only the horizontally oriented holes straddles both side of the hole rim which is also angular being a triangular shaped hole therefore making the notches not a rectilinear shape which would occur had the hole been a rectilinear shape and the hole rim also has the notch that straddles the top and bottom edges of the lip of the reverse lip spacer brace.
Figure 24:
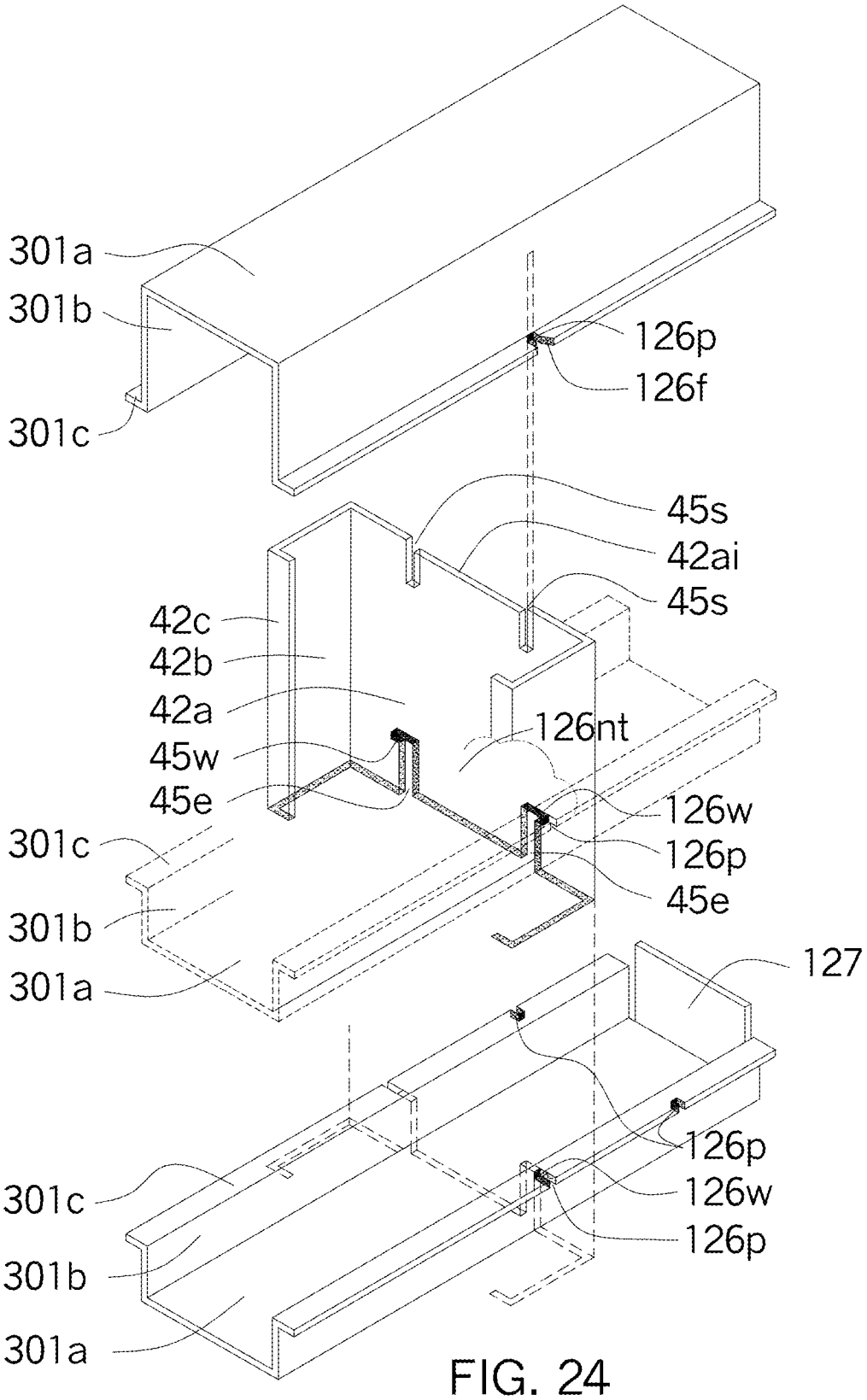
FIG. 24 shows a partial view of a metal framed wall with two reverse lip spacer braces at the top and bottom with a support member connected between spacer braces.
Figure 25:
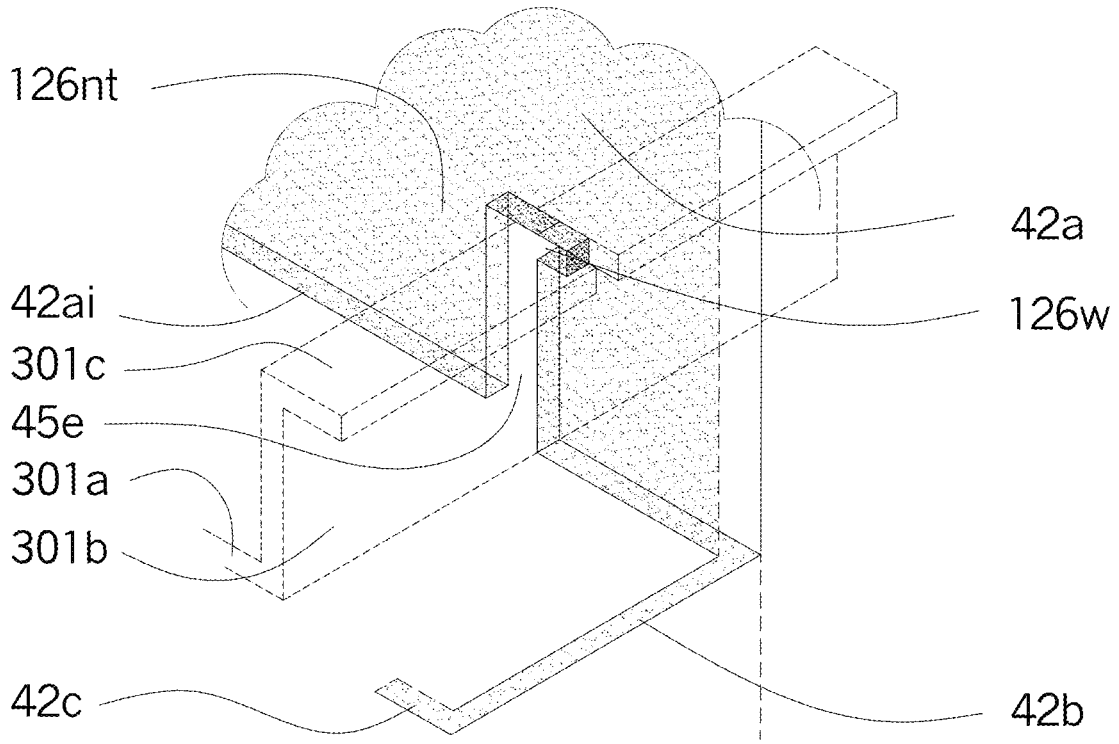
FIG. 25 shows an enlargement of the support member intersecting the reverse lip spacer brace.
Figure 26:
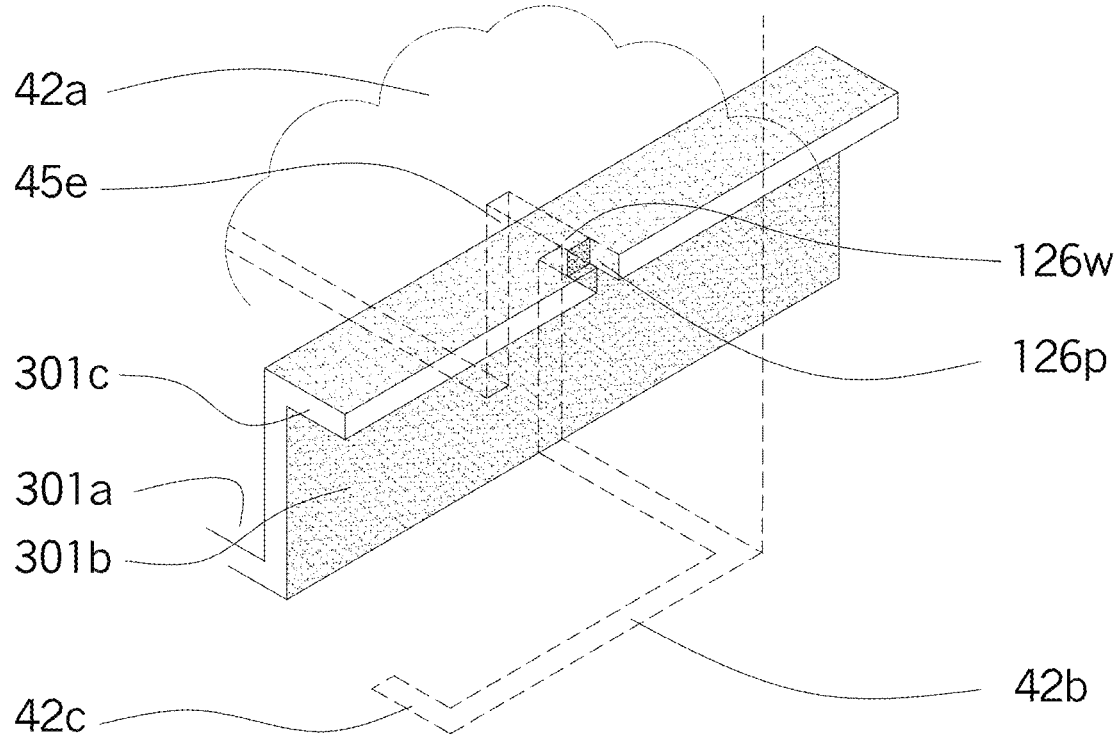
FIG. 26 shows an enlargement of the reverse lip spacer brace where the support member self-locking connection occurs.
Figure 32:
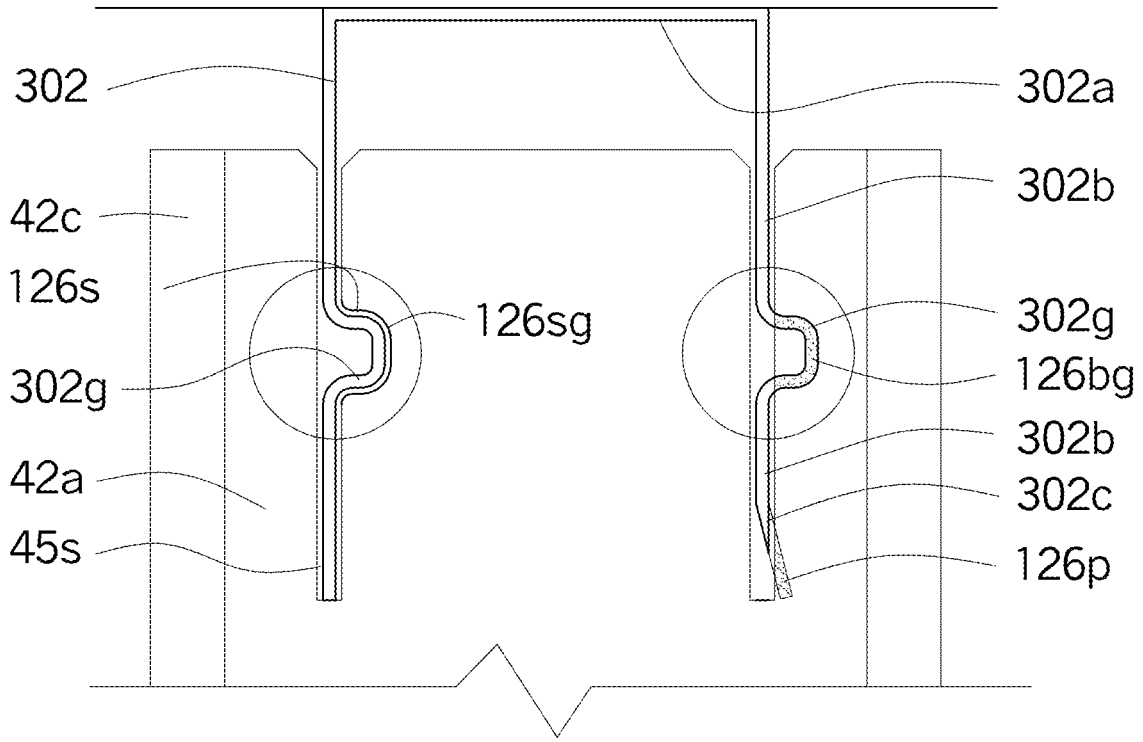
Figure 52:
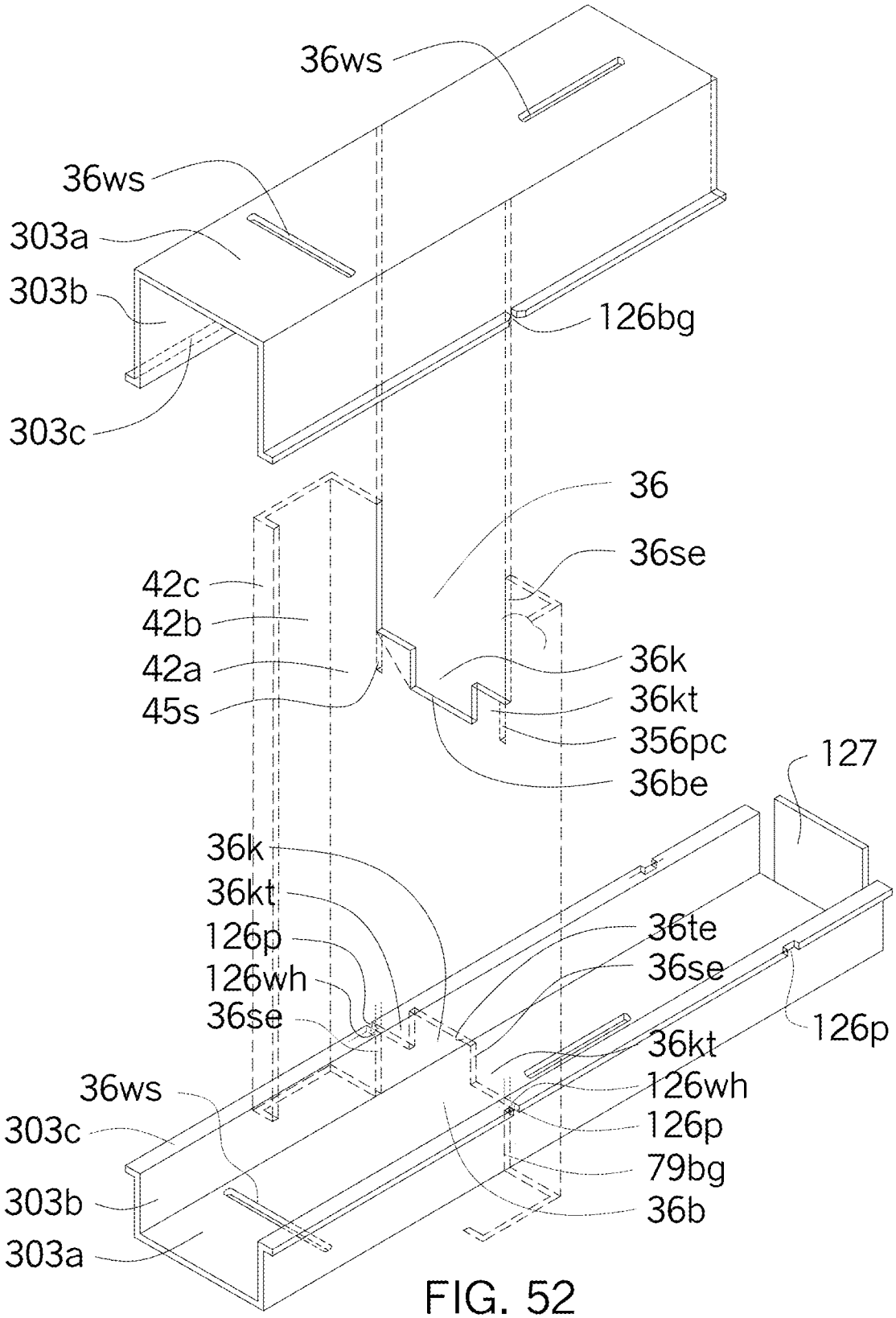
FIG. 52 shows the similar spacer braces in FIG. 31 however here the top and bottom of the support member shows bracing holes having a keyhole and key tabs on both sides of the key hole.

FIGS. 22 & 23 show a similar triangular shaped hole 36*tr* as in FIGS. 20 & 21 except a reverse lip channel or referred to as a spacer brace 301 shows a plan view that better explains the intersection with a web 301*a* and extending flanges 301*b* and horizontal extending lips 301*c* where the lips 301*c* have lip notches 126*p* that extend into the rim notches 136*rm* shown in the rims 36*r* of the triangular shaped hole 36*tr*. The plan view FIG. 23 shows the lip notch 126*p* horizontally at the right side with said rim 36*r* is angled therefore when the lip notch is angled the lip notch will glide into the lip notch causing little friction, however if the lip notch is notch is not angled causing more friction between the hole rim 36*r* and the lip notch 126*p*. When the lip notch 126*p* straddles the hole rim 36*r* friction will occur as the lip notch and the rim 36*r* are not in alignment. On the left side of the triangular hole 36*tr*, because the rims 36*r* are canted inward toward the area occupied by the rim notch 126*r* increase the friction between the two members at the right lip 301*c*. The friction increases when the lip notches 126*p* are angled off center and the hole notches 126*h* from the hole rim 36*r*. The interlocking self-locking connections are made when the lip notches 126*p* installed into the rim notches 126*rm* in the rim 36*r* by having the vertical oriented rim notches 126*rm* interlock to the horizontal oriented lip notches 126*p* creating the interlocking self-locking connections between the two members FIG. 24 shows two reverse lip spacer braces 301 connected by a support member shown as a C channel 42 has a web 42*a* with extending flanges 42*b* and outwardly extending lips 42*c* with longitudinal edges of the lips 42*c* having a lip notch 126*p* with a flare edge 126*f*. The reverse lip spacer brace 301 shown at the top edge of the support member is also shown in FIGS. 31, 32 & 52 and the reverse lip spacer brace 301 is shown in FIGS. 24-26 where the external side of the web 301*a* is against the floor. The support member is shown with the web 42*a* having two L-shaped gaps 126*e* where the flanges 301*b* and lip 301*c* would intersect the web 42*a*. The web 42*a* of the support member is narrow at the L-shaped gaps 45*e* and is wide enough for the flange 301*b* and lip 301*c* to slide into. The flange 301*b* will bend inward when the lip 301*c* and flange 301*b* are inserted into the narrow portion of the L-shaped gap 45*e*—The opposing L-shaped gap 45*e* will also be inserted at the same time. The lips 301*c* will become slanted downward as pressure is applied to insert the lips 301*c* into the L-shaped gap 45*e*. The lips 301*c* could be slanted initially in order to more easily fit into the L-shaped gap 45*e*. Once the lips 301*c* are completely inserted into the L-shaped gap 45*e* the lip 301*c* will flex back into their original position when the lips 301*c* reach the web notch 126*w* at the top of the L-shaped gap 45*e*. The L-shaped gaps 45*e* is more clearly shown in FIG. 25 and the lip notch 126*p* is more clearly shown in FIG. 26. When the lip notch 126*p* is oriented to the longitudinal direction of the reverse lip spacer brace 301 and the web notch 126*w* which is oriented in the direction of the C channel 42 cross, the vertical and horizontal notches become a self-locking secured connection between the two framing members. The web 42*a* between the web gap at the bottom edge of the support member describes the notch-tab 126*nt* with the notch-tab notches 126*ntn* and head 126*nth* as previously described in other notch-tabs.

The second reverse lip channel spacer brace 301 shown at the top of the support member in FIG. 24 shows the internal side extending downward toward the C channel 42. The reverse lip spacer brace 301 has the internal side of the web 301*a* abut the longitudinal edge of the web 42*a*. The web 42*a* shows a web-indentation 42*ai* where the 301*a* crosses the web 301*a* of the reverse lip spacer brace 301. The two slide gaps 45*s* shown at the top end of the web 42*a* have a narrow width wide enough for the flange 301*b* to slide into so the lip notch 126*p* can fit into and wrap around both side planes of the web 42*a* of the C channel 42. When the external side of the reverse lip spacer brace 301 has the web 301*a* secured to a floor or structure above, the reverse lip spacer brace 301 is forced to move or bent when a vertical load is applied to the reverse lip spacer brace 301 then the lip notches 126*p* will slide vertically between side edges of the lip notches 126*p* at the top reverse lip spacer brace 301 forming a self-locking sliding connection between the two framing members.

Figure 27:
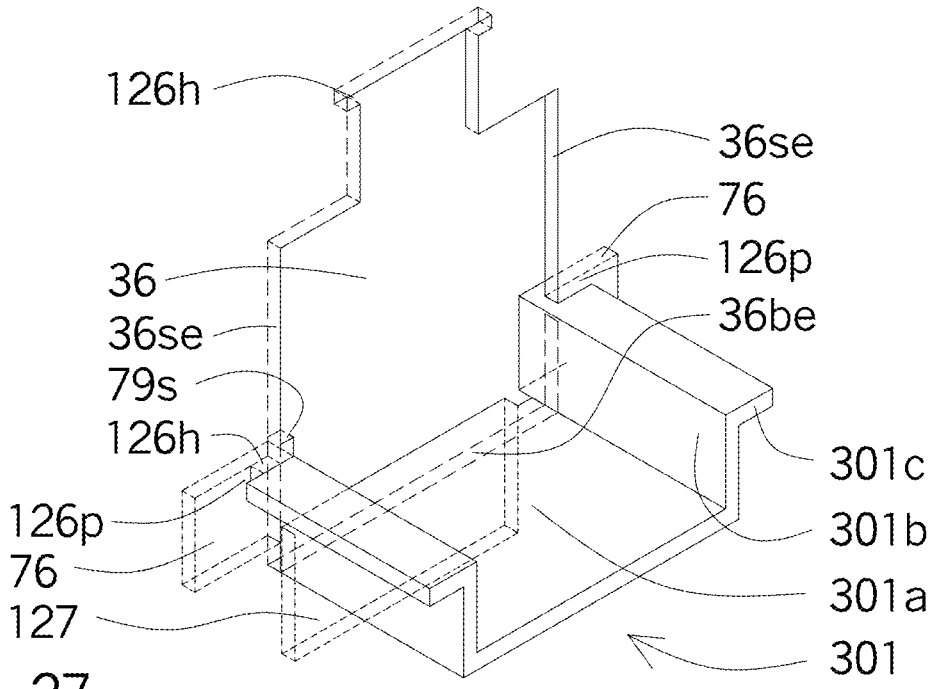
FIG. 27 shows an isometric of a reverse lip spacer brace within a hole and using a hook finger, bent flap and ledge shaft to secure the end.

FIG. 27 shows an isometric view of a reverse lip spacer brace 301 being terminated at the end of the hole 36 where the web 301*a* is extended to form a hook finger 127 that extends downward over the hole bottom edge 36*be* and the two lips 301*c* are show with lip notches 126*p* on the near side and the flanges 301*b* being wrapped around the far side of the hole side edges 36*se*. The nearside of the lip notch 126*p* and the flap 76 will prevent the reverse lip spacer brace 301 from moving horizontally. The hook finger 127 and lip notch 126*p* prevent the reverse lip from moving horizontally. The whole notch 126*h* that supports the lip notch 126*p* prevents the reverse lip spacer brace from moving vertically. Another alternative is the ledge shaft 79*s* (not shown) but described in FIGS. 22 & 23 that could fit above the lip 301*c* to secure the reverse lip spacer brace 301 at the lip and the hole bottom edge 36*be* secured the web 301*a*. In previous pending applications a ledge 79 (not shown) extends from the hole bottom edge 36*be* and the hook finger 127 can wrap around the ledge 79 to also secure the reverse lip spacer brace 301 from moving vertically.

Figure 28:
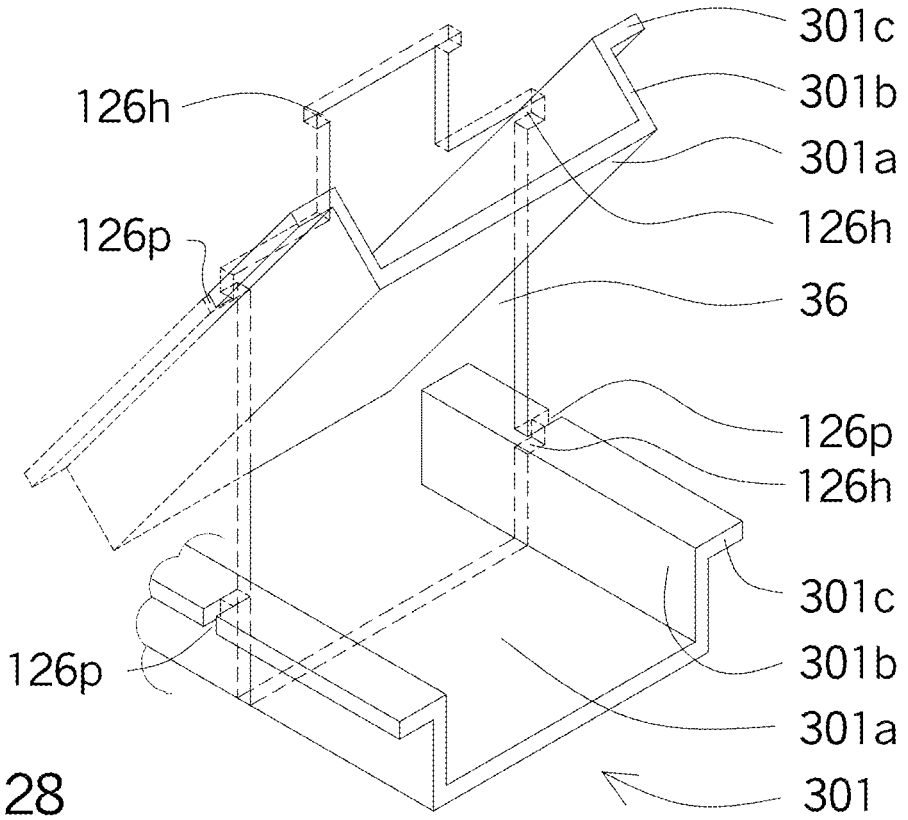
FIG. 28 shows an isometric of a reverse lip spacer brace installed diagonally through the hole.

FIG. 28 shows an isometric view of a reverse lip spacer brace 301 installed diagonally passing through the hole 36 and shown in FIG. 1. The horizontal bracing channel is shown as the reverse lip spacer brace 301 where the lip notches 126*p* can also be expressed as flanges 301*b*, however the lip notches 126*p* would typically be deeper since the lip notches 126*p* have to pass over the web notches 126*w* into the hole notches 36*h* so the lip 301*c* can still be supported in the web notches 126*w*.

Figure 29:
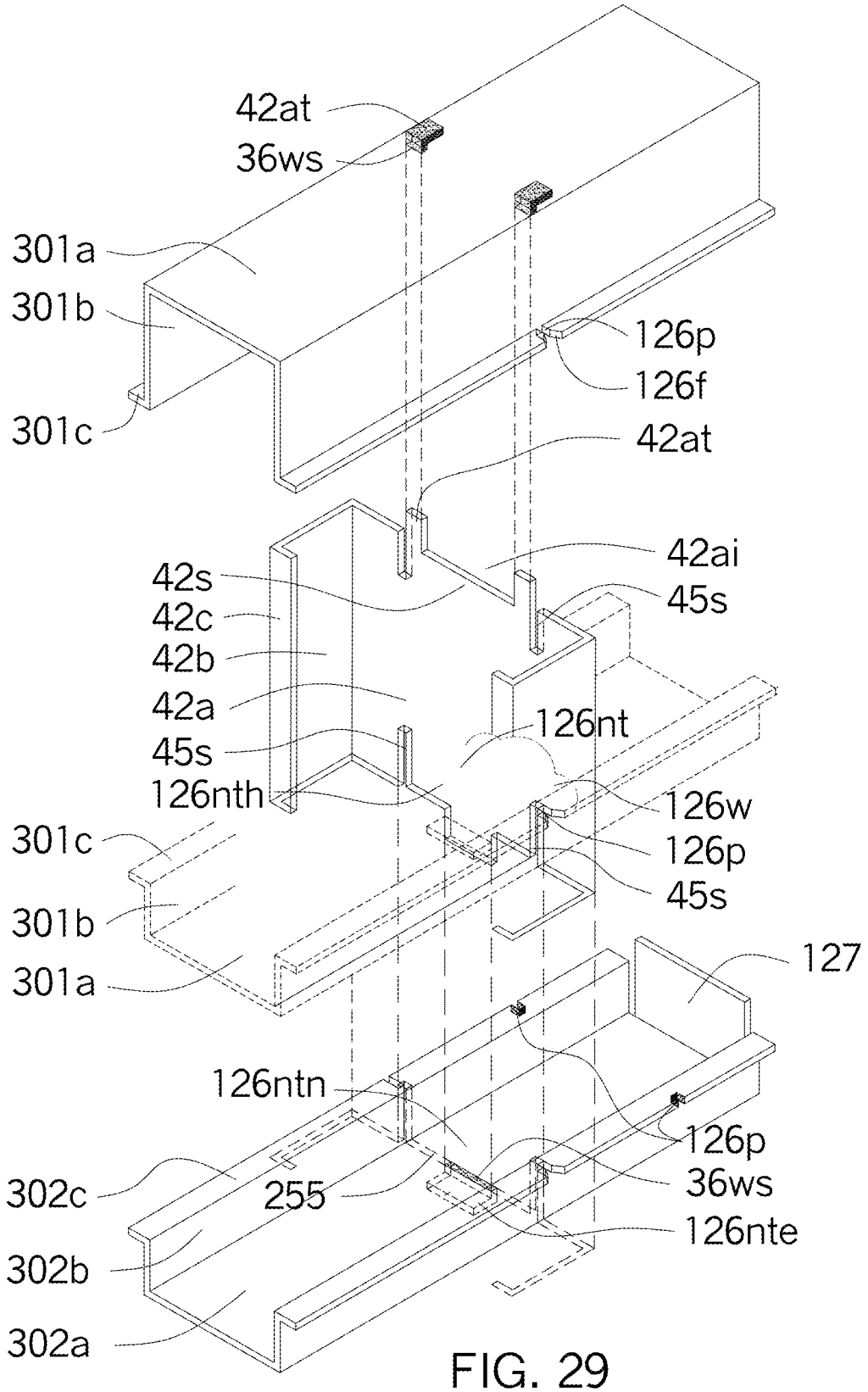

FIG. 29 shows a similar isometric view as FIG. 24 except here a web shaft 42*s* is the anchor space 355 at the internal side of the reverse lip spacer brace 301 at the top of the support member while bottom of the support member has a web tab 42*at* at the head 126*nth* of the notched tab 126*nt*. The web tabs 42*at* extends through the web slot holes 36*ws* and the web tabs 42*at* can be bent or have a notch installed similar to the head 126*nt* of a shown in FIG. 8. This usually occurs when metal framing is assembled horizontally then erected vertically after the web tabs 42*at* are bent. The top reverse lip spacer brace 301 shows two web tabs 42*at*, while the bottom reverse lip spacer brace 301 shows the notch-tab 126*nt* as shown in FIG. 24.

The reverse lip spacer brace channel 301 shown mounted at the floor can also be used at the top of the support members. Other types of spacer braces previously shown in previous pending patents can be installed as a diagonal or using any of the hole notches, rim notches, wrap-around tabs, the tabs from the punch out holes, the hook receiver with hook tongues and hook fingers.

FIG. 30 shows an isometric drawings of a C shaped spacer brace 303 where the external side of the web 303*a* is mounted typically by fasteners (not shown) against the underside of a floor or ceiling with the flanges 303*b* extending downward and the lips 303*c* turning inward and the longitudinal edge of the lips 303*c* has a lip notch 126*p* that occurs at a standard array spacing in alignment with the web 42*a* of an intersecting support member. The bottom of the wall shows another C shaped spacer brace 303 with the external side of the web 303 against the floor and connected by fasteners (not shown). The C shaped spacer brace 303 shown having a sharp bulge 303*sg* at the intersection of the web 303*a* and the flanges 303*b* extending upward being connected to the lips 303*c*. The sharp bulge 303*sg* protrudes from the external side of the flanges 303*b* enough to have a bulge notch 126*bg* that is also in alignment with web 42*a* of the support member. After the C shaped spacer braces 303 are installed at the floor and ceiling the support members can be installed between the two C shaped spacer braces can now be installed. Each of the ends of the web 42*a* have L-shape gaps 45*e* also described as slide gaps 45*s* that correspond to the flanges 303*b* in both the top and bottom spacer braces and the web 42*a* has an web indentation 42*ai* so all the edges of the web 42*a* will rest on the internal side of a crossing member or on the same plane as the external side of the crossing member. The web 42*a* at the top of the support member is inserted vertically into slide gap 45*s* and moved horizontally until the web 42*a* is inserted into the lip notch 126*p*. Taking the support member and lifting the support member higher into the internal side of the web 303*a*, the bottom end of the web 42*a* of the support member will detect the slide gap 45*s* at the bottom edge of the support member. Since the C shaped spacer brace 303 at the floor has a lip 303*c* that is narrower than the slide gap 45*s*, the flange 303*b* will flex allowing the lip 303*c* having a longitudinal edge be allowed to enter the slide notch 126*s* at the end of the slide gap 45*s*, securing the lip 303*c* into the slide notch 126*s*. Once the web 42*a* is secured into the slide notch 126*s* the end of the web 42*a* of the support member can be installed into the bulge notch 126*bg*. A bulge notch 126*bg* can be any type of notch that can protrude from a flange in order form a notch that can be inserted into the web 42*a* of a support member. At the top and bottom C shaped spacer brace 303 the web 303*a* has a web slot hole 36*s* where the web slot hole 36*ws* is oriented so the length of the web slot hole 36*ws* is the width of the C shaped spacer brace 303. So, when a fastener not shown is installed in the web slot hole 36*ws* the C shaped spacer brace 303 will be able to slide horizontally in the direction of the web slot holes 36*ws*.

FIG. 31 is similar to FIG. 30 except a U-shaped spacer brace 302 has its external side of the web 302*a* mounted against the ceiling with its flanges 302*b* extending downward. A rounded shape bulge 302*g* is shown extending outward from the flange 302*b* and in the middle of the longitudinal oriented bulge 302*g* shows a bulge notch 126*bg* that is in alignment with the web 42*a* of the support member. The bottom reverse lip spacer brace 301 has the external side of its web 301*a* fastened (not shown) to the floor with its flanges 301*b* extending upward and its lips 301*c* extending outward. A bulge 301*g* is shown extending outward from the web 301*a* protruding outward from the flange 301*b* so a bulge notch 126*g* can be located in the bulge 301*g* aligned or canted at an angle with the web 42*a* of the support member. Again, the top and bottom spacer braces are mounted at floor and ceiling and the support member has its web 42*a* with its sliding gaps 45*s* inserted into the flanges 302*b* & 301*b*. The bottom end of the support member also has a slide gap 45*s* but is shown with a slide notch 126*s* at the end and aligned so the slide notch 126*s* is on the flange sides of the slide gap 45*s*. After the web 42*a* is inserted in the flanges 301*b* at the slide gap 45*s* of the L-shaped gap 45*e*, then the lip 301*c* is inserted into the slide gap 45*s* and adjusted to fit into the two slide notches 126*s* in both slide gaps 45*s* and the support member is then slid horizontally so the web 42*a* can fit into the bulge notches126*bg*. One end of the web 302*a* is bent to form a hook finger 127 at one end of the reverse lip spacer brace 301. At the top of the support member additional vertically oriented web slot holes 36*ws* are shown and are aligned with the slide gaps 45*s* above. Should a support member need to be cut shorter, the web slot holes 36*ws* would then be used as the slide gaps 45*s*.

FIG. 32 shows a wall section through a longitudinal U-shaped spacer brace 302 where the web 302*a* has the external side mounted against the ceiling with fasteners (not shown) and two flanges extending downward where the right flange 302*b* shows a bulge notch 126*bg* projecting from the external sides of the flanges 302*b*. As further explained bugles 302*b* with bulge notches 126*bg* are required on both flanges 302*b* for the U-shaped spacer brace 302 to slide vertically in the slide gaps 45*s*. The bulge 302*g* has vertical oriented bulge notches 126*g* located at the slide gaps 45*s* so the sides of the vertically oriented bulge notches 126*bg* engage both planes of the web 42*a* of the support member. The bulges 302*g* can be located on the internal or external side of the U-shaped spacer brace 302. The bulge notches 126*bg* are notched typically 16" or 24" on center and can have a flared edge to make it easier to insert into the slide gap 45*s* which is also shown to have a flared edge at the end of the support member. When bending occurs from a ceiling or floor member above, the slide gaps 45*s* located in the web 42*a* of the support members, allows the U-shaped spacer brace 302 to move vertically by allowing the support member to slide vertically within the slide gaps 45*s*. On the left side the bulge 302*g* is shown extending inward on the internal side of the U-shaped spacer brace 302. In this case the left bulge 302*g* does not have a bulge notch 126*bg* in the bulge 302*g*, but a slide bulge notch 126*sg* is shown on the internal side of the slid gap 45*s* so the bulge 302*g* can be inserted into the slide notch 126*s*. By having the right slide gap 45*s* have a bulge notch 126*bg* and the left slide gap 45*s* having a slide notch 126*s*, the two different types of notches interlock the support member and the U-shape spacer brace 302 together. Also, in FIG. 41 a lip 302*c* is shown in lieu of the bulge 302*g*. When the lip 302*c* is turned so the lip 302*c* is extending on the external side the spacer brace has been referred to as a reverse lip spacer brace 301, however for explanation purposes the lip 302*c* has a lip notch 126*p* shown at the longitudinal end that engages the slide gap 45*s* similar to a previous FIG. 29.

Figure 33:
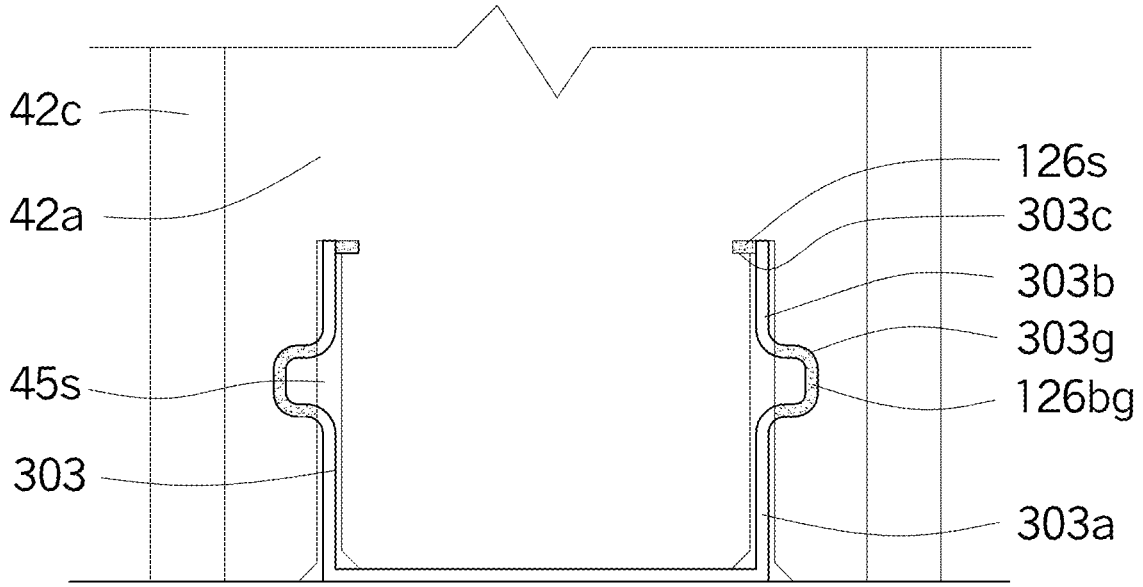

FIG. 33 shows the wall section in FIG. 32 extending to the floor line where the C shaped spacer brace 303 has the web 303*a* with its exterior side mounted at the floor by fasteners (not shown). The flanges 303*b* extend upward with the lips 303*c* extending inward from the flanges 303*b*. The flanges 303*b* also have the bulge 303*g* protruding external from the flanges 303*b* and have a bulge notch 126*bg* occurring typically 16" or 24" on center. The support member has the slide gap 45*s* at the bottom of the web 42*a* along with a slide notch 126*s* for the lip 303*c* to be inserted into. When the web 42*a* is inserted into the slide gap 45*s* the lip 303*c* along with the flange 303*b* will bend then the bulge notch 126*g* will engage the side planes of the web 42*a* at the slide gap 45*s* until the lips 303*c* are inserted into the slide notches 126*s* in the web 42*a* of the support member.

Figure 34:
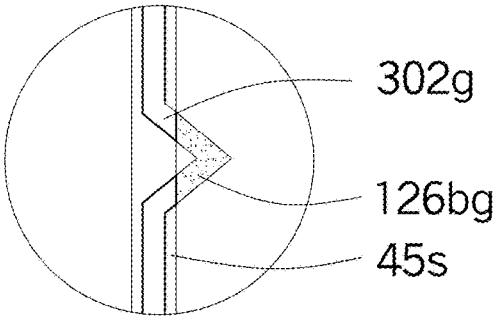
FIGS. 34-41 shows various spacer brace bulge notches and flange bulges when intersecting the support member.
Figure 35:
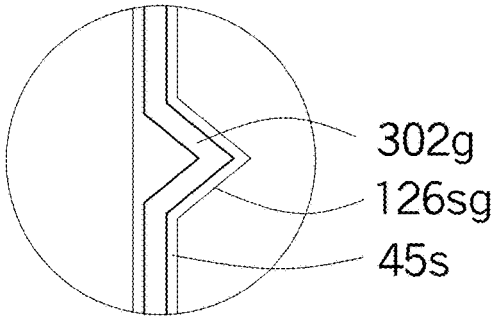
Figure 36:
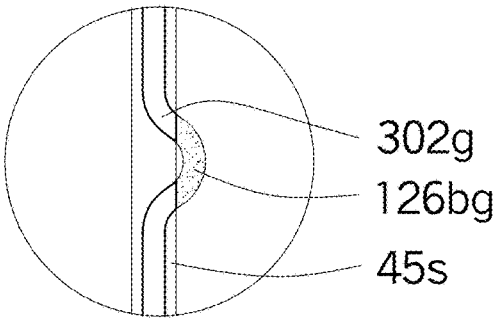
Figure 37:
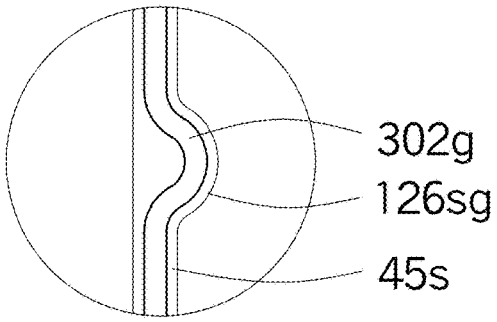
Figure 38:
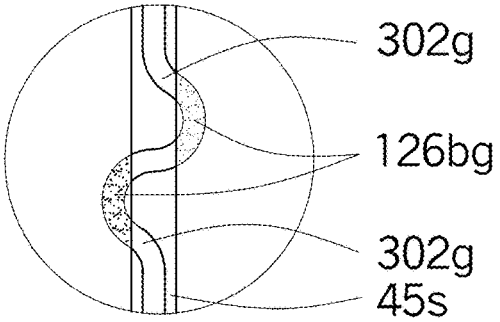
Figure 39:
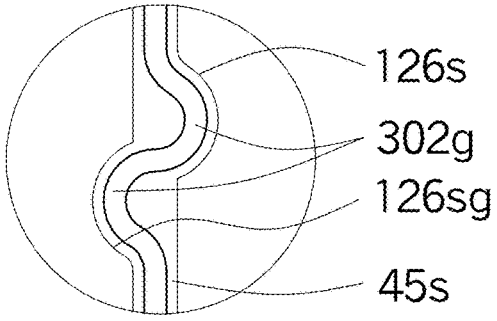
Figure 40:
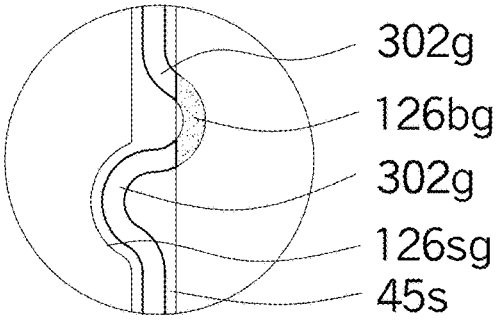
Figure 41:
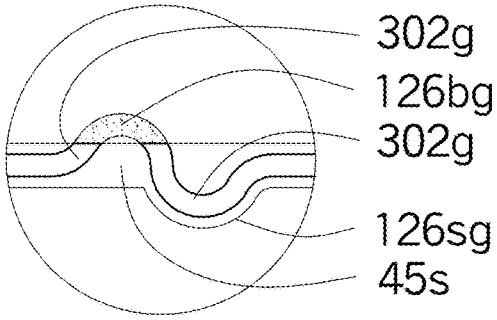

FIGS. 34-41 shows the cross section of various configurations of bulges that can be used to form the bulge notches 126*bg* located in the bulges 302*g* or slide notches 126*s* located in slide gaps 45*s* or holes notches 126*h* located in the holes of the support members. Only one flange is shown in the enlargements, however typically the bulges 302*g* are located on both flanges of the spacer brace. The bulges 302*g* can be located anywhere along the plane of the flanges and located in a slide gap 45*s* of a web 42*a* of a support member. A U-shaped spacer brace 302 is used where the bulge 302*g* extends wider than the slide gap 45*s* so a bulge notch 126*bg* can be formed on the external side of the bulge notch 126*bg* so both sides of the bulge slide notch 126*sg* engage both sides of the slide gap 45*s*. The bulges 302*g* can be located on either side of the slide gap 45*s*. FIG. 34 shows a pointed shape bulge 126*g* having a vertex where the two planes intersect with a bulge slide notch 126*sg* located where the web 42*a* of the slide gap 45*s* intersect the bulge slide notch 126*sg* and in FIG. 35 the pointed shaped bulge 126*g* does not have a bulge slide notch 126*sg*, but instead has a slide notch 126*s* so the bulge 302*g* can fit into and will be lodge into the slide notch 126*s* and will not move vertically within the slide notch 126*s*. FIGS. 36 & 37 are similar however the bulge 302*g* is like a half-circle shaped bulge and in FIG. 36 the bulge 302*g* has a bulge notch 126*bg* and in FIG. 46 the bulge 302*g* is continuous and the slide gap 45*s* has a slide notch 126*s* to fit into. FIGS. 38 & 39 are similar to FIG. 36 that is the bulge 302*g* is a combination of two bulges 302*g* as shown in FIG. 36 where one-half of the bulge 302*g* extends over the internal side of the slide gap 45*s* and the other half of the bulge 302*g* extends over the external side and both halves have the bulge notch 126*bg* that extends over the side plane of the slide gaps 45*s*. FIG. 39 is similar to FIG. 38 having two half bulges 302*g* each extending over the external and internal sides of the slide gap 45*s*, however both bulges 302*g* extend into the slide notches 126*s* of the slide gap 45*s*. FIG. 40 is similar to FIGS. 38 & 39 as the bulge 302*g* consist of two half bulges where one half bulge has bulge notch 126*bg* and the other half bulge has a slide notch 126*s*. FIG. 41 is the same as FIG. 40 except the slide gap 45*s* is horizontal rather than vertical and the half bulges are the same as in FIG. 40.

FIGS. 35-40 shows several different configurations of spacer braces crossing and passing through the hole 36 of a support member. At both sides of the key hole 36*k* shows two key tabs 36*t* that are formed by making a tab forming cut 251 along the hole side edge 36*se* to the hole top edge 36*te*. The ledge tabs 79*t* were previously described in FIGS. 13-16. FIG. 35 shows a U-shaped spacer brace 302 that has a bulge 302*g* that first extends outward forming a half-circle shape then upward forming the flange 302*b*. The half-circle shape of the bulge 302*g* corresponds to the half-circle shape of the web-bulge notch 126*wg* for the bulge 302*g* to fit into as shown in FIG. 44.

Figure 42:
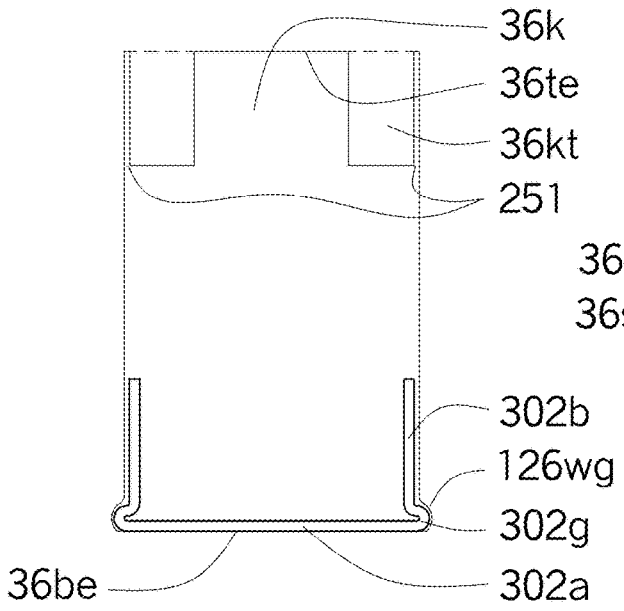
FIG. 42 shows the bulge of the spacer brace insert into the hole notch at the lower corners of the hole in the support member.
Figure 43:
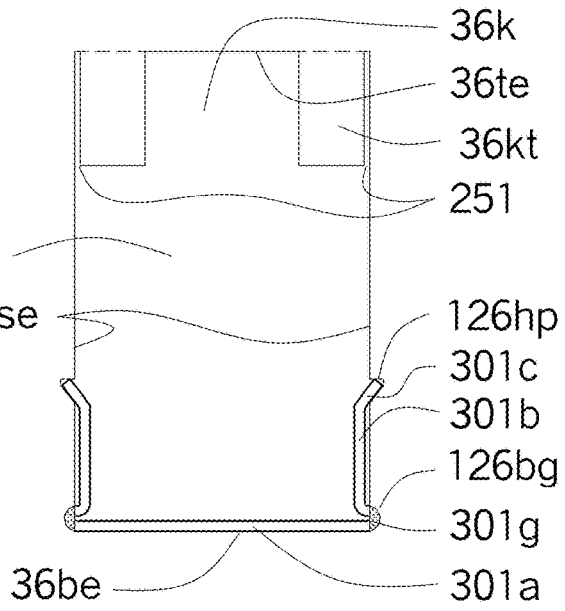
FIG. 43 shows the bulge having a bulge notch where the side edge hole fits into, and the lip of the space brace fits into the hole notch of the web in the support member.

FIG. 43 is similar to FIG. 42 except the space brace is a reverse lip spacer brace 301 however they both have a half-circle shape at the bulge 301*g*. The bulge 301*g* shown as a half-circle being vertically oriented having a bulge notch 126*bg* engage the external the bulge notch 126*bg* for the hole side edges 36*se* to fit into and resistance any vertical movement. The flanges 301*b* extend from the bulge notch 126*bg* to the lips 301*c* that extend externally at an angle and where the lip notches 126*p* and the bulge notches 126*bq* can be angled to increase friction between the hole side edge 36*se* and the notches. The hole lip notches 126*hp* are vertically and angular oriented and inset into the hole side edges 36*se* for the longitudinal edges of the lips 301*c* to be inserted into. The reverse lip spacer brace 301 is inserted into the hole 36 at an angle allowing the flanges 301*b* to bend where the bulge notches 126*bg* slide into the hole side edges 36*se* and the reverse lip spacer brace 301 is continually pressed downward until the lips 301*c* engage the both hole side edges 36*se*. The left bulge 302*q* is shown flush with the hole side 36*se* but the opposing side having the same configuration and would be installed nestled between the hole side edges 36*se* as the web 302*a* is meant to bend allowing the bulge notches 126*bq* to fit as tight as possible creating a maximum friction between the bulge notches 126*bq*.

Figure 44:
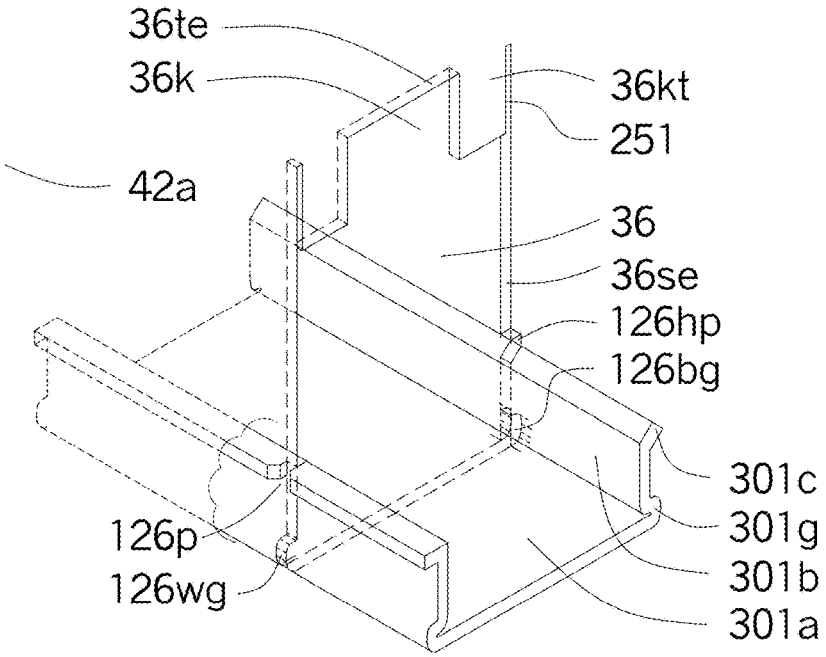
FIG. 44 shows an isometric view of FIG. 43 where the bulge notch fits into the side edge of the hole and the lip from the spacer brace fits into the hole notch of the web in the support member.

FIG. 44 shows a reverse lip spacer brace 301 having a web 301*a* with bulges 301*g* at each intersection of the flanges 301*b* with the left side having a horizontal oriented lip 301*c* and the right side having an angular oriented lip 301*c*. The left hole side edge 36*se* at the bottom corner has a web-bulge notch 126*wg* as shown in FIG. 42 for the bulge 301*g* to fit into and the left lip 301*c* has a lip notch 126*p* for the hole side edge 36*se* to fit into. The bulge notches 126*bq* and the lip notches 126*p* do not have to be in alignment and the lip notches 126*p* and bulge notches 126*bq* can be slightly angled to create friction. The right side would typically have the same above-described combination of self-locking connections on the opposing side of the reverse lip spacer brace 301. Another combination of self-locking connection is shown on the right side which is the same combination as shown in FIG. 43.

Figure 45:
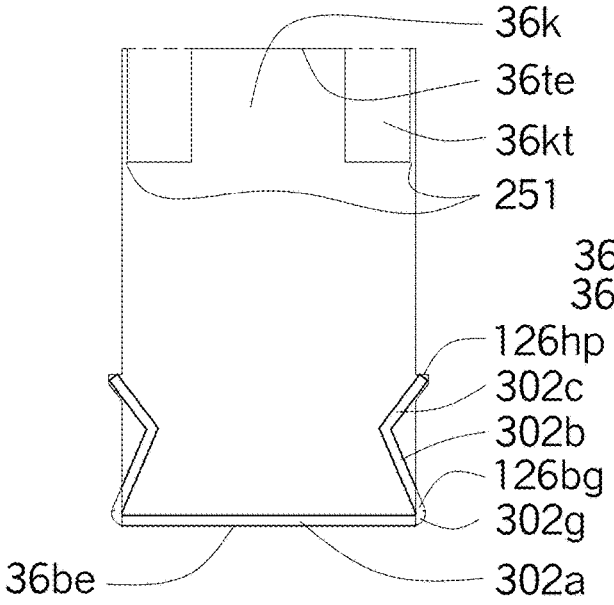
FIG. 45 shows a similar isometric view of FIG. 43 however the flange and lip form obtuse angles.
Figure 46:
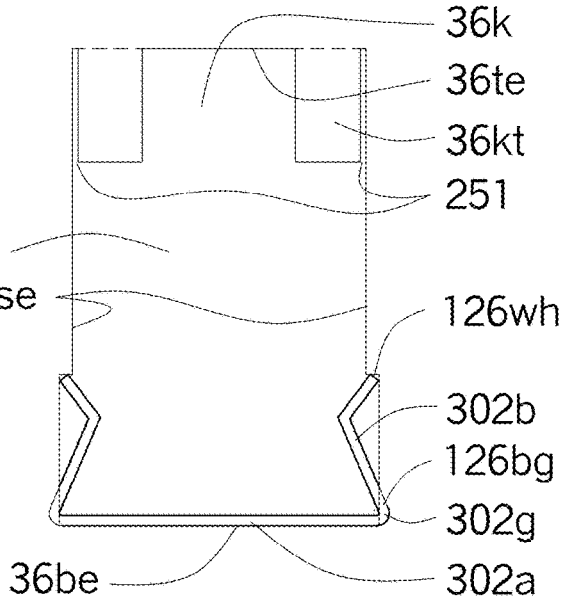
FIG. 46 shows the same isometric view of the spacer brace 45 except the side-edges of the hole are inserted to the depth of the back of the notch allowing the spacer brace to be inserted into the deeper side-edges of the hole.
Figure 47:
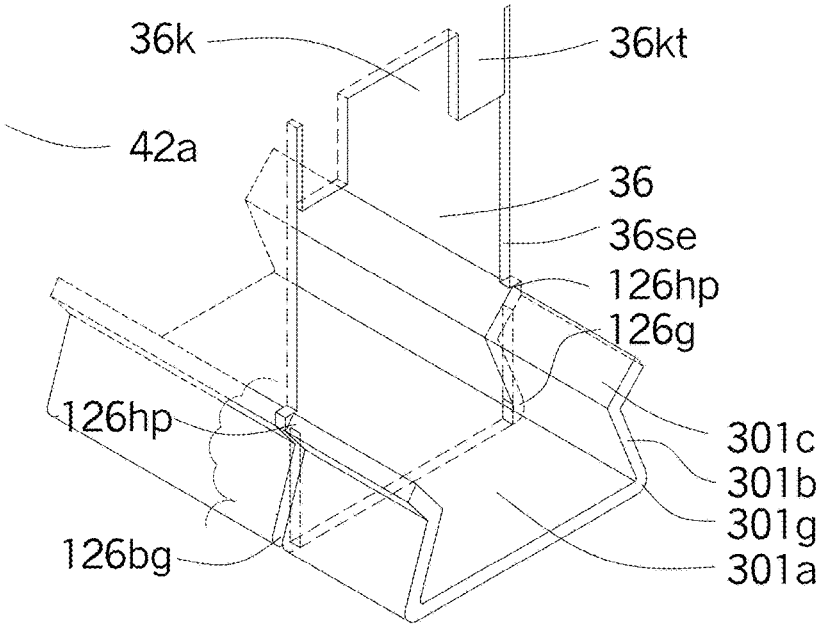
FIG. 47 shows an isometric view of FIG. 45.

FIGS. 45-47 show a reverse lip spacer brace 301 having a web 301*a* with bulges 301*g* on both sides having flanges 301*b* extending inward at an angle from the bulges 301*g* then bending outward forming a lip 301*c*. In FIG. 45 the reverse lip spacer brace 301 passes through the hole 36 so the bulge notches 126*bg* intersect the hole side edges 36*se* and the longitudinal side edges of the lips 301*c* are inserted into the hole lip notches 126*hp* forming a self-locking connection using the same configuration on both sides of the hole 36. The U-shaped spacer brace 302 or reverse lip spacer brace 301 having the flanges 301*b*.& 302*b* have acute angles to the web 301*a*, 302*a* also shown as bulges 301*q*, 302*q* where the smaller interior flanges are used as the frictional resistance from vertical movement. The configuration is shown having the end of an adjacent U-shaped spacer brace 302 having a shorter width web 302*a* and a short flange 302*b*, however a longer flange 302*b*' is shown with the lip notch 126*p* connecting the hole side edges 36*se*. On the right side a reverse lip spacer brace 301 is used also having a web 301*a*, flange 301*b* and a lip 301*c*, however the hole notch 36*h* has a greater depth leaving a greater overhang so the lip notch 126*p* can engage the hole notch 126*h*. The U-shaped spacer brace 302 or the reverse lip spacer brace 301 can have opposite orientations and can overlap each other when the overlapping member has a larger or smaller profile or orientation. FIG. 46 has the same reverse lip spacer brace 301 along with the bulge notch 126*bg* at the bulge 301*g*. The hole lip notch 126*hp* shown as a web notch 126*w* because the hole side edge 36*se* at the reverse lip spacer brace 301 recessed rather than shown as a hole lip notch 126*hp*. The isometric in FIG. 47 has the same profile as FIG. 45.

FIG. 48 shows an isometric view of the external side of the support member shown as a C channel 42 with a large shaped hole 36 and a key hole 36*k* below with key hole tabs 36*kt* on both sides of the key 36*k*. A U-shaped spacer brace 302 with the external side of the web 302*a* facing upward and the extension 302*e* extending through the key hole 36*k* with the extension 302*e* and the flanges 302*b* abut the internal side on the web 42*a*. The extension 302*e* has receiver notches 126*r* on both side edges for the key hole tabs 36*kt* to fit into. The first leg 129*a* of the hook receiver 129 and the extension 302*e* abuts the internal side of the web 42*a* and the first leg 129*a* is bent internally downward against the external side plane of the web 42*a*. The second leg 129*b* extends away from the web 42*a* and is then bent vertically leaving a gap 45 between the first leg 129*a* and the third leg 129*c*. The second leg 129*b* has receiver notches 126*r* on both side edges similar to the hook receiver in FIG. 49. The key hole tabs 36*kt* form a triangular shape because the key tabs 36*k* are bent at an angle shown as a dashed line at the corner edges of the hole 36 and the edge of the key hole tabs 36*kt* where the extension 302*e* intersects the key hole tabs 36*kt*. At the hole top edge 36*te* two key hole tabs 36*kt* are shown extending downward from the hook tongue 128 shown in FIG. 58 with the right key hole bent tab 128*tt*.

Figure 49:
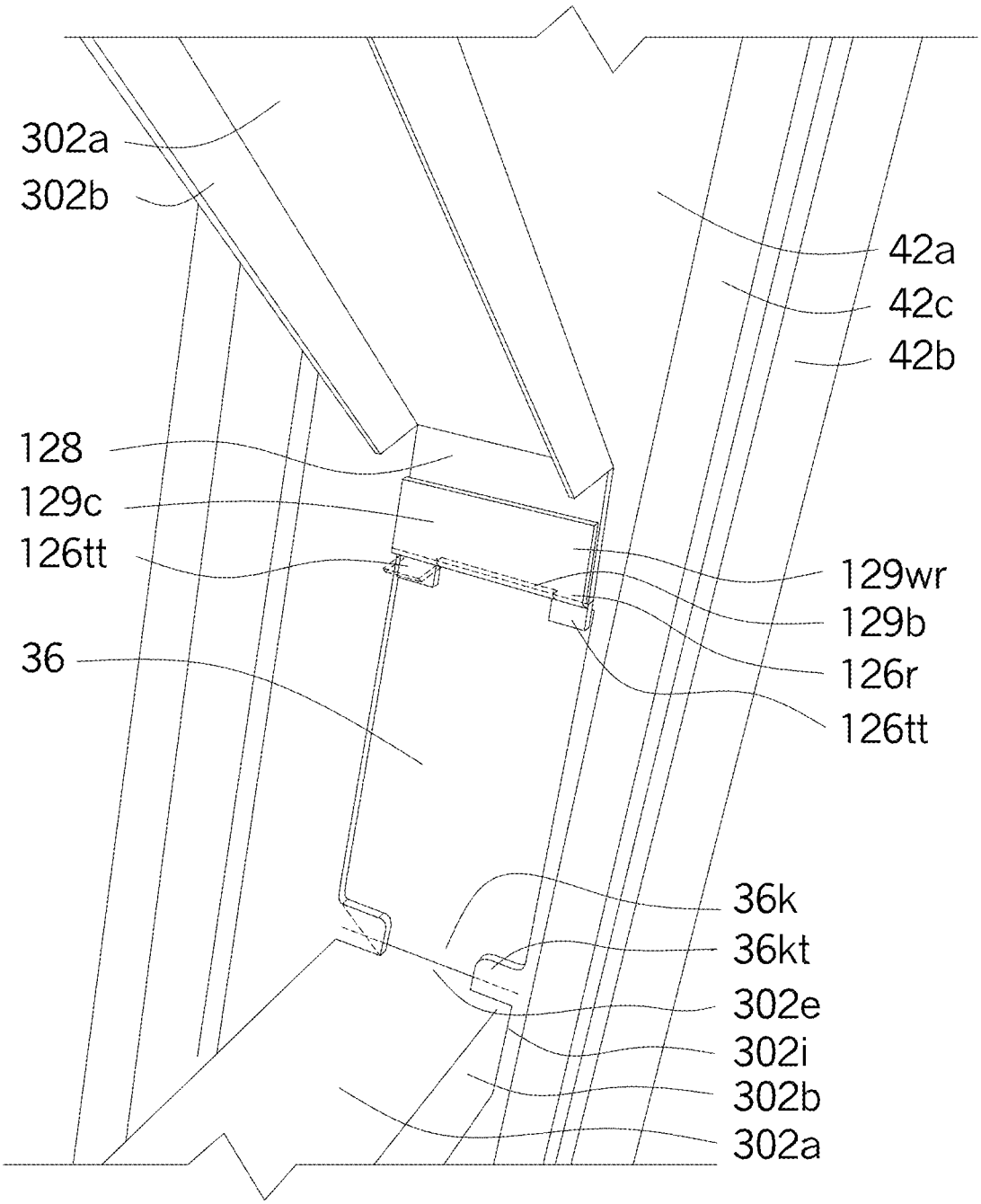
FIG. 49 shows the internal side of the support member with the extension having a receiver notch for the key hole tabs to fit into and the top edge of the hole shows a web receiver having the tongue of the spacer brace extending through the notches on the bottom edge of the web receiver for the two bent tabs.
Figure 57:
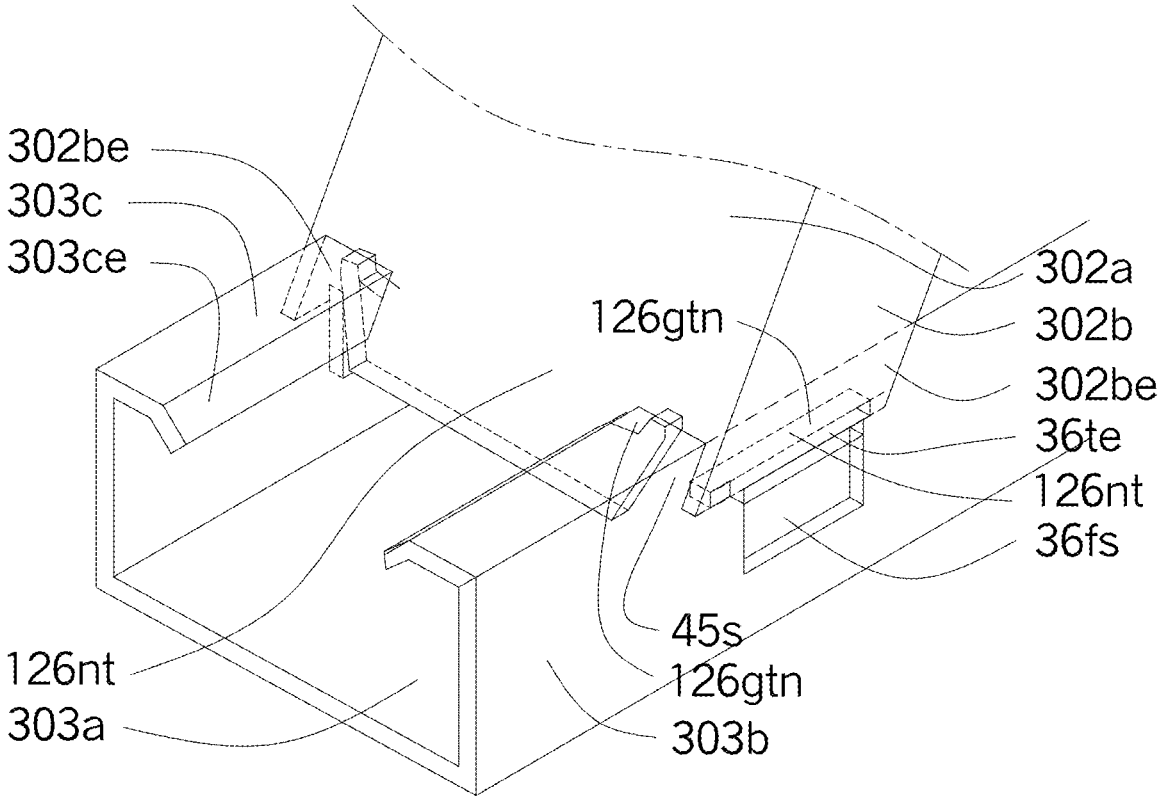
FIG. 57 is an enlargement of the diagonal spacer brace and the support member intersecting the C-shaped spacer brace shown in FIG. 1.

FIG. 49 shows the internal side of the C channel 42 shown in FIG. 57 and the lower edge of the hole 36 shows the external side of a U-shaped spacer brace 302 extending through the key hole 36*k* with the key hole tabs 36*kt* shown ready to be bent. At the hole top edge 36*te* shows a hook receiver 129 shown as a web hook receiver 129*wr* where the external side of the web 42*a* is the same as the first leg 129*a* of a hook receiver 129. The second leg 129*b* is a continuation of the web 42*a* bent perpendicular to the web 42*a* and then bent vertically leaving a gap 45 between the third leg 129*c* and the web 42*a*. The second leg 129*b* has receiver notches 126*r* at both side edges for bent key hole tabs 128*tt* to pass through. The web hook receiver 129*wr* shows a U-shaped spacer brace 302 with its hook tongue 128 extending into the gap 45 of the web hook receiver 129*wr* with its tongue tabs 128*tt* extending through the receiver notches 126*r* and where the left tongue tab 128*tt* is bent forming a secure self-locking connection between the U-shaped spacer brace 302 and a web hook receiver 129*wr*.

Figure 50:
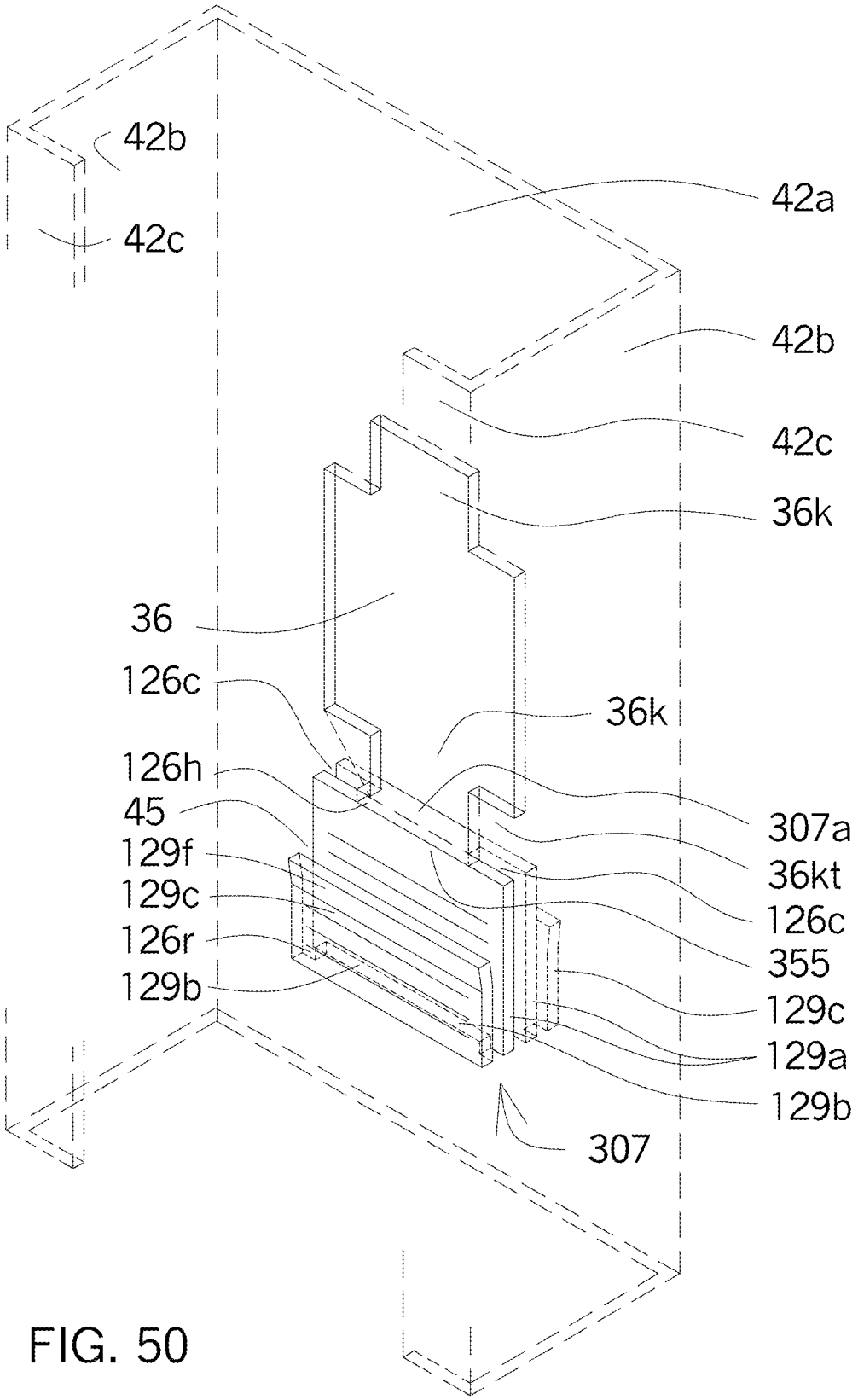
FIG. 50 shows a W-Clip having clip notches that extend on both sides of the W-Clip for the key tabs to fit into.006

FIG. 50 shows an isometric view of a W-shaped clip 307 having a hook receiver 129 extending over external and internal sides of the web 42*a* of the C channel 42 and where the first leg 129*a* is against the plane of the web 42*a* and the second leg 129*b* extends outward with the third leg extending upward leaving a gap 45 between the first and third legs 129*a* & 129*c*. The web 307*a* of the W-shaped clip 307 shows clip notches 126*c* on both side edges of the web 307*a* for the key tabs 36*kt* to extend through the clip notches 126*c* to fit through and upon the internal side of the web 307*a* being secured into the anchor space 355, the key hole tabs 36*kt* are bent at an angle of least resistance allowing the W-shaped clip 307 to have a self-locking connection into the key hole 36*k*.

Figure 51:
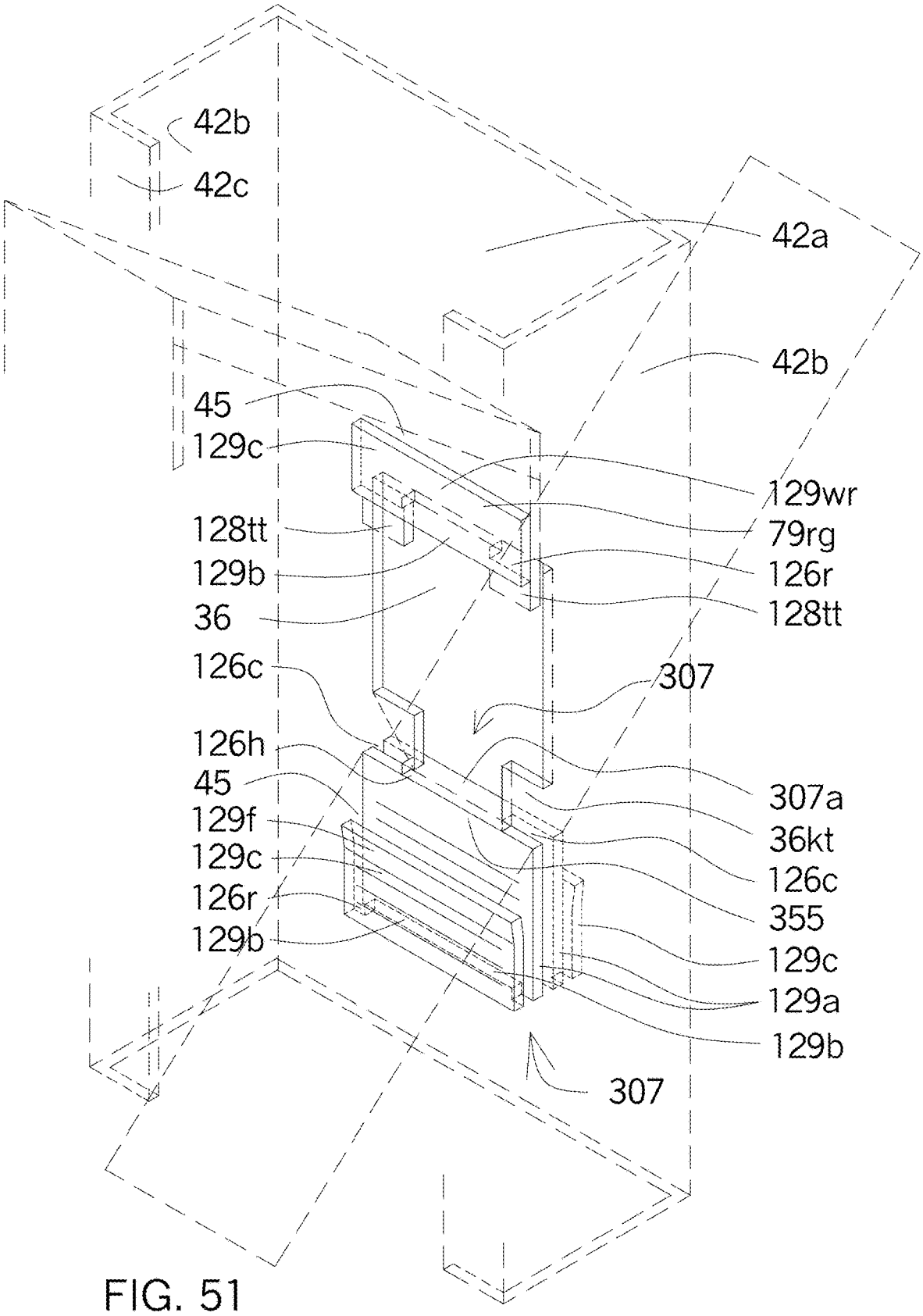
FIG. 51 shows the same W-Clip as FIG. 50 and a web hook receiver at the top edge of the hole with the tongue tabs for the diagonal spacer brace above passing through the receiver notches at the bottom of the web receiver.
Figure 59:
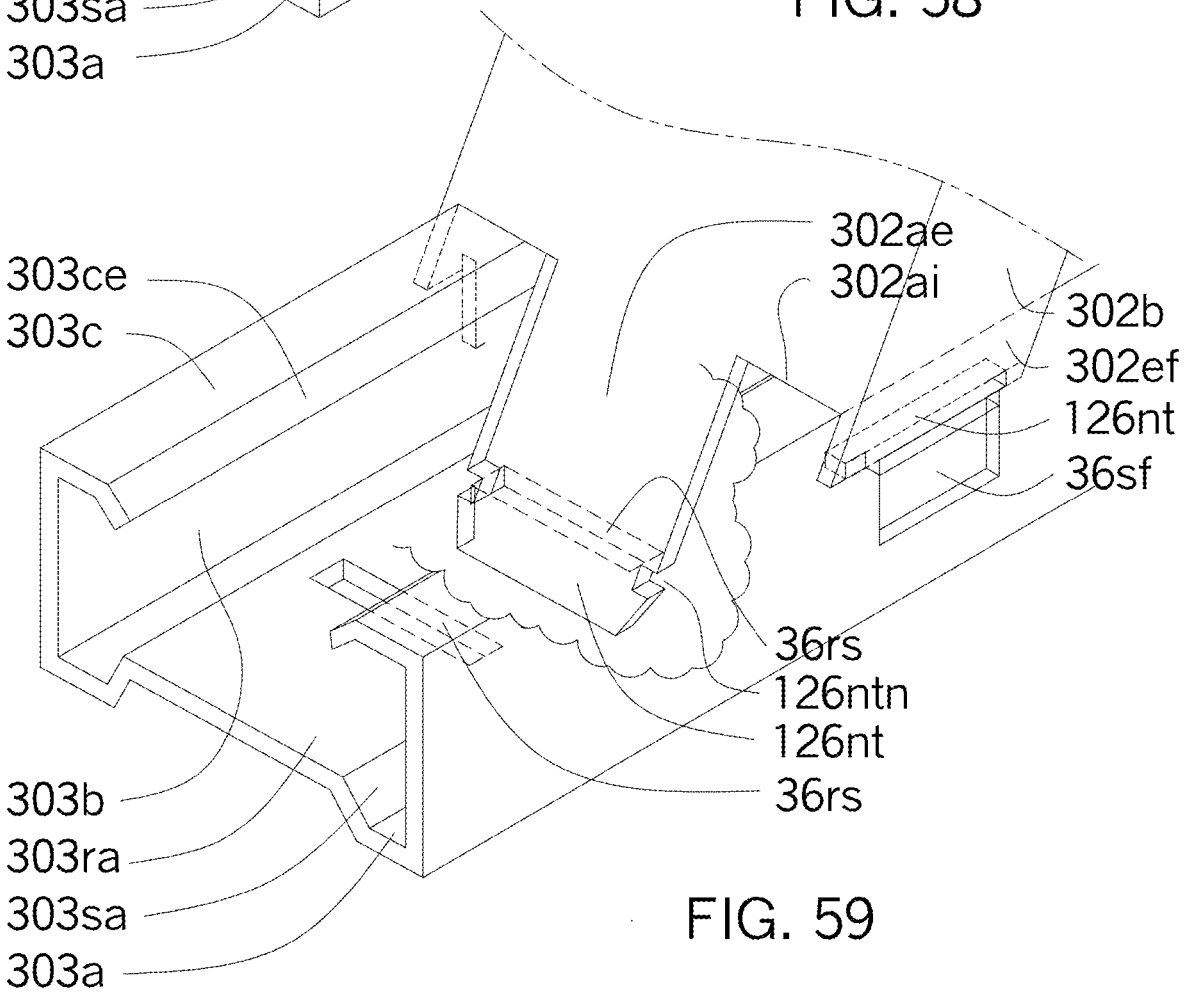
FIG. 59 shows the diagonal spacer brace intersecting the horizontal spacer brace as shown in FIG. 58 however the a vertical support member is shown intersecting the horizontal spacer brace also having notch-tab indentation at the web with a notch-tab extension having a notch-tab at the end inserted into the receiver slot hole.

FIG. 51 shows an isometric view of the C channel 42 with the same W-shaped clip 307 shown installed at the key hole 36*k* as shown in FIG. 59 and the web hook receiver 129*w* as shown in FIG. 49. At the top of the hole 36 shows a web hook receiver 129*wr* that is formed from the web 42*a* of the C channel 42. When the hole 36 is manufactured the center section of the hole 36 is removed, however for a web hook receiver 129*wr* the first leg 129*a* is the web 42*a* of the C channel 42 and the second leg 129*b* and third leg 129*c* is the cut-away area of the web 42*a* that is discarded to create the hole 36. Therefore the second leg 129*b* is bent perpendicular to the web 42*a* with the third leg 129*c* extending upward leaving a gap 45 between the web 42*a* and the third leg 129*c*. A receiver notch 126*r* is installed at both the side edges of the second leg 129*b* of the web hook receiver 129*wr* for the two tongue tabs 128*tt* that are extending into the receiver notches 126*r* from the Ushaped spacer brace 302 shown dotted.

FIG. 52 is similar to FIG. 24 except a bracing hole 36*b* is shown between the previously described slide gaps 45*s* and the web indentation 42*i* is now shown as a bracing hole 36*b* with a key hole 36*k* and two key tabs 36*kt* form the hole bottom edge 36*be*. When the flange 303*c* from the reverse lip spacer brace 303 extends to the bottom of the slide gap 45*s* the web 302*a* would be flush with the external side of the reverse lip spacer brace 303. To form a recess base at the top or bottom of the metal framing the slide gap 45*s* is required to be shorter than the flange 303*b* then the flange 303*b* will extend beyond the top and bottom edge of the support member. The reverse occurs at the bracing hole 36*b* at the lower bottom edge of the web 42*a* where the key hole 36*k* and the two key hole tabs 36*kt* form the hole top edge 36*te* with the side edges of the key hole 36*k* being the side edges of the key hole tabs 36*kt*. The bottom edge of the key hole tabs 36*kt* in the bottom bracing hole 36*b* shows a web-hole notch 126*wh* at both side edges of the bracing hole 36*b* for the lip notches 126*p* at the longitudinal side edge of the lips 303*c* for the reverse lip spacer brace 303. The web 303*a* shows web-slot holes 36*ws* extending in both a width and longitudinal direction for fasteners (not shown) to be installed into a floor.

Figure 53:
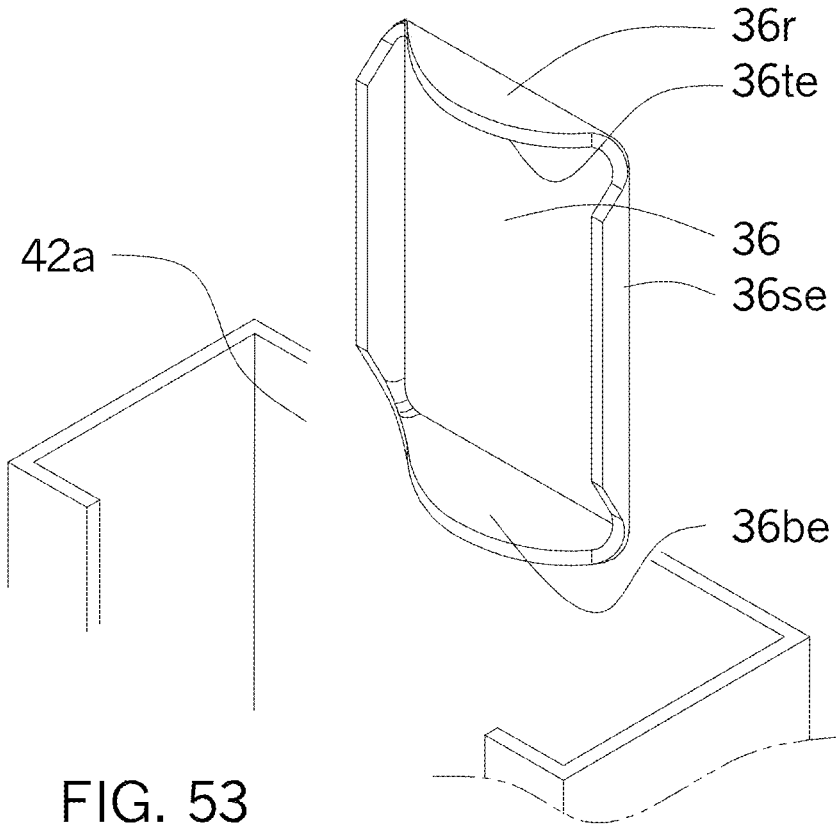
FIG. 53 an irregular shape hole have a continuous rim extending around the hole edges leaving a narrow edge in the corner where the W-Clip could be inserted into the rim of the hole if the rim had a notch or the W-clip was bent to create a notch to form a secure connection.
Figure 54:
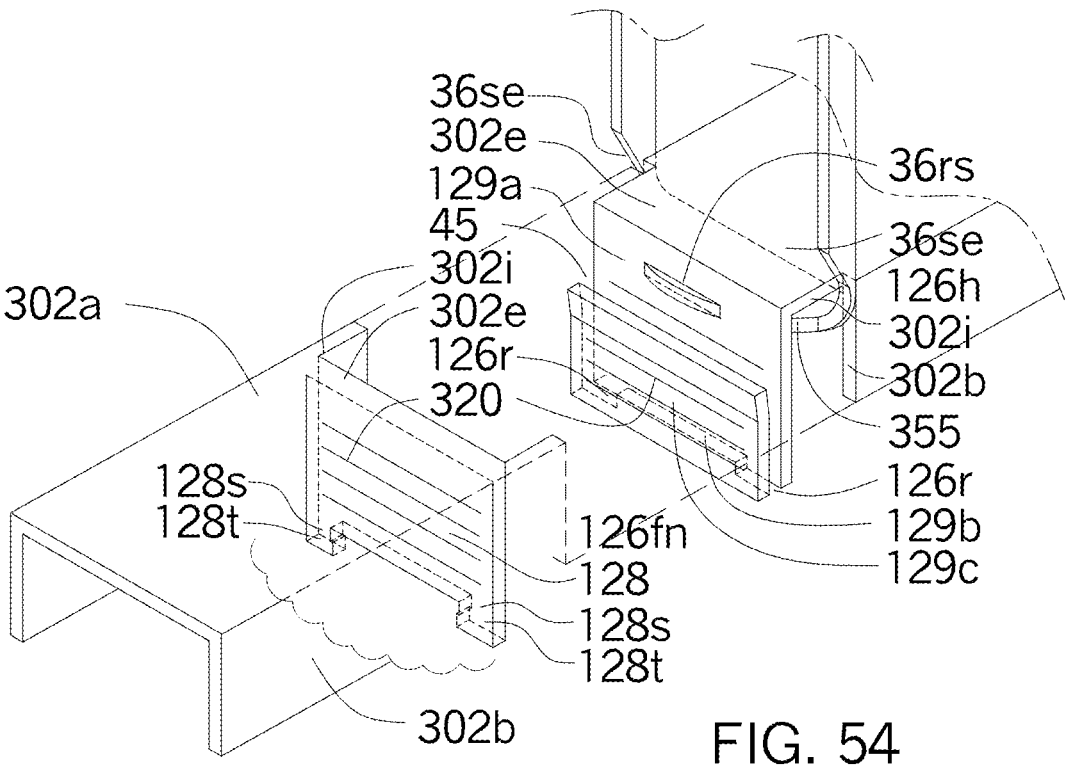
FIG. 54 shows a U-shaped spacer brace extending through the hole in FIG. 53 where the bottom edge of the rim penetrates the first leg of the hook receiver.

FIG. 53 shows a rectilinear shaped hole 36 having a continuous rim 36*r* extend from the web 42*a* of the support member and where the corners have a short depth at the rims 36*r*. FIG. 54 shows a U-shaped spacer brace 302 extending through a hole 36 shown similar to the U-shaped spacer brace 302 in FIG. 15, however the hole bottom edge 36*be* in FIG. 53 has an irregular shape configuration. The hook receiver 129 shown extending over the irregular shape of the hole bottom edge 36*be* due to the shape of the rim 36*r*. The first leg 129*a* of the hook receiver 129 shows a receiver slot hole 36*rs* so the rim 36*r* can fit into. If the hook receiver 129 extends through the hole 36 in reverse, the flanges 302*b* would have notches 126 at the end side edges of the flanges 302 for the rim 36*r* could fit into will the hook receiver 129 would have extended over the hole bottom edge 36*be* against the web 42*a*. The rims 36*r* are irregular in shape allowing the rim 36*r* to extend through the receiver slot hole 36*rs* forming another similar self-locking connection.

Figure 55:
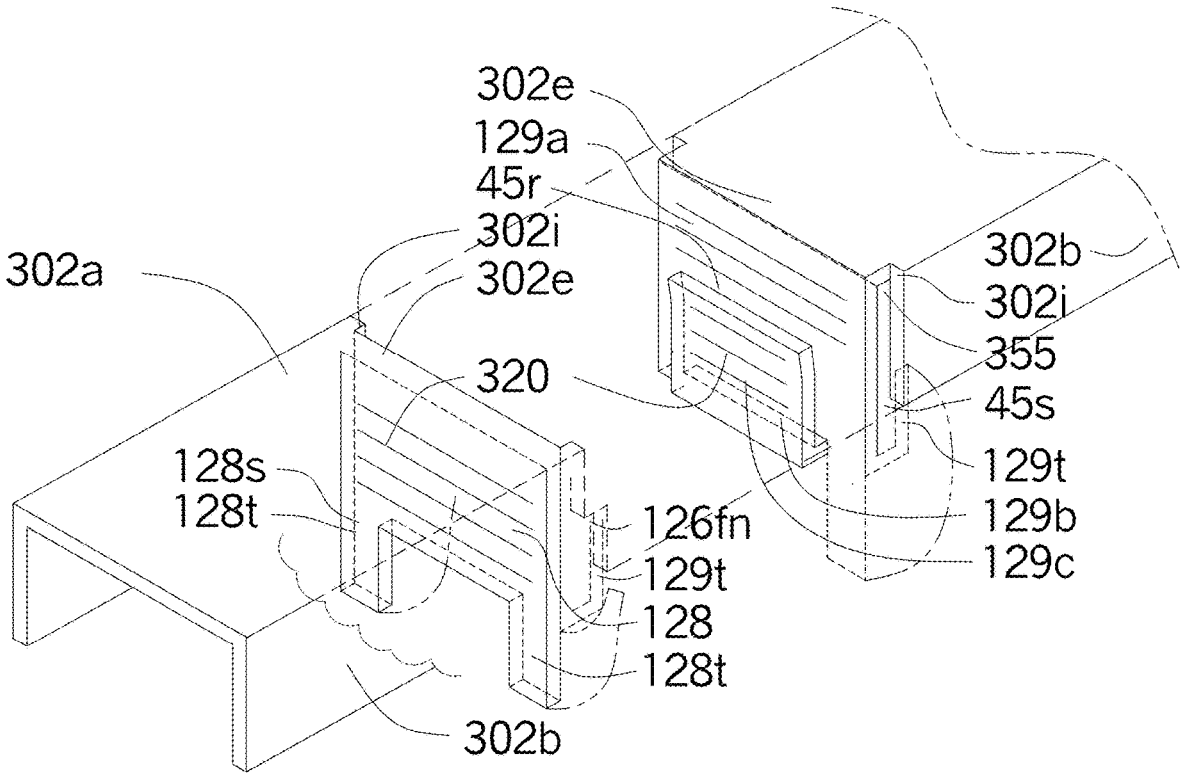
FIG. 55 shows the hook tongue intersecting a hook receiver where the hook receiver also has receiver tabs that extend around a hole or lip and the tongue tabs overlap the receiver tabs.

FIG. 55 shows a U-shaped spacer brace 302 with the external side facing upward having a hook receiver 129 at the end with an adjacent U-shaped spacer brace 302 having its hook tongue 128 ready to be connected to each other. In FIG. 15 a similar connection occurs between the hook tongue 128 fits into the hook receiver 129, except here the hook receiver 129 is not required since the hook tongue tabs 128*t* wrap around the bottom edge of the first leg 129*a* of the hook receiver 129. The hook tongue 128 still fits into the gap 45 between the first and third legs 129*a* & 129*c*, however in lieu of shorter tongue tabs 128*tt* the tongue tabs are longer and extend around the hook receiver tabs 129*t*.

Figure 56:
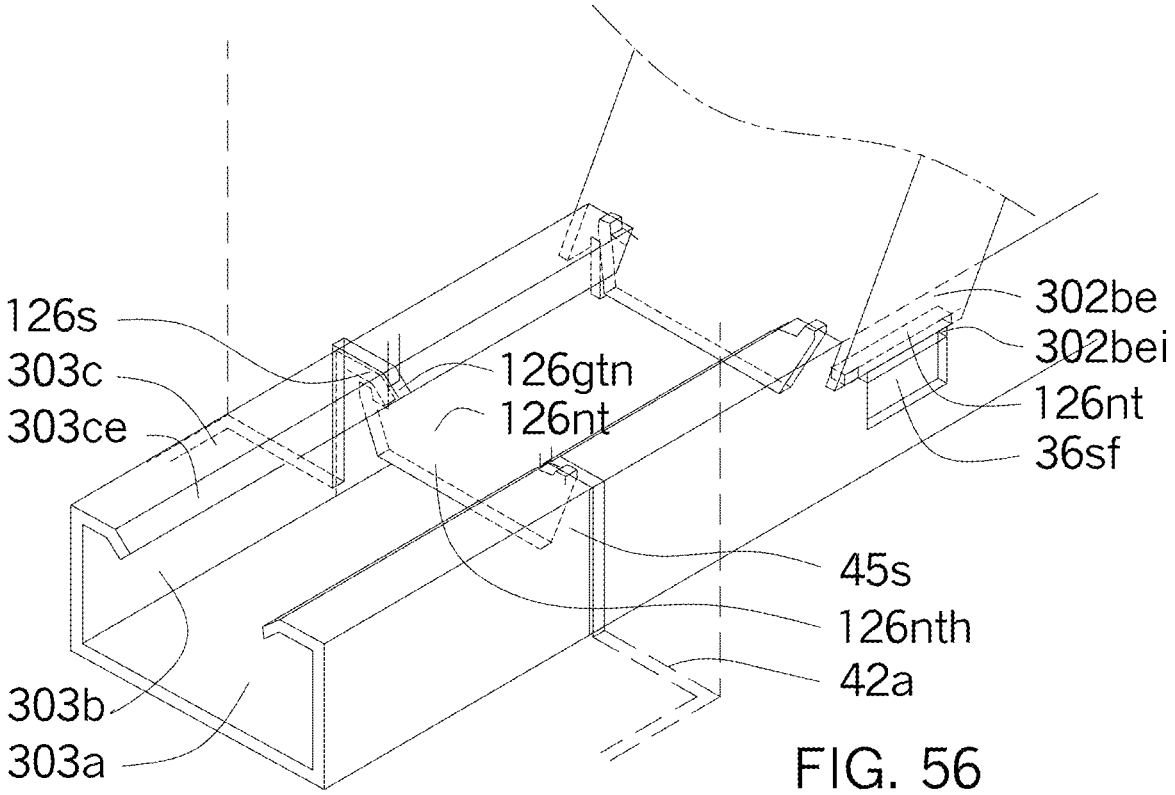
FIG. 56 is an enlargement of the diagonal space brace being installed into a C-shaped spacer brace with its extended flange and notch-tab inserted into the flange hole as shown in FIG. 1.
Figure 58:
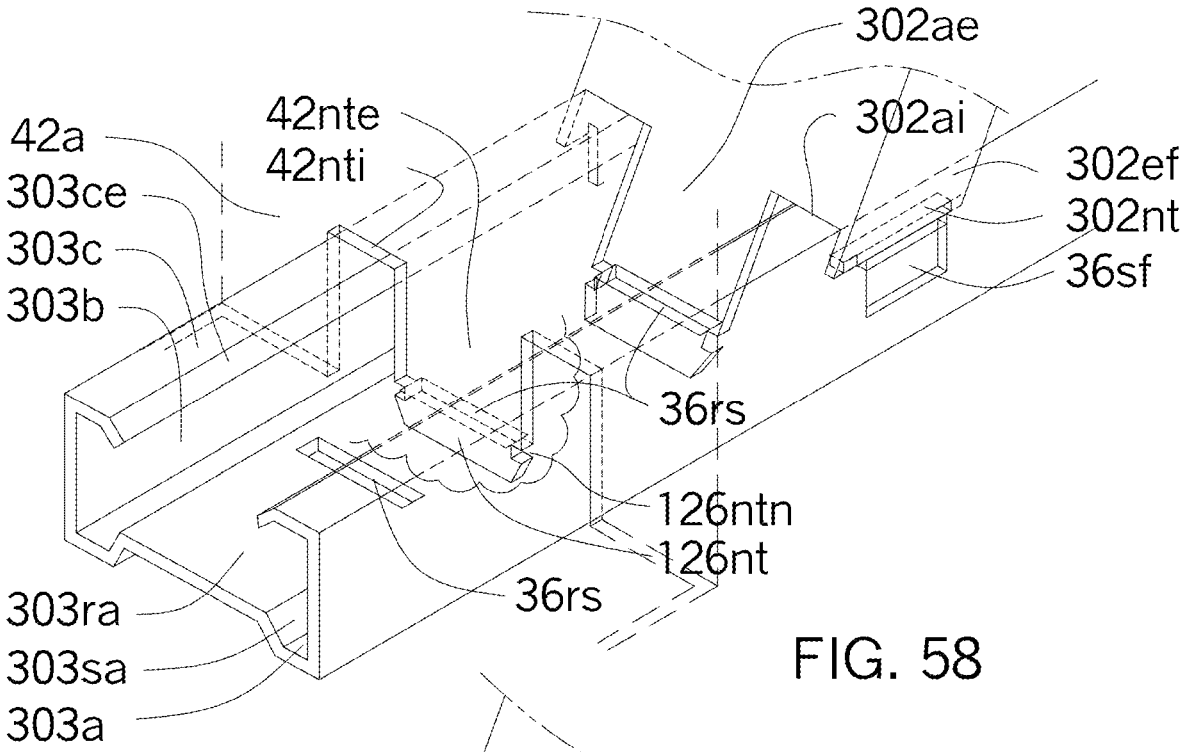
FIG. 58 is an enlargement of the diagonal spacer brace being installed into a C-shaped spacer brace shown in FIGS. 56 & 59 except the web of the diagonal space brace has an indentation at the lips of the horizontal spacer brace and a notch-tab extension has a notch-tab at the end that is inserted into the receiver slot hole at the web of the horizontal spacer brace.

FIG. 56 shows an enlargement of FIG. 58 where the diagonal oriented framing member shown as a U-shaped spacer brace 302 installed into the horizontal C shaped spacer brace 302. The diagonal oriented U-shaped spacer brace 302 is slightly wider than the horizontal oriented C shaped spacer brace 303 so the extended flanges 302*be* are flush with the external side of the flanges 303*b*. The extended flanges 302*be* form the beginning side of the notch-tabs 126*nt* so the extended flanges 302*be* can be bent to fit into the flange slot holes 36*sf*. The extended flanges 302*be* have an indentation 302*bei* at the hole top edge 36*te* so the head 126*nth* of the notch-tab 126*nt* can fit into and be secured at the flange slot hole 36*sf*. The web 302*g* of the diagonal U-shaped spacer brace 302 has the same or similar notch-tab 126*nt* as described in FIGS. 58 & 59.

FIG. 58 similar to FIG. 56 both show a vertical oriented C channel 42 and a diagonal oriented U-shaped spacer brace 302 intersecting a horizontal oriented C shaped spacer brace 303. FIG. 58 shows the horizontal oriented C shaped spacer brace 303 having a raised web 303*ra* with sloped sides 303*sa*; however the web 303*a* is still resting on the exterior side against a floor. The receiver web 303*ra* shows a receiver slot hole 36*rs* oriented to align parallel to the web 42*a* of the support member. The notch-tab 126*nt* starts as a web extension 302*ae* at the web 42*a* of the support member. The web extension 302*ae* shown having an indentation 42*nti* that is indented around the lip 303*c* and the lip extension 303*ce*. The web extension 302*ae* has a notch 126*ntn* where the notch-tab 126*nt* intersects the receiver slot hole 36*rs* and the head 126*nth* of the notch-tab 126*nt* extends through the receiver slot hole 36*rs*. FIG. 58 also shows a similar diagonal oriented U-shaped spacer brace 302 intersecting the horizontally oriented C shaped spacer brace 303 as shown in FIGS. 56 & 57.

FIG. 59 shows an enlarged isometric view of the diagonal oriented U-shaped spacer brace 302 intersecting the C shaped spacer brace with the raised web 303*ar*. The web 302*a* has an indentation 302*i* at the lips 303*c* and extended lips 303*ce* with the web 302*a* having an extension 302*e* at the start of the notch-tab 126*nt*. The notch-tab 126*nt* at the receiver slot hole 36*rs* has a notch 126*ntn* at the receiver slot hole 36*rs* with the head 126*nth* extending through the receiver slot hole 36*rs* to the external side of the raised web 303*ra* of the C-shaped spacer brace 303.

Figure 60:
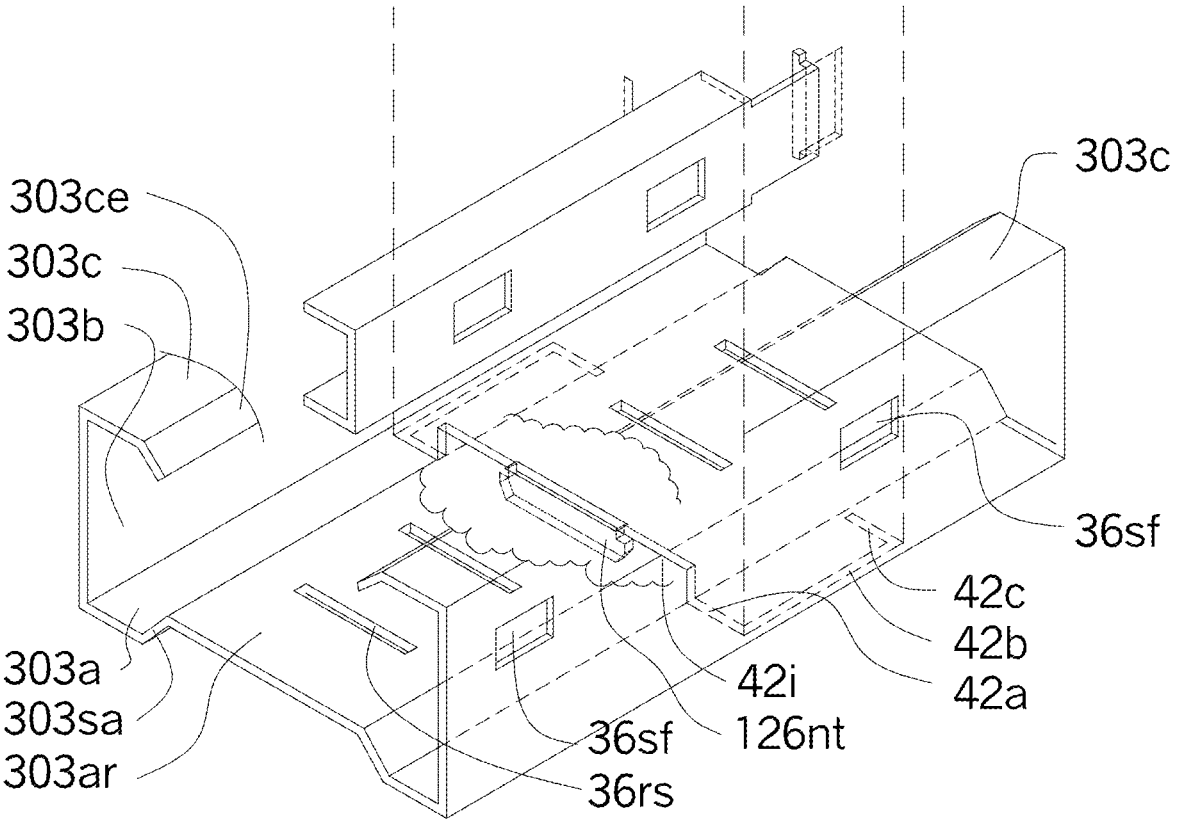
FIG. 60 shows an enlarged view of the vertical support member inserting the horizontal spacer brace as shown in FIG. 1 where the web of the support member is indented at the raised area of the web and a notch-tab is extended into the slot hole.
Figure 61:
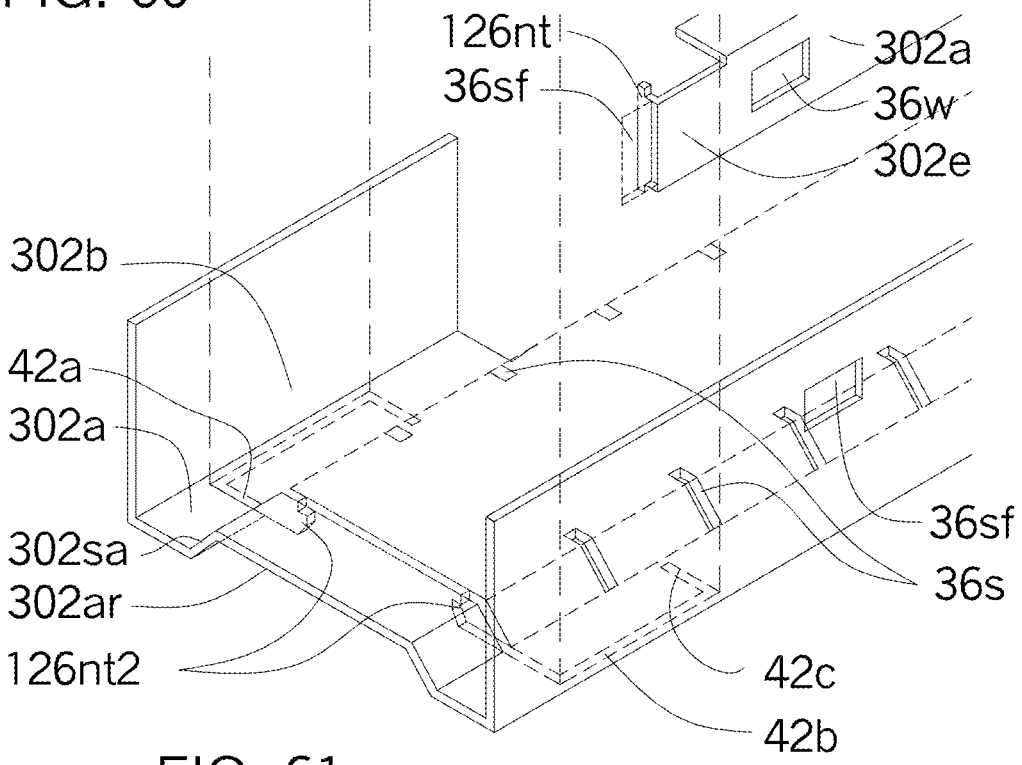
FIG. 61 shows an enlarged view of the vertical support member inserted into two diagonally oriented notches at the raised web as shown in FIG. 1 where the web has a notch-tab inserted into one of the diagonally oriented notches and another notch-tab is inserted into the opposite diagonally oriented notches on the opposite side of the raised web.
Figure 70:
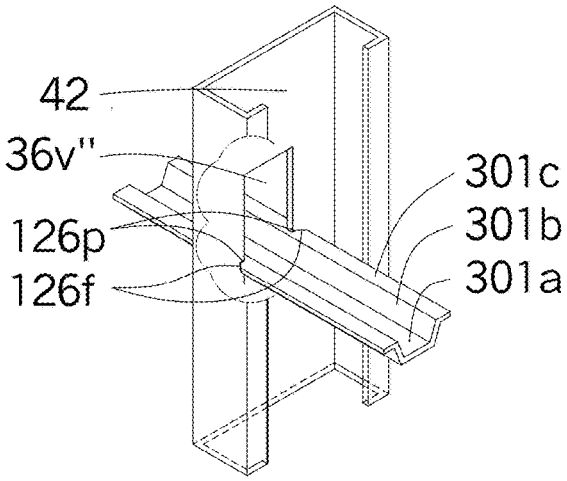

FIG. 60 also has the support member shown as a C channel 42 intersect the C-shaped spacer brace 303 where the web 303 has a raised web 303*ra* with raised sloped sides 303*sa*, however here the left side of horizontal spacer brace is shown as a U-shaped spacer brace 302 where the lips 303*c* & extended lips 303*ce* are removed and the right horizontal spacer brace is shown as a C-shaped spacer brace 303 with lips 303*c* and extended lips 303*ce*. On the left side of the horizontal spacer brace the web 42*a* for the support member rests on the internal side of the web 303*a* while the right side the web 42*a* would be required to have an indentation 42*i* (but not shown here). Depending on the width of the vertical support member and the width of the horizontal spacer brace the bearing point or the anchor space 355 would vary. Should the support member fit into the internal side of the flanges the bearing point would be at the web 42*a* adjacent to the flanges and at the head 126*nth* of the notch-tab 126*nt*. When the raised slot holes are located in the middle of the raised web 303*ra* the notch-tab 126*nt* is aligned with the receiver slot holes 36*rs* and the notches 126*ntn* of the notch-tab 126*nt* as similarly described in FIG. 70. FIGS. 1, 60 & 61 show vertical oriented slot holes 36*s* at the flanges of adjacent support members where a U-shaped spacer brace 302 is shown spanning between adjacent support members. The U-shaped spacer braces 302 are shown having notch-tabs 126*nt* extending from their webs 302*a*. The flanges 302*b* abut the webs 42*a* or lips 42*c* of the support member and the web extension 302*e* are part of the notch 126*ntn* of the notch-tab 126*nt* as the web extension 302*e* wraps around the hole side edge 36*se* and the head 126*nth* becomes wider than the slot hole 36*s* and therefore becomes a notch-tab 126*nt* when extended through the slot hole 36*s*. Even though FIGS. 14 & 15 or FIGS. 60 & 61 show the notch-tab 126*nt* at the top or bottom edges of the web 42*a* in the support members, a smaller width U-shaped spacer brace 302 with flange slot holes 36*fs* can be inserted into the hole 36 having the notch-tab 126*nt* extending from the holes bottom edge 36*be*. The notches 126*ntn* would be inserted from the bottom side of the U-shaped spacer brace 302 rather than from above as shown in FIGS. 60 & 61.

FIG. 61 is similar to FIG. 59 as the horizontal spacer brace can be U-shaped or C shaped as described above. FIG. 60 has sloped edge notches 126*se* at the raised sloped sides 303*sa* where the sloped edge notches 126*se* are notched at the sloped edges and slightly indented into the raised web 303*sr* to give additional bearing to the web 42*a* which is the beginning side of the notch-tab 126*nt*, but in this case it is a one-half notch-tab 126*nt*2 where one-half of the notch-tab 126 is located in the sloped edge notches 126*se*. The web 42*a* is the beginning side of the one-half notch-tab 126*nt*2 with the notches 126*n* being inserted into the side edge of the sloped edge notches 126*se* and the finish side being at the same plane as the internal side of the web 303*a*. Therefore, notch-tab 26*nt* form the same function as the two one-half notch-tabs as the receiver slot hotes 36*rs* secures two crossing members together.

Figure 62:
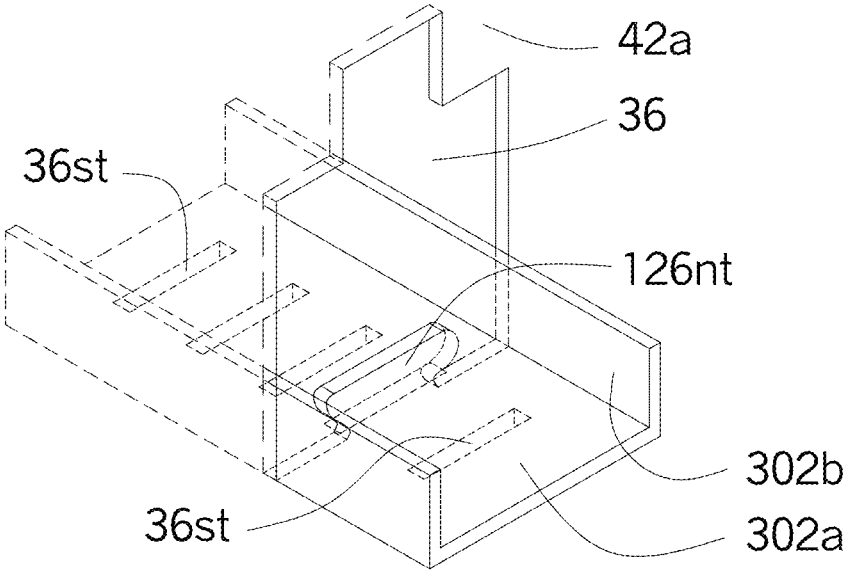
FIG. 62 shows notch-tab having rounded edges and the crossing member having slot holes.

FIG. 62 is similar to FIGS. 8 & 9 except only one notch-tab 126*nt* is shown along with one slot-tab hole 36*st*. The notch-tab 126*nt* and shown as having rounded edges making it easier to be inserted into the slot-tab holes 36*st*.

Figure 63:
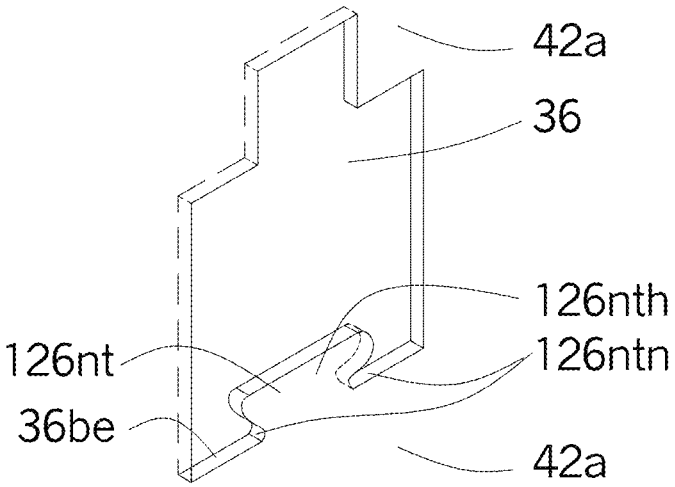
FIG. 63 shows only the notch-tab as shown in FIG. 62.
Figure 64:
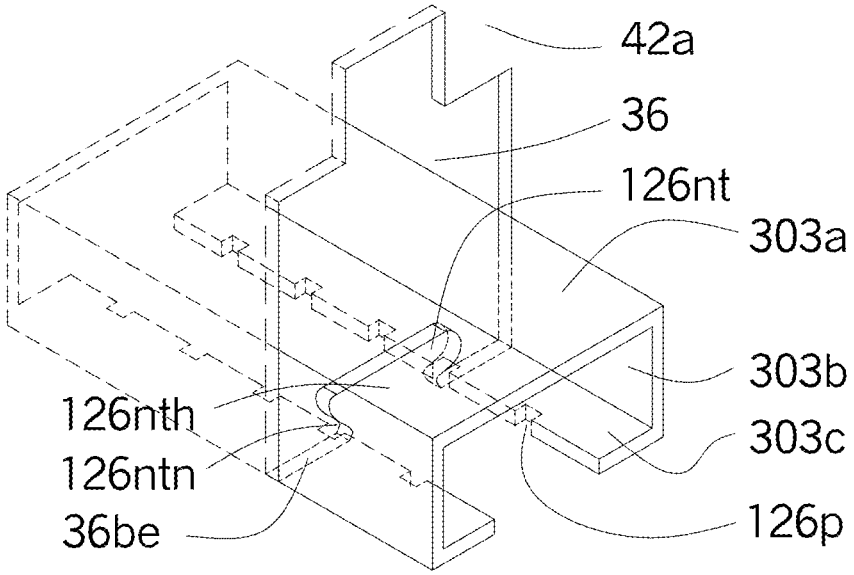
FIG. 64 shows a C shaped spacer brace as a crossing member having notches at the lips being supported at the hole bottom edge of the support member where the notches in the lips are secured at the notch of the notch-tab at the hole bottom edge.

FIG. 64 shows the C shaped spacer brace 303 wraps around the notch-tab 126*nt* as shown in FIG. 63. The C shaped spacer brace 303 is smaller and passes through the hole 36 in a support member. The C shaped spacer brace is shown having the external side of the lips 303*c* supported on the hole bottom edge 36*be* with the side edges of the lip 303*c* extending against the notch 126*n* of the notch-tab 126*nt*. If the C shaped spacer brace 303 requires to be connected together then the lip notch 126*p* needs to be installed so the C shaped spacer brace 303 will not slide horizontally.

Figure 65:
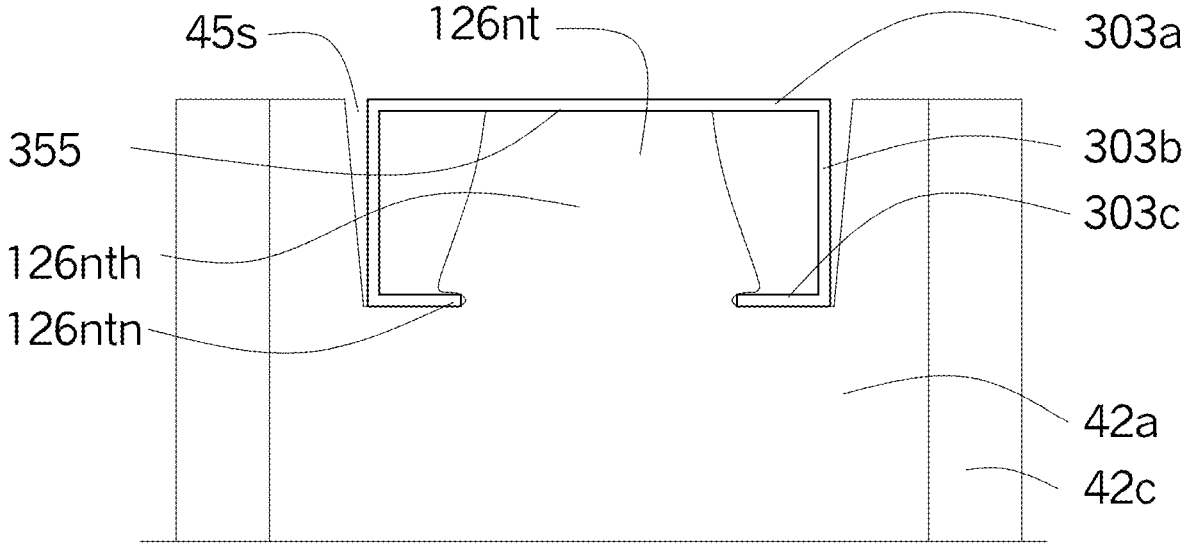
FIG. 65 is similar to FIG. 64 except the notch-tab in located at the top edge of a support member and the crossing member is a C shaped spacer brace having the web outside edge even with the top edge of the support member and the notch-tab is the anchor space at the internal side of the web of the crossing member.

FIG. 65 is a sectional view but similar to FIG. 57 the external side of the web 302*a* of the U-shaped spacer brace 303 is shown even with the top edge of the support member and the notch-tab 126*nt* has it top edge being the anchor space 355 for the internal side of the web 303*a* to rest on. In addition, the flanges 303*b* extend into the slide gap 45*s* allows the lips 303*c* to flex and become engaged into the notch 126*n* of the notch-tab 126*nt*.

Figure 66:
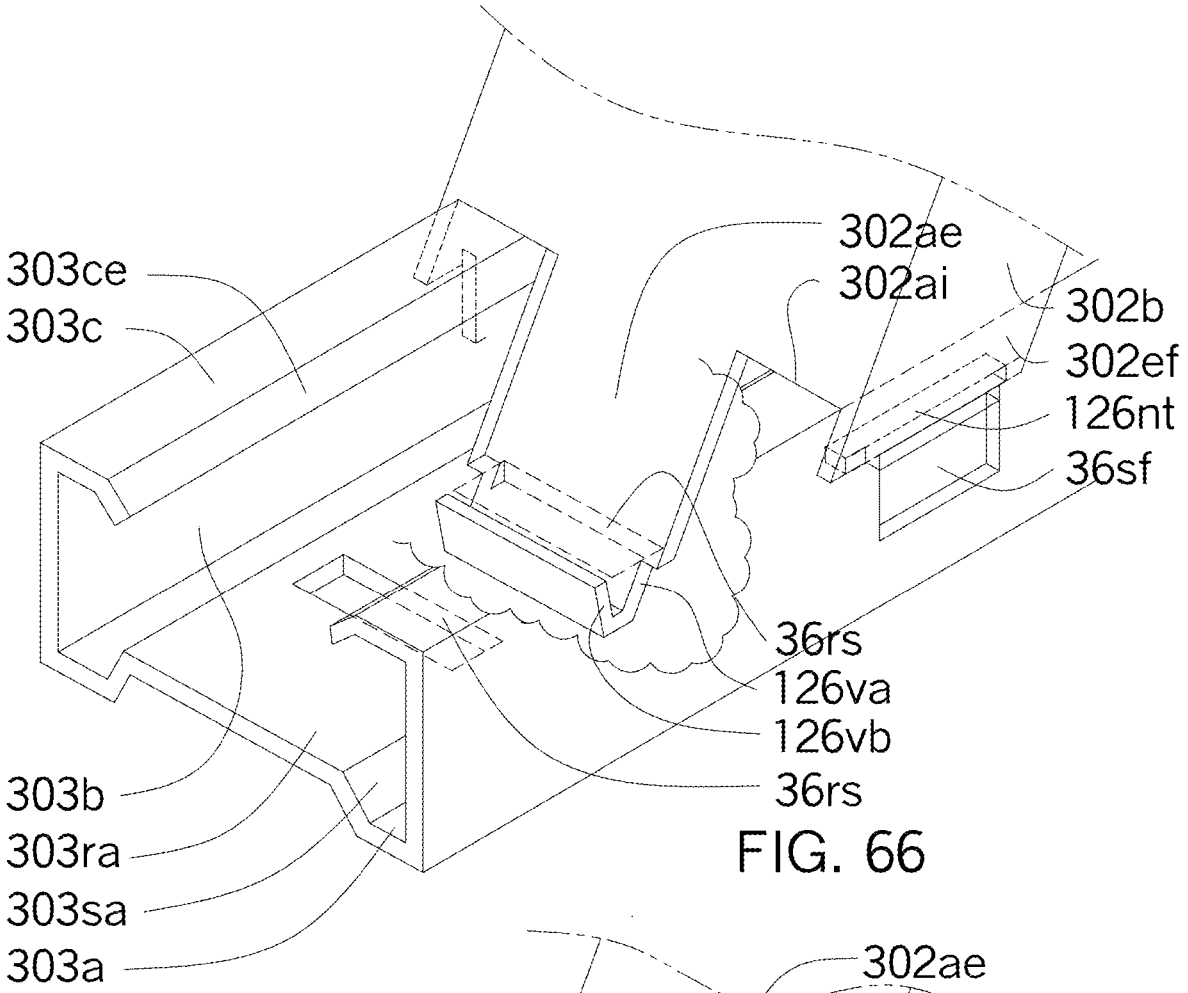
FIGS. 66 & 67 are similar to FIGS. 58 & 59 except the hooked tongue is V-shaped.
Figure 67:
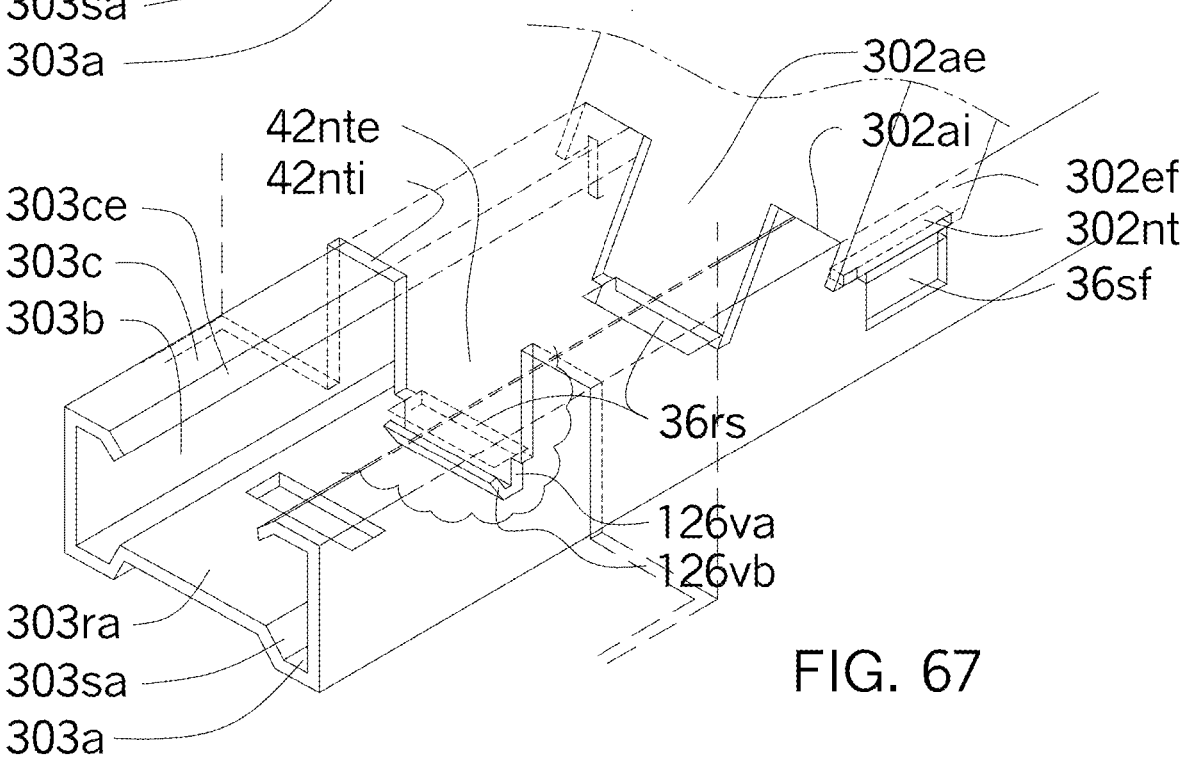

FIGS. 66 & 67 show a notch-tab 126*nt* extending through the receiver slot hole 36*rs*, however in both figures the V-shaped notch-tab 126*v* extends from the web extension 302*ae*. The web extension is wider than the length of the receiver slot hole 36*rs* forming the top edge of a notch type of connection. The first leg 126*va* and the second leg 126*vb* of the V-shaped notch-tab 126*v* are narrower than the receiver slot hole 36*rs* therefore forming an edge above the receiver slot hole 36*rs* at the web extension 302*ae*. The first leg 126*va* and the second leg 126*vb* are bent forming a V-shape and extended through the receiver slot hole 36*rs*. The second leg 126*vb* expands after being inserted allowing the second leg 126*vb* to extend to the underside of the raised web 303*ra*, forming a connection between the second leg 126*vb* wedged at the raised web 303*ar* and the edge at the web extension 303*ae*.

Figure 68:
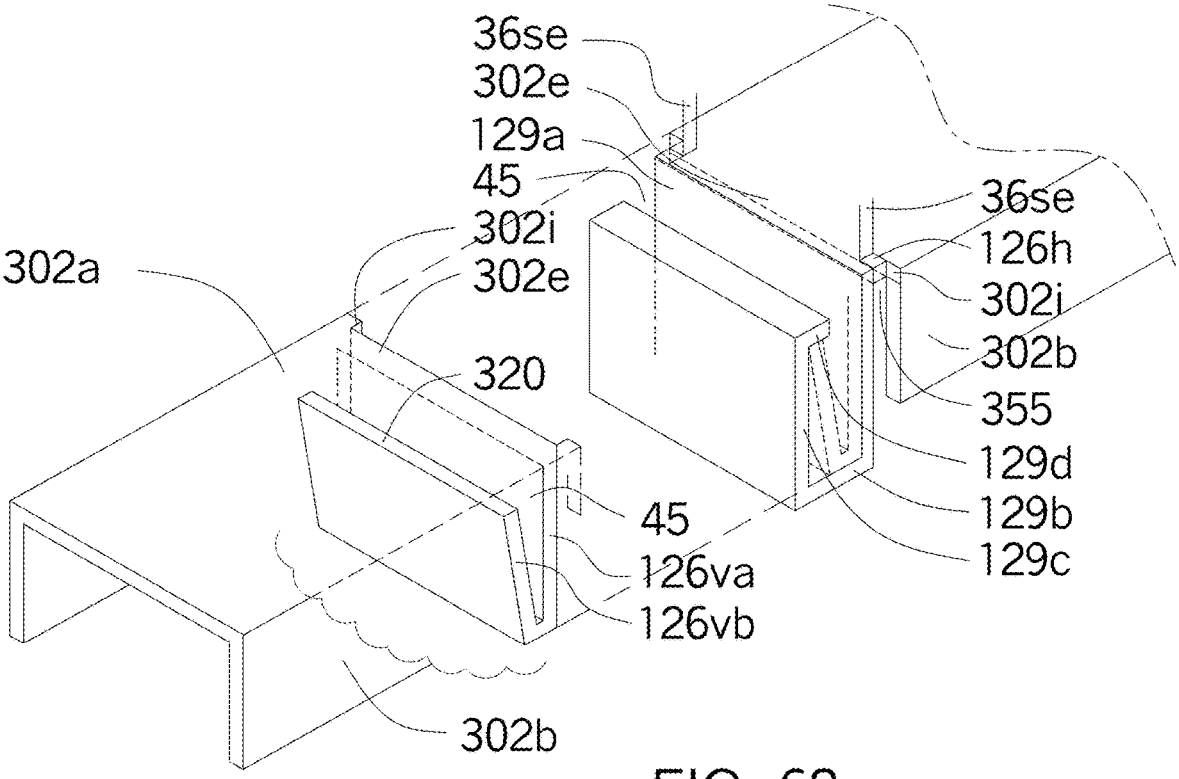
FIG. 68 is similar to FIGS. 15 & 16 except the V-shape tongue is used therefore the hooked receiver is slightly different shape.

In FIG. 68 the hooked tongue 128 and hooked receiver are slightly different than in FIG. 55. In FIG. 68 the hooked tongue 128 has a V-shaped notch-tab 126*v* having the first leg 126*va* extend downward from the web 302*a* with the second leg 126*vb* extending at an obtuse angle back to the internal side of the U-shaped spacer brace 302. The V shape of the hooked tongue 128 is inserted into the hooked receiver 129 where the first leg 129*a* is extended from the web extension 302*we* extending downward then extending horizontally at the second leg 129*b* then extending upward as the third leg 129*c* then turning again at the fourth leg 129*d* back toward first leg 129*a* leaving a gap 45 between the first leg 129*a* and the fourth leg 129*d*. The hooked tongue 128 referred to as a V-shaped notch-tab 126*v* extends into the hooked receiver 129 so the first leg 126*a* and second leg 126*b* become compressed together so when the V-shape is fully extended into the hooked receiver 129 the second leg 126*b* of the V-shaped notch-tab 126*v* springs back so the second leg 126*b* becomes lodged under the fourth leg 129*d* of the hooked receiver 129.

Figure 69:
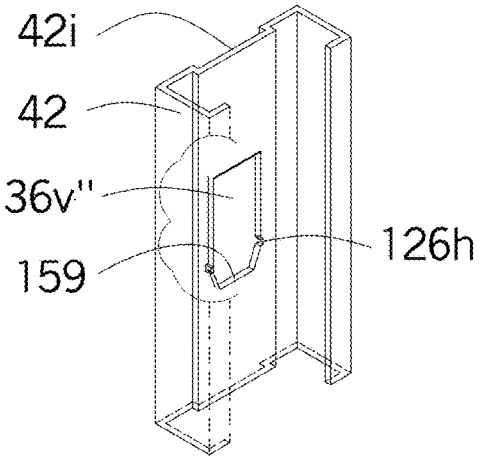
FIGS. 69 & 70 shows a reverse lip spacer brace extending through a V shaped hole having a blunt end and also connected by lip notches and hole notches.

FIGS. 69-76 show different variations of a V-shaped hole 36*v* also described as V' & V. A V-shaped hole 36*v* has the hole bottom edge 36*be* in a V-shape. In FIG. 69 the V-shaped hole V" has the bottom edge oriented horizontally or the blunt end 159 of the V-shaped hole V" while both the hole side edges 36*se* are at an angle similar to FIG. 73, in addition the vertical hole side edges 36*se* has hole notches 36*h* similar to other previous figures at the intersection of the hole side edges 36*se* and the angular side walls of the V-shaped hole 36V". A reverse lip spacer brace 301 shown having a web 301*a* abutting the blunt end 159 with the flanges 301*b* parallel with the angular side walls of the V-shaped hole 36" and lips 301*c* extending externally having lip notches 126*p* extending into the hole notches 36*h*.

Figure 71:
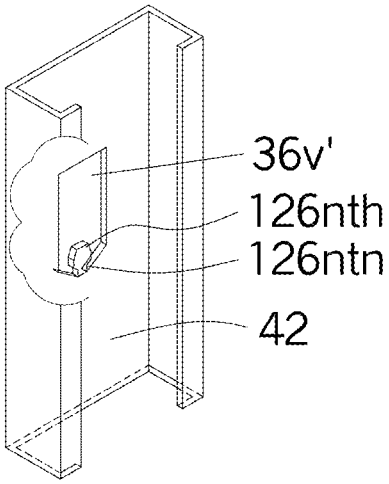
FIGS. 71 & 72 shows a V shaped hole having a V shaped spacer brace with a notch-tab at the vertex and FIGS. 73 & 74 show the V shaped spacer brace being connected by holes notches and leg notches.
Figure 72:
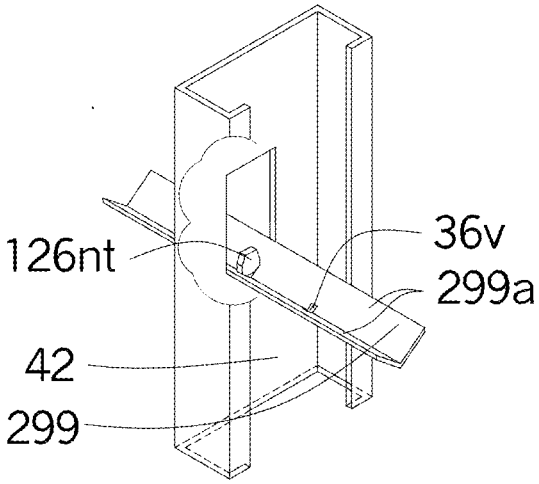

FIG. 71 is similar to FIG. 69 except the V-shaped hole 36*v*' has a notch-tab 126*nt* at the vertex and does not have holes notches 36*h*. In FIG. 72 a V-shaped channel or V-shaped spacer brace 299 has two angular legs 299*a* that meet at the vertex of the angular legs 299*a*, however at the vertex a vertex slot hole 36*v* is installed so the notch-tab 126*nt* can fit into. The notch-tab 126*nt* is extended from the web 42*a* through the vertex slot hole 36*v* with the head 126*nth* being larger and taper so the head 126*nth* can slide into the vertex of the vertex slot hole 36*v*.

Figure 73:
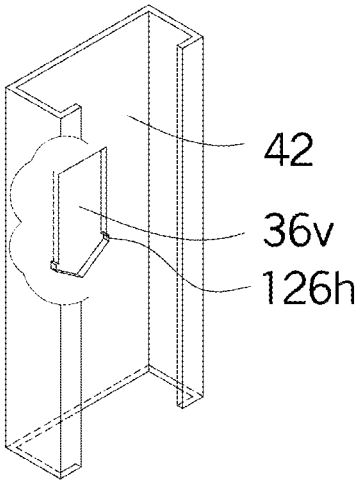
Figure 74:
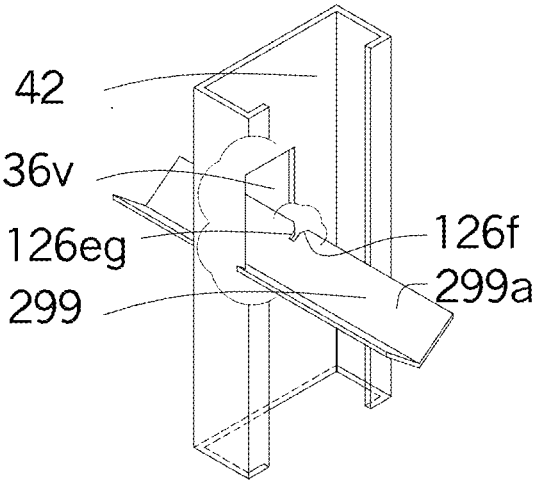

FIG. 73 is similar to FIG. 69 as the V shaped hole 36*v* has hole notches 36*h* at the angular oriented hole bottom edges 36*be* and the hole side edges 36*se*. In FIG. 74 the V shaped spacer brace 299 has leg notches 126*eg* to fit into the hole notches 36*h* thereby eliminating any vertical and horizontal movement of the V shaped spacer brace 299.

Figure 75:
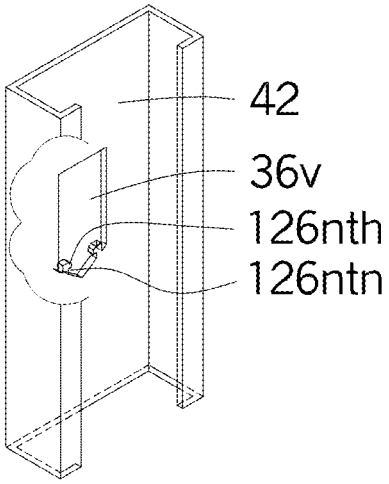
FIGS. 75 & 76 also use the V-shaped hole, but the notch-tabs extend from the angular hole bottom edge.
Figure 76:
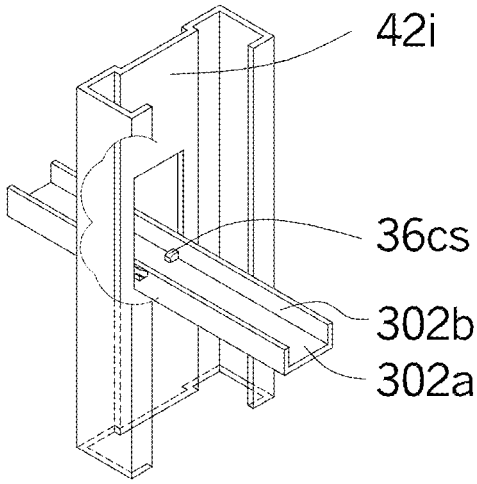

FIG. 75 shows a V shaped hole 36*v*'" having a slightly different configuration where a notch-tab 126*nt* is shown at each of the angular oriented hole bottom edges 36*be*. In FIG. 76 a U-shaped spacer brace 302 is installed in the V shaped hole 36*v*'" and corner slot holes 36*cs* are installed at the intersection of the web 302*a* and flanges 302*b* on both side corner edges. The corner slot holes 36*cs* are large enough for the head 126*h* to fit through and become engaged at the notch-tab notch 126*ntn* of the notch-tab 126*nt*.

FIG. 77 shows two horizontal oriented U-shaped spacer braces 302 having horizontal oriented notch-tabs 126*nt* extend from the web 302*a* at each end into the vertical oriented hole notches 126*h* at each of the hole side edges 36*se*. A horizontally oriented U-shaped spacer brace 302 intersections a vertical oriented hole 36 in the web 42*c* of the C channel 42 from the left side and another U-shaped spacer brace 302 intersections the hole 36 from the right side. The ends of the U-shaped spacer braces 302 have notch-tabs 126*n* that extend from the webs 302*a* at the indentations 301*i* forming a head 126*nth* greater than the width of the hole 36. When installing the web 302*a* and flanges 302*b* the notch-tab 126*nt* abut one side plane of the web of the 42*a* of the C channel 42 at the indentation 302*i* with the web extension 302*we* passing through the hole side edges 36*se* extending from the web 302*a* over the hole bottom edge 36*be* then extending along the opposing side plane of the web 42 forming a notch 126*ntn* in the notch-tab 126*nt* to the end of the head 126*nth* of the notch-tab 126*nt*. In addition, hole notches 126*h* installed at the hole side edges 36*se* to eliminate vertical movement and provide stronger metal framing connections. Since the notch-tab 126*nt* passes through the vertical oriented hole notches 126*n*, notches 126*ntn* installed on both side edges of the notch-tab 126. The adjacent U-shaped spacer brace 302 also has the notch-tab 126 at each end along with the notches 126*ntn* at the notch-tabs 126*nt*. When two notch-tabs 126*nt* are installed over each other into the same hole notch 126*h*, the notch-tabs 126*nt* are stacked above each other forming a hole notch 126*h* having a taller wider opening to accommodate two notch-tab notches 126*ntn*. The notch-tab 126*ntn* of the notch-tab 126*nt* has the web 42*a* as one side edge the web extension 302*we* as the second side edge and the head 126*nth* as the third side edge of the notch-tab 126*nt*. Since the U-shaped space brace 302 and the notch-tabs 126*nt* are wider than the width of the hole 36, the U-shaped spacer brace 302 is installed at an angle installing one notch-tab notch 126*ntn* into the hole notch 36*h* at one hole side edge 36*se* then pushing the opposing notch-tab notch 126*ntn* into the opposing hole notch 126*h* on the opposing hole side edge 36*se*. The notch-tab 127*nt* could also be used at the end of described as a notch-finger 127*n* similar to FIG. 78 or as an extension of the web 302*a* having a notch 126 and now referred to as notch-tab notch 127*ntn*. As previously described, spacer braces vary in size, shape and connect differently between framing elements. The notch-tab 126*nt* can be installed as a connection means at the ends of any metal framing member needing a connection without requiring fasteners and an even stronger connection when holes notches 126*h* are used.

In addition, the hole notches 126*h* and the lip notches 126*p* secure the support member to the crossing member without fasteners.

Figure 78:
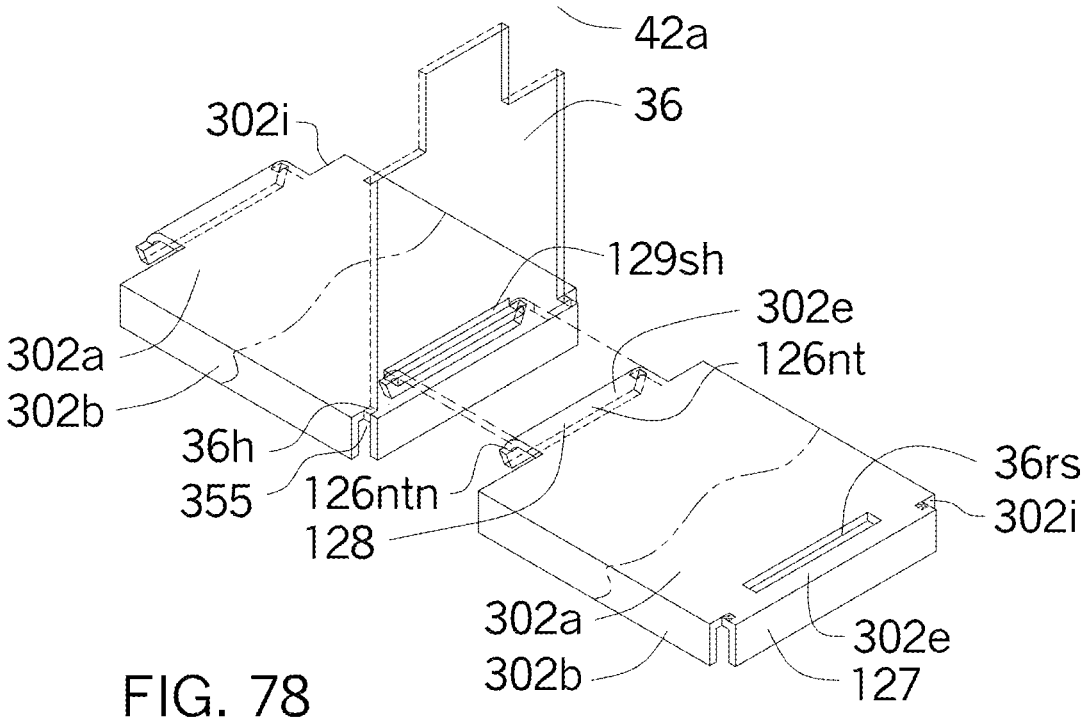
FIG. 78 shows two spacer braces intersecting a notched hole where one end has the extension engaged in the notched hole with the finger extending over the bottom edge having a web-slot hole for the opposite end of an adjacent spacer brace having a notch-tab end engage the web-slot hole.

FIG. 78 shows two horizontal oriented U-shaped spacer braces 302 passing through the hole 36 of a support member connected together having hole notches 126*h* at the hole side edges 36*se* with the bottom edge of the hole notches 126*h* being the hole bottom edge 36*be*. The web 302*a* and flanges 302*b* abut one side of the 42*a* of the C channel 42 at the indentation 302*i* with the web extension 302*we* passing over the hole bottom edge 36*be* and into the hole notches 126*h* so the hook finger 127 can extend downward over the hole bottom edge 36*be* and against the planar surface of the web 42*a*. At the web 302*a* a receiver slot hole 36*rs* that extends parallel to the web 42*a* less than the width of the hole 36 for an adjacent spacer brace to connect into. The opposing end also has the web 302*a* and flanges 302*b* abut the planar surface of the adjacent web 42*a* of another support member. The opposite end of a second U-shaped spacer brace 302 has a web extension 302*we* with a notch-tab 126*nt* at the end which is installed over the hook finger 128 and web 302*a* of the first U-shaped spacer brace 302. The web extension 302*we* is wider than the width of the receiver slot hole 36*rs* of the first U-shaped spacer brace 302 so notches 126*ntn* can be bent and installed at the side edges of the web extension 302*we* and then inserted into the web slot hole 36*we*. The notch-tab 126*nt* in the web slot hole 36*ws* and the hole notches 126*h* and the hook finger 128, web 302*a* and flanges 302*b* engage the opposing end making a self-locking connection between the two U-shaped spacer braces 302.

Figure 80:
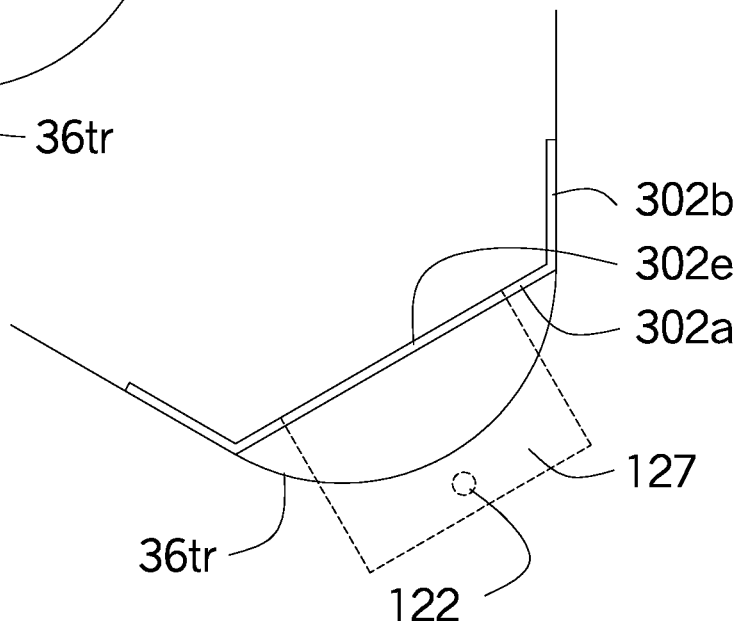
Figure 79:
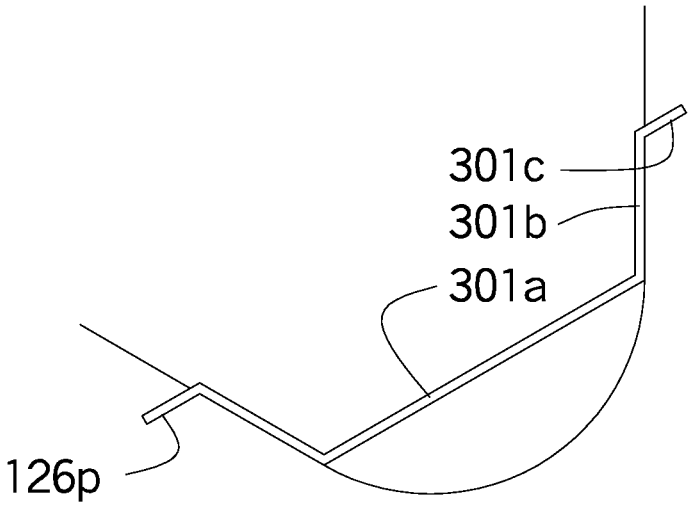

FIG. 79 shows a reverse lip spacer brace 301 [framing member 2] having corner notches 126*wf* engaging the hole bottom edge [36*be*) and lip notches 126*g* engaging the hole side edges with flange-lip notches 126*fg* that engages the hole side edges 36*se* and connected by fasteners (not shown) to the web 42*a* of the first framing member 42. The reverse lip spacer brace 301 shows the external side of the flanges 301*b* at an angle so the web 301*a* and flanges 301*b* can fit through the triangular shape hole 36*t*, however the lips 301*c* act as a flap 76 as shown in FIG. 80 where the flaps 76 abuts the web 42*a*. The flaps 76 or the ends of the lips 301*c* abut the web 42*a* on one side of the web 42*a* and the web 301*a* of the reverse lip spacer brace 301 has an indentation 301*i* and then a web extension 301*we* (not shown, but in FIGS. 68 & 78 shown as a web extension 302*we*, required when extending through a hole 36) so the hook receiver 129 can extend over to the opposite side of the web 42*a* and the internal side of the hook tongue 128 can abut the web 42*a* and fastened by a fastener 122 into the web 42*a*. FIG. 80 shows the web 302*a* and the flanges 302*b* extending through the triangular shape hole 36*t* and flaps 76 that extend away the angular oriented flanges 302*b*. The flaps 76 are rectilinear in shape and are perpendicular to the flanges 302*b*. FIG. 79 shows an elevation of the U-shaped spacer brace 302 where the hook receiver 129 or the hook finger 127 is fastened with fasteners 122 on the viewers side of the web 42*a*, the web extension 302*we* is the thickness of web 42*a* of the support member and the indentation 302*i*, web 302*a* and the flanges 302*b* is on the opposite side of the web 42*a*. Some spacer braces are attached to the web 42*a* or by the hook finger 127 or the U-shaped hook receiver 129 when installed in tandem.

Figure 82:
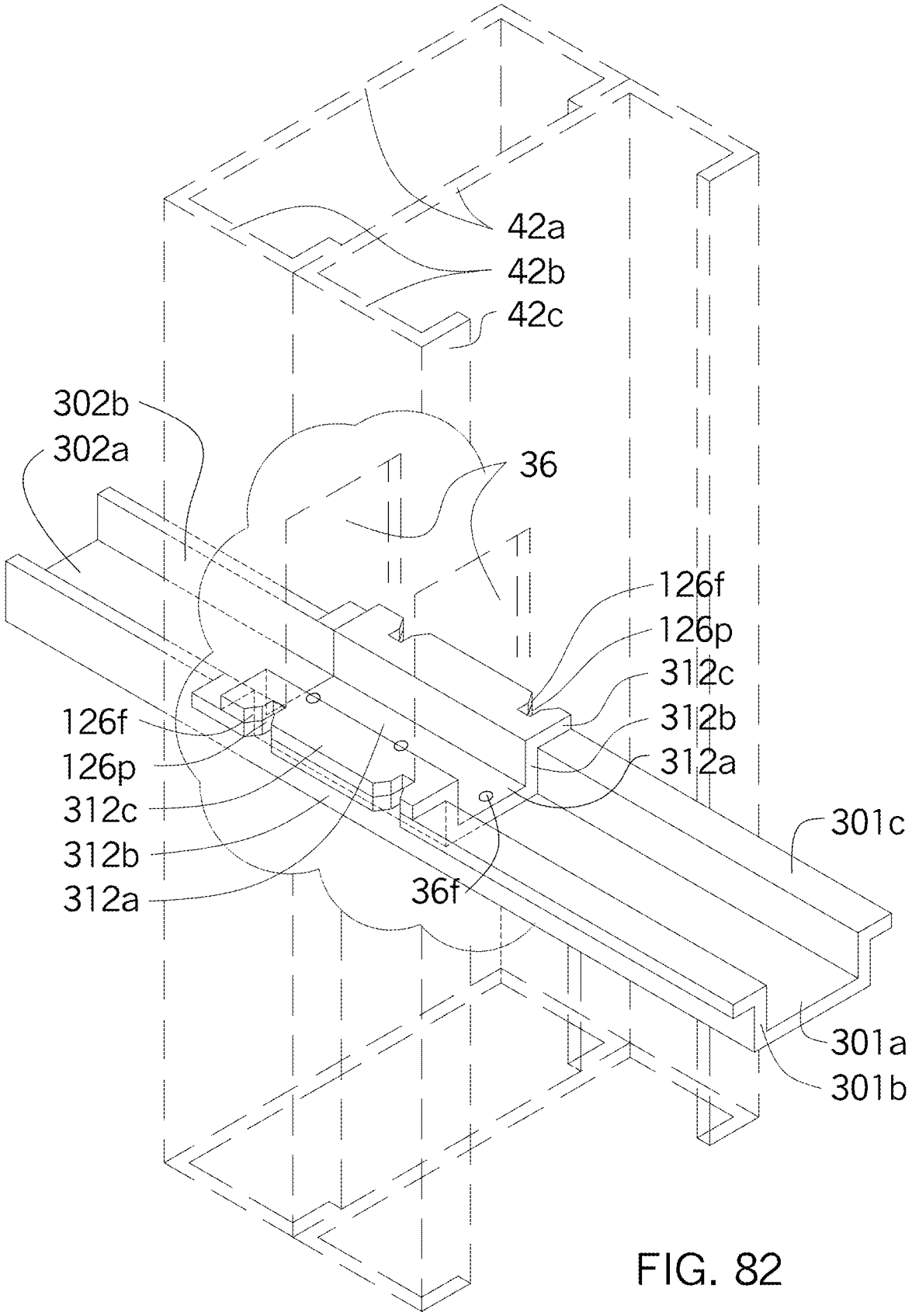
FIG. 82 shows a double reverse clip bracket being attached to two support members shown as a C channel 42 and a horizontal bracing channel shown as a U-shaped shown on the left side where the web of the U-shaped rests on the bottom edges of the holes and the flanges fit against the side edges of the holes in the webs of the support members with the right side shown as a reverse lip spacer brace as shown as FIG. 56 in provisional application 62/369,041 filed on Jul. 30, 2016 and now part of this application.

FIG. 82 has a reverse lip bracket 208 installed between the flanges 155*b* of the horizontal U channel 155. The reverse lip bracket 208 is shown between hole 36 in the web 42*a* of the support channel and notches 126 are installed near the top of the flanges 208*b* and in the lips 208*c*. The notches 126 are wider so the flat plate 201 shown vertically and the edges of the hole 36 fit into the notches 126. Previously shown as FIG. 37 in provisional application 62/369,041 filed on Jul. 30, 2016, and now part of this application. shows a double reverse clip bracket 312 being attached to two support members shown as a C channel 42 and a horizontal bracing channel shown as a U-shaped 302 shown on the left side where the web 302*a* of the U-shaped 302 rests on the bottom edges of the holes 36 and the flanges 302*b* fit against the side edges of the holes 36 in the webs 42*a* of the support members with the right side shown as a reverse lip spacer brace 301. The double reverse clip bracket 312 can also be shown as a reverse lip spacer brace 301, shown here as having a web 312*a* and flanges 312*b* fits tight against the internal side of the U-shaped spacing member 302 and the lips 312*c* extend outwardly from its flanges 312*b*. The lips 312*c* extend outwardly having notches 126 with flares 126*f* that are angular where the notches 126 engage both sides of the vertical side edges of the holes 36 of two adjoining and adjacent support members thereby engaging two support members using the same double reverse clip bracket 312 or a reverse lip spacer brace 301 as shown as FIG. 56 in provisional application 62/369,041 filed on Jul. 30, 2016 and now part of this application.

Figure 83:
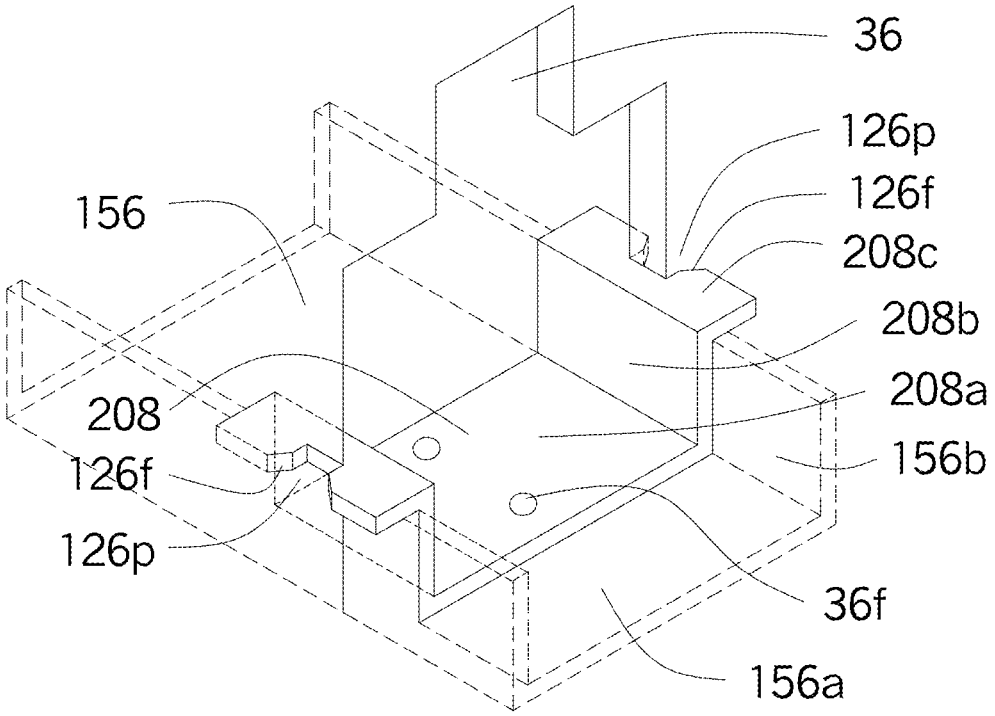
FIG. 83 shows a one piece multi-plane bracket having a bottom side, two vertical sides with notches at the horizontal lips engaging the hole of the support member installed between the webs of a bracing member being U-shaped with the web of the bracket fasten to the bracing member shown in provisional application U.S. Ser. No. 15/449,250 filed Mar. 3, 2017 now shown as FIG. 86 in U.S. Pat. No. 10,683,665 issued Jun. 16, 2020 and now part of this application.
Figure 84:
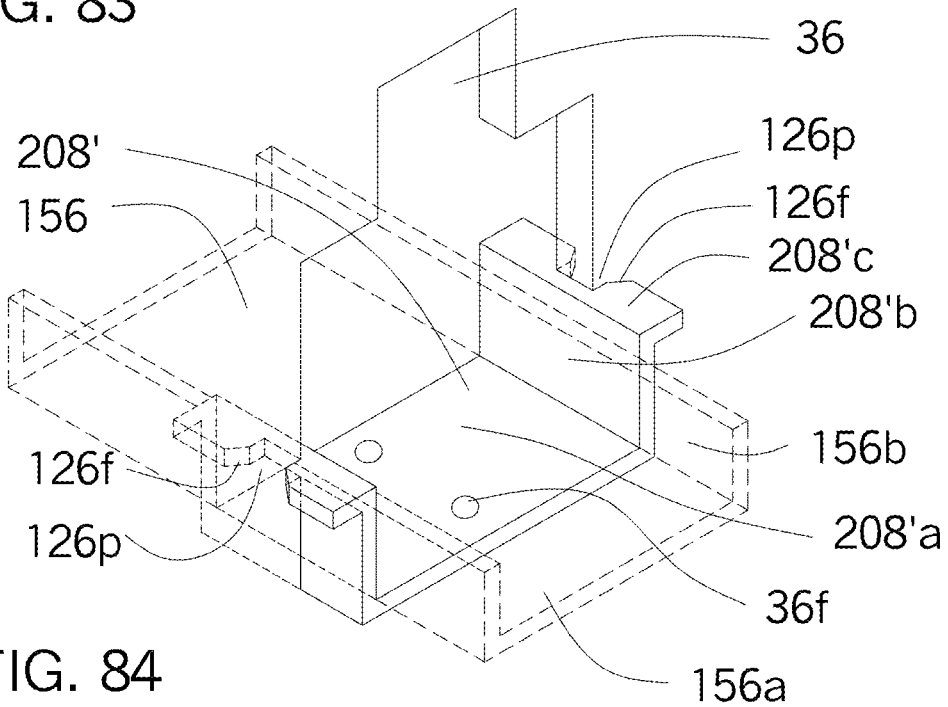
FIG. 84 is the same as FIG. 83 except the one piece multi-plane bracket shown as a reverse lip shape with notches at the lips is installed in the hole of the support channels first and the bracing member being U-shaped facing upwards is installed between the flanges of the bracket shown in provisional application U.S. Ser. No. 15/449,250 filed Mar. 3, 2017 now shown as FIG. 87 in U.S. Pat. No. 10,683,665 issued Jun. 16, 2020 and now part of this application.

FIG. 83 shows the horizontal bracing channel as a horizontal U channel 155 now U-shaped spacer brace 302 where the ventral side is facing upwards typically spanning between the holes 36 in the support channels shown as C channel 42. A reverse lip bracket 208 having the dorsal side fitting between the parallel ventral flanges 155*b* of the horizontal U channel 155 so that the lip notches 126*p* on both sides of the lips 208*c* engage the side edges of the hole 36 and extend past the edge of the hole 36 along with the flares 127 that are angled. The flares 127 are angled so the reverse lip bracket 208 can glide into the side edges of the hole 36 easily as the reverse lip bracket 208 is inserted in a vertical orientation and then rotated into a horizontal orientation so the lip notches 126*p* engage the side edges of the holes 36. The horizontal bracing channel and the reverse lip bracket 208 are additionally secured by fasteners between the webs 155*a* & 208*a* thereby securing the horizontal bracing channel, the reverse lip bracket 208 and the hole 36 together at the support channel. The multi-plane bracket 128 can also be used to connect two horizontal bracing channels together. FIG. 84 is similar to FIG. 83, however the reverse lip bracket 208 shown with its lip notches 126*p* are installed in the hole 36 of the support channels first, then the web 155*a* of the horizontal U channel 155 are installed between the two parallel flanges 208*b* of the reverse lip bracket 208 are secured together at their webs 155*a* & 208*a*. The multi-plane bracket 128 is rotated into the hole 36 with the lip notches 126*p* engaging the side edges of the hole 36. The reverse lip bracket 208 and the horizontal U channel 155 can be reversed, where the ventral sides are turned downward so the web 155*b* & 208*b* extend downward from the web 155*a* & 208*a*. The bracket 208 is shown in provisional application U.S. Ser. No. 15/449,250 filed Mar. 3, 2017 now shown as FIG. 87 in U.S. Pat. No. 10,683,665 issued Jun. 16, 2020 and now part of this application.

Figure 85:
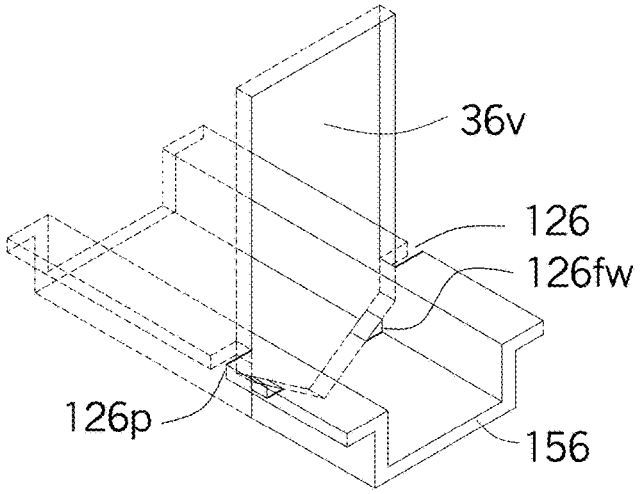
FIG. 85 shows an enlargement of the intersection with the notches of the lips engaging the sides of the hole in the support member. In addition, a U-shaped bracing member having a notches at the web and flanges engage a downward facing V shape hole as shown in FIG. 28 in provisional application 62/369,041 filed on Jul. 30, 2016 and now part of this application.

FIG. 85 shows the support member having a downward pointed V shaped hole 36*v* with angular side bottom edges at the web 42*a* of the C shaped channel 42 shown as the support member. A bracing member shown as a reverse lip channel 301 passes through the V shaped hole having a bottom edge 301*d*, two parallel sides 301*b* and lips 301*c* extending outwardly with notches 126*n* at its outer edges engaging the side edges of the V shaped hole 36*v*. Another method to secure a bracing member to a hole in the support member is shown where the bottom side 301*d* and the two parallel sides 301*b* have notches 126*n* that are continuous to each other so the diagonal side edges of the downward pointing V shaped hole 36*v* engages the notches 126*n* at its bottom side 301*d* and the parallel sides 301*b* of the bracing member. Previously shown as FIG. 28 in provisional application 62/369,041 filed on Jul. 30, 2016 and now part of this application.

Figure 86:
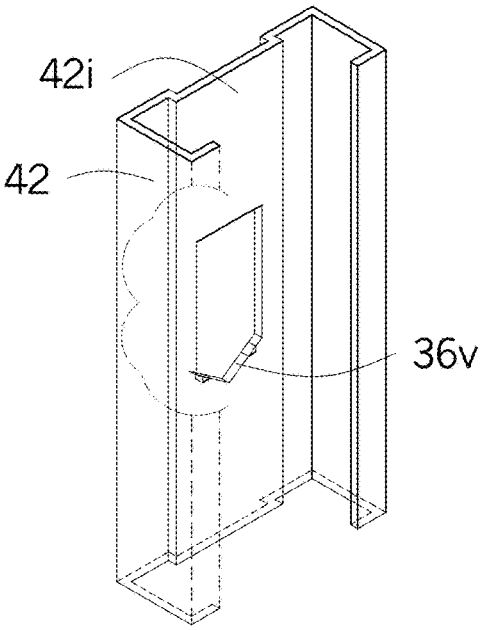
FIG. 86 is an isometric view of a C channel as the support channel with a V hole and the V pointing downward shown in provisional application U.S. Ser. No. 15/449,250 filed Mar. 3, 2017, shown as FIG. 23 in U.S. Pat. No. 10,683,665 issued Jun. 16, 2020, and now part of this application.
Figure 87:
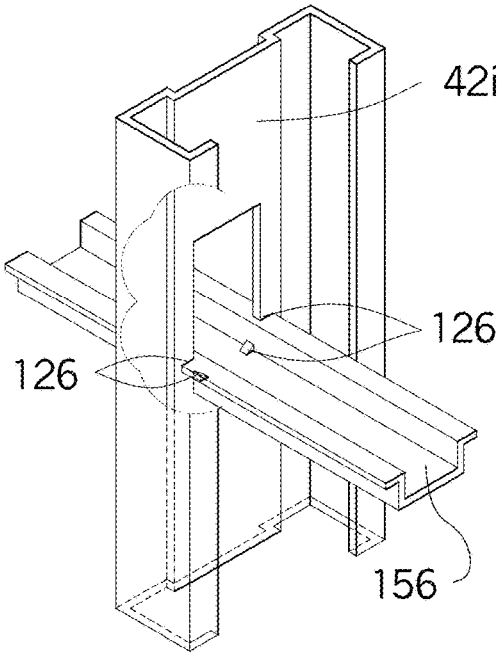
FIG. 87 shows the support channel of FIG. 86 with a longitudinal spacing-bracing member with corner notches in the web received in the blunt end shown in provisional application U.S. Ser. No. 15/449,250 filed Mar. 3, 2017 now shown as FIG. 24 in U.S. Pat. No. 10,683,665 issued Jun. 16, 2020 and now part of this application.

Referring to FIGS. 86-87 the support channel shown as C channel 42 having an indentation 42*i*, but has an indentation at the web 42*a* for strengthening. This feature is not part of the present invention. The V-shaped hole 36*v* in indentation 42*i* is similar to the V-shaped hole 36*v* in support channel 42. The support channel being a C channel 42 receives horizontal U channel 155. The horizontal U channel 155 has corner notches 126*fw* located on the corners where the flanges 155*a* and web 155*b* intersect. The corner notches 126*fw* in each corner are opposite one another. The corner notches 126*fw* engage the wall of the web 42*a* has angled bottom edges sloping inward to form the V. The V hole 36*v* with the sloped edges and the side edges of the hole engage the corner notches 126*fw* preventing the horizontal U channel 156 from moving horizontally. The corner notches 126*fw* and the U-shaped spacer brace were shown as corner notches 126 and horizontal U channel 155 shown in FIG. 23-24 in provisional application 62/369,041 filed on Jul. 30, 2016 and now part of this application are shown in in the application U.S. Ser. No. 15/449,250 filed Mar. 3, 2017 now shown as FIG. 86-87 in U.S. Pat. No. 10,683,665 issued Jun. 16, 2020 and now part of this application.

Figure 88:
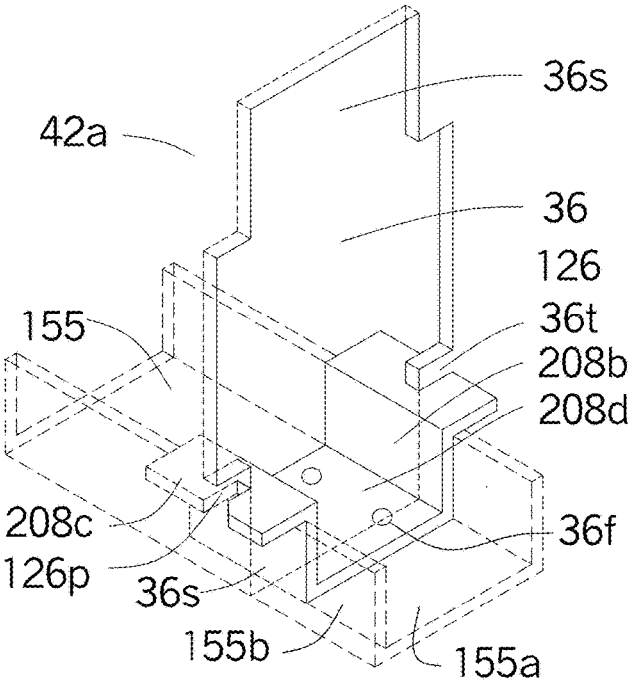
FIG. 88 shows a large hole in the web of the support member with a smaller hole above and another lower hole below the larger hole for a smaller width bracing channel to fit through and a smaller size U-shaped bracket with extending lips, so the lips with notches can fit into the side edges of the smaller sized hole as shown in FIG. 46 of the provisional application 62/369,041 filed on Jul. 30, 2016 and now part of this application.

FIG. 88 shows the reverse lip bracket 208 and bracing member are smaller in width. FIG. 46 shows a hole 36 that is wider in middle with smaller size holes 36*s* at the top and bottom edges of the hole 36 which is a standard size hole produced by metal stud manufactures. The reverse lip bracket 208 is installed in the smaller width portion of the hole 36 so the bottom side 208*d* and the parallel sides 208*b* fit within the smaller area of the hole 36. The lips 208*c* with its notches 126 at the ends, are installed so the notches 126 extend on both sides of the throat 36*t* of the hole 36. Previously shown as FIG. 46 in provisional application 62/369,041 filed on Jul. 30, 2016 and now part of this application.

Figure 89:
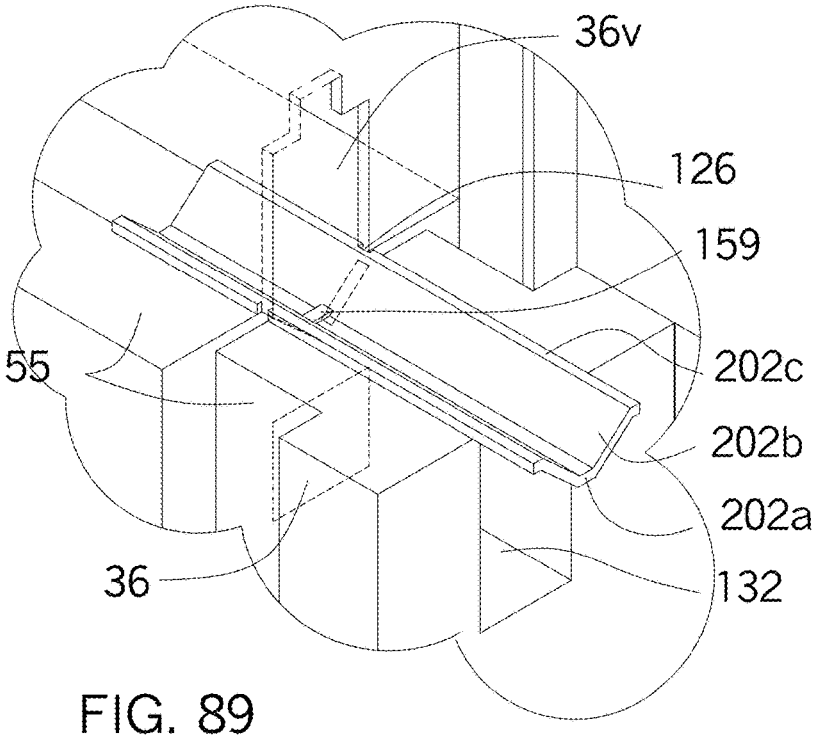
FIG. 89 shows a bracing member as V shaped with the lips having notches that engage the holes where the holes in the support member is V shaped with the arrow shape pointing downward and also having a blunt point and the bracing member having a notch at the vertex for the blunt end of hole to fit into as shown in FIG. 13 in provisional application 62/369,041 filed on Jul. 30, 2016 and now part of this application.

FIG. 89 shows a bracing member shown as a modified V channel 202 (reverse lip spacer brace 301) passing through a V shaped hole 36*v* with a blunt end 159 at the vertex at the web 42*a* of the support member. The modified V channel 202 (301) has a bottom side 202*a* (301*a*), two angular sides 202*b* (302*b*) with lips 202*c* (301*c*) where the bottom side 202*a* (301*a*) and the two angular sides 202*b* (301*b*) have notches 126 (for the blunt end 159 to fit into. The modified V channel 202 also uses notches 126 at the lips 202*c* to secure the modified V channel 202 to the V shaped hole 36*v*. In addition, two holes are shown in the web 42*a* of the C channel 42, a deeper trough 132 and the bottom edges of the lips 202*c* (301*c*) rest on the top side of the spacer block 55. Previously shown as FIG. 13 in provisional application 62/369,041 filed on Jul. 30, 2016 and now part of this application.

Figure 90:
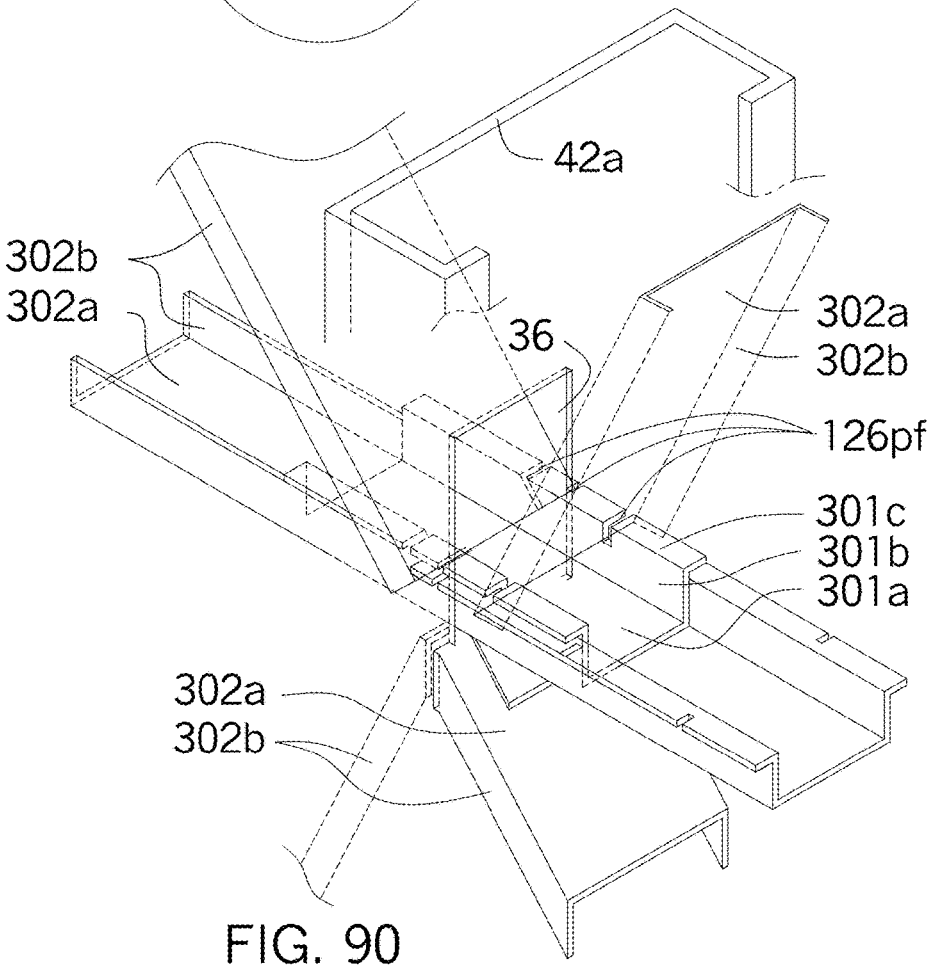
FIG. 90 shows an enlargement of the six spacer braces intersecting in one hole however the horizontal spacer brace is shown as a continuous horizontal bracing channel for clarification and a reverse lip brace with notches in the lips are secured to the sides of the hole and the reverse lip brace has angles notches for the top sides of the diagonal spacer braces could be installed in the angled notches. Previously shown as FIG. 28 in provisional application 62/083,276 filed Nov. 23, 2014, and later shown as FIG. 8 in application U.S. Ser. No. 14/946,378 filed Nov. 19, 2015.

FIG. 90 the exploded isometric view show the reverse lip shaped brace 301 on the right is installed first where the bottom side 301*d* has an indentation 301*i* and has an extension 301*e* where the extension 301*e* is wider than the bottom side 301*d* so notches 126 are installed at the outside edges that engaged the side edges of the hole 36 in the support member. The left reverse lip shaped spacer brace 301 has notches at the side edges of the lip 301*c* is installed over the right reverse lip shaped spacer brace 301 so the notches 126 at the lips can engage both sides of the side edges at the hole 36. The horizontal bracing channel 155 has been changed to a U-shaped spacer brace 302 on the left side and the one piece multi-plane bracket 301 is now referred to as a reverse lip spacer brace 301 on the right side. Previously shown as FIG. 8 in patent application U.S. Ser. No. 14/946,378 filed Nov. 19, 2015, and now part of this application. In addition, FIG. 23-28 are more fully described at length and claimed in provisional application 62/083,276 filed on Nov. 23, 2014 and more specifically shown at FIG. 28 and claims 23 & 24. A segment of the specification notes; FIG. 28 shows a upward orient bracing member shown as a horizontal bracing channel 155 passing through the hole 36 having a bottom side 155*d* and two parallel sides 155*b* for clarity purposes. A one-piece multi-plane brace 301 having a bottom side 301*d*, two parallel sides 301*b* with lips 302*c* extending outwardly being installed between the two parallel sides 155*b* into the bracing member and the lips 301*c* with notches 126 engaging the side edges of the hole 36. The upward facing one piece multi-plane brace 301 also has angular oriented notches 126 installed in the lips 301*c* and the upper side of the two parallel sides 301*b* forming continuous notches 126. Diagonally oriented U-shaped spacer braces 302 have their top sides 302*a* installed into the diagonally oriented notches 126. Whether the spacer braces or U-shaped or reverse lip shapes, upward facing or downward facing the spacer braces are interchangeable as well as most of the interlocking connections at the hole 36. Previously shown as FIG. 28 in provisional application 62/083,276 filed on Nov. 23, 2014, and as FIG. 8 in U.S. Ser. No. 14/946,378 filed Nov. 19, 2015 and now part of this application.

Figure 91:
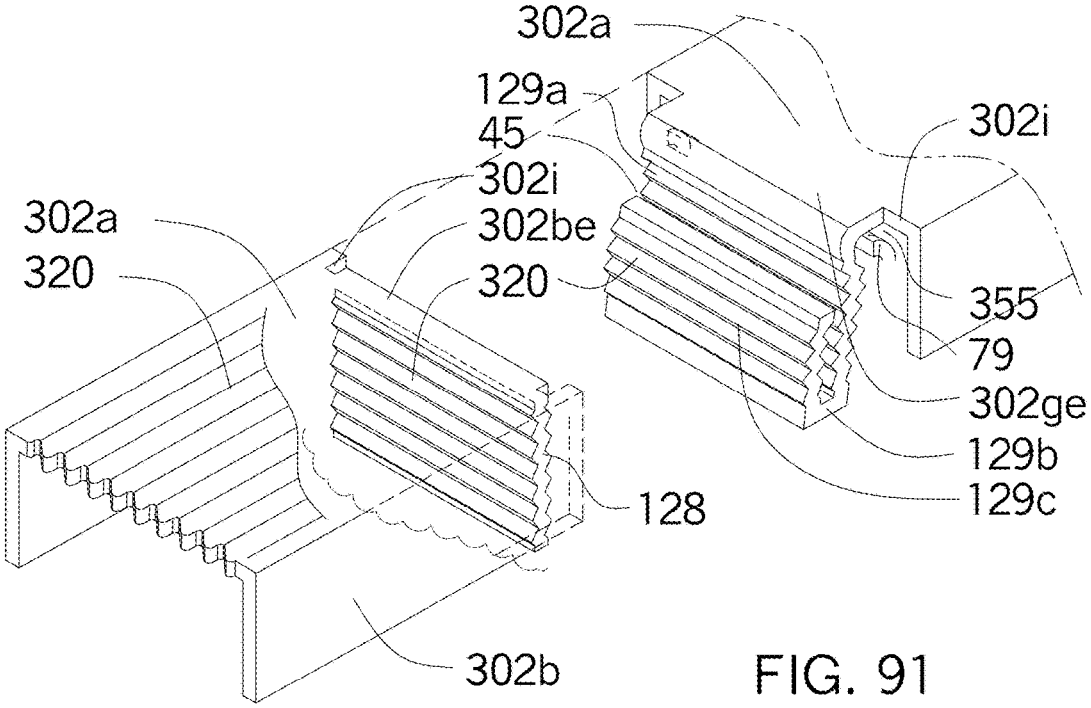
FIG. 91 is similar to FIG. 275 in provisional application U.S. 62/345,153 except here the hook receiver does not have ridges; the ledge is shown clearer and the tab shaft and is now notch-tabs. shown as FIG. 91 in provisional application 62/399,434 filed Sep. 25, 2016.

FIG. 91 shows a U-shaped spacer brace 302 having the exterior side facing upward with the flanges 302*b* extending internally downward. The U-shaped spacer brace 302 is shown broken where the hook tongue 128 is shown having horizontally oriented ridges 320 on the left with the flanges 302*b* extending beyond the hook tongue 128 where the edges of the flanges 302*b* would engage the web 42*a* (not shown). The right U-shaped spacer brace 302 has the hook receiver 129 extending from the web 302*a*. The hook receiver 129 is shown with the first leg 129*a* extending downward from the web 302*a* then horizontally at the second leg 129*b* and third leg 129*c* extending vertically upward leaving a gap 45 between the first and third legs 129*a* & 129*c*. The hook tongue 128 fits into the gap 45. The hook tongue 128 and the first and third legs 129*a* & 129*c* all have horizontal ridges 320 so the ridges 320 can interlock between each other forming a self-locking connection between each other. FIG. 41 shows the ledge 79 on the internal side of the U-shaped spacer brace 302 under the ledge extension 302*ge* protruding outwardly from the web 42*a* toward the hook receiver 129. The ledge extension 302*ge* rests onto the ledge 79 and the hook receiver 129 extends over the ledge 79. Since a ledge 79 can occur at the top of a support member, not specifically at a hole 36, it is referred to as a ledge extension 302*ge*. Another self-locking connection occurs when the ledges 79 at the top, bottom or the support member or at the side edges of the holes 36, occupy the anchor space 355 at the ledge extension 302*ge* and the first leg 129*a* wraps-around the ledge 79 at the front side edge and bottom side edge then turns parallel to the web 42*a*, but extends slightly outward having a fluid shape similar to the W-shaped clip 307. The second leg 129*b* and third leg 129*c* including the flare 128*d* are shaped similar to the W-shaped clip 307. As explained earlier the side edges of the holes 36, side edges of the ledges 79 or the sides of the flanges 302*b* all restrict any horizontal movement of the U-shaped spacer brace 302 at the support member. In addition, the left U-shaped spacer brace 302 the hook tongue 129 has a bend extension 302*be* at the web 302*a* for the hook tongue 129 to extend downward and the flanges 302*b* extend past the hook tongue 129 so the flanges 302*b* can abut the web 42*a* of the support member. Previously shown as FIG. 42 in provisional application Ser. No. 15/295,172 filed on Oct. 17, 2016 and now U.S. Pat. No. 10,364,566 Issued Jul. 30, 2019 an now part of this application.

Figure 92:
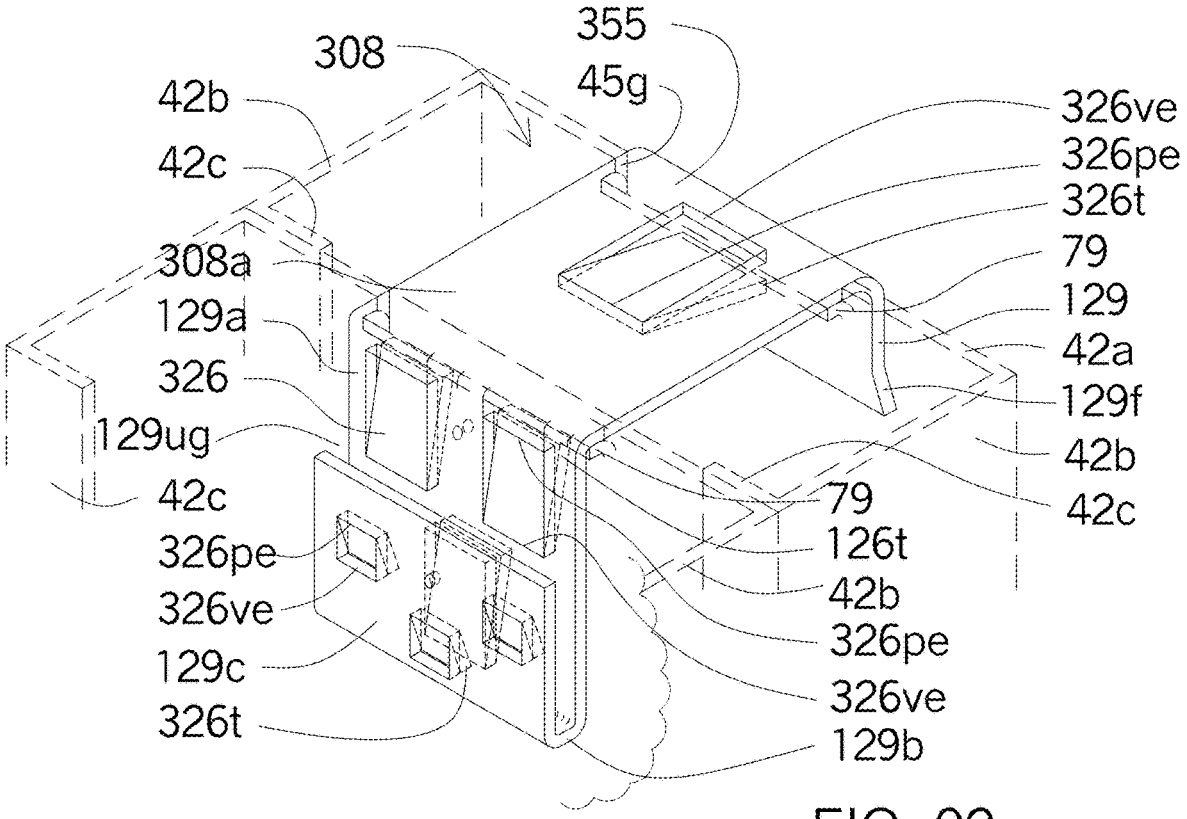
FIG. 92 shows an isometric view of a U-shaped spacer brace clip spanning over the end of two support members conned at the web and ledges and tabs of the punched-out tabs in the U-shaped clip. Previously shown as FIG. 17 in Provisional application Ser. No. 15/295,172, filed Oct. 17, 2016, now U.S. Pat. No. 10,364,566, issued Jul. 30, 2019 and not part of this application.
Figure 93:
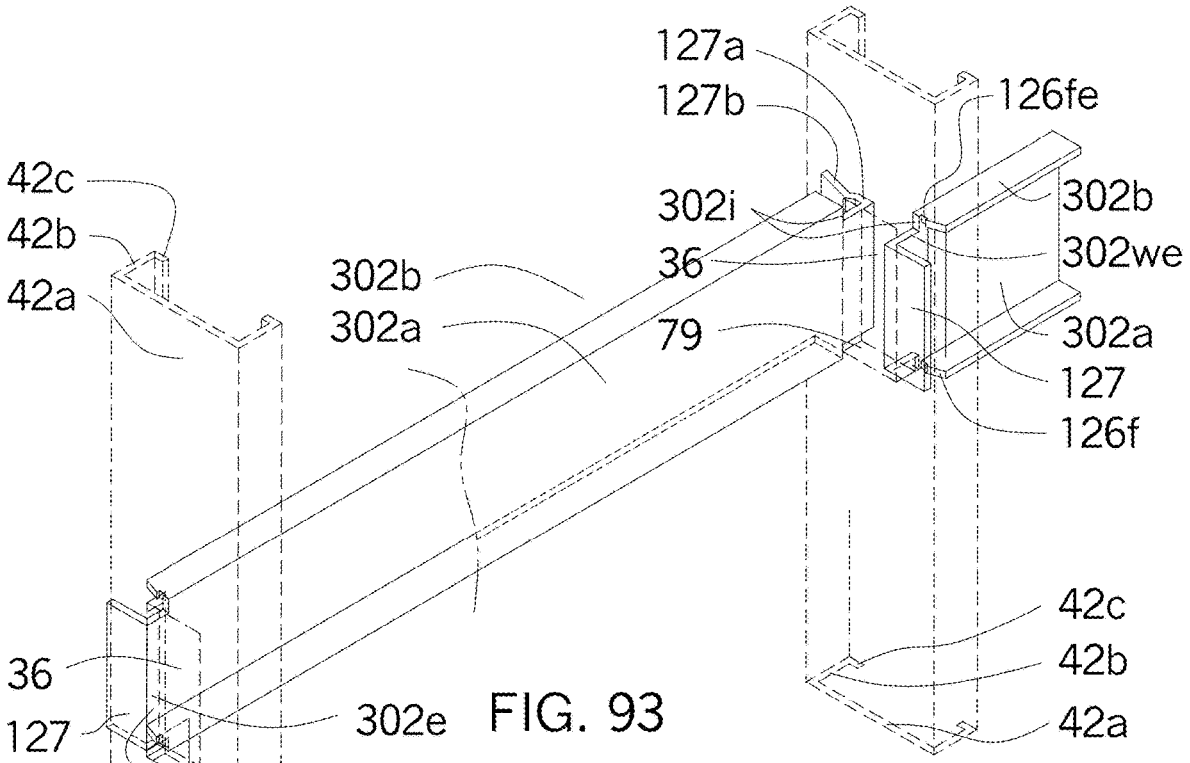
FIG. 93 shows an isometric view of a U-shaped spacer brace being installed on the vertical side edges shown as a ledge at the holes in the support members and where the U-shaped spacer braces on installed on both vertical side edges of the hole of a support member.
Figure 94:
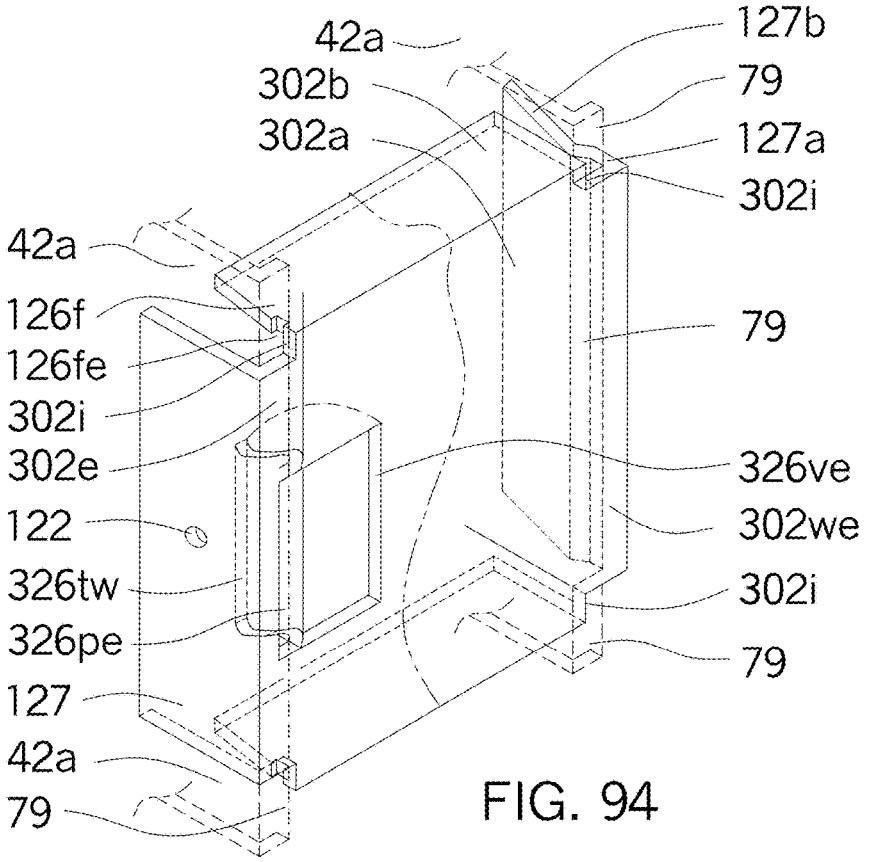
FIG. 94 is an enlargement at the intersection of the ledge in the support member and the notch gap in the flange of the spacer brace.

In FIG. 92 on the left ends of the U-shaped spacer braces 302 show a hook finger 127 extending through the hole 36 where the flanges 302*b* engage the web 42*a* on one side and the hook finger 127 engaging the web 42*a* on the opposing side. The holes 36 show ledges 79 installed on the vertical side edges of the hole 36. The hook finger 127 has a web extension 302*we* that extends over the ledges 79 and where the ledges 79 extend over the web 42*a* of the support members. The ends of the flanges 302*b* of the U-shaped spacer braces 302 have flange-end notches 126*fe* for the ledge 79 to fit into. The hook finger 127 and the ledges 79 engaged into the flange-end notches 126*fe* for a self-locking connection to prevent any vertical movement of the U-shaped spacer brace 302 engaging the support member. The right ends or the opposite end shows the hook finger 127 having a U-shape where the hook finger 127 extends over the ledge 79 so the first leg 127*a* wraps-around and extends over the front edge of the ledge 79 and under the ledge 79 then parallel to the web 42*a* of the support member then having an outward projecting flare at the second leg 127*b*. The hook finger 127 with its U-shape supports the support member on one side of the web 42*a* and the flanges 302*b* abut the web 42*a* on the opposite side again forming a self-locking connection between the support member and the U-shaped spacer brace 302. FIG. 93 shows an enlargement of both the self-locking connections. A fastener 122 is shown on one of the hook fingers 127, should an engineer specify a fastener 122 over and above the self-locking connection described. Previously shown as FIG. 42-43 in provisional application Ser. No. 15/295,172 filed on Oct. 17, 2016 and now U.S. Pat. No. 10,364,566 Issued Jul. 30, 2019 an now part of this application.

Figure 95:
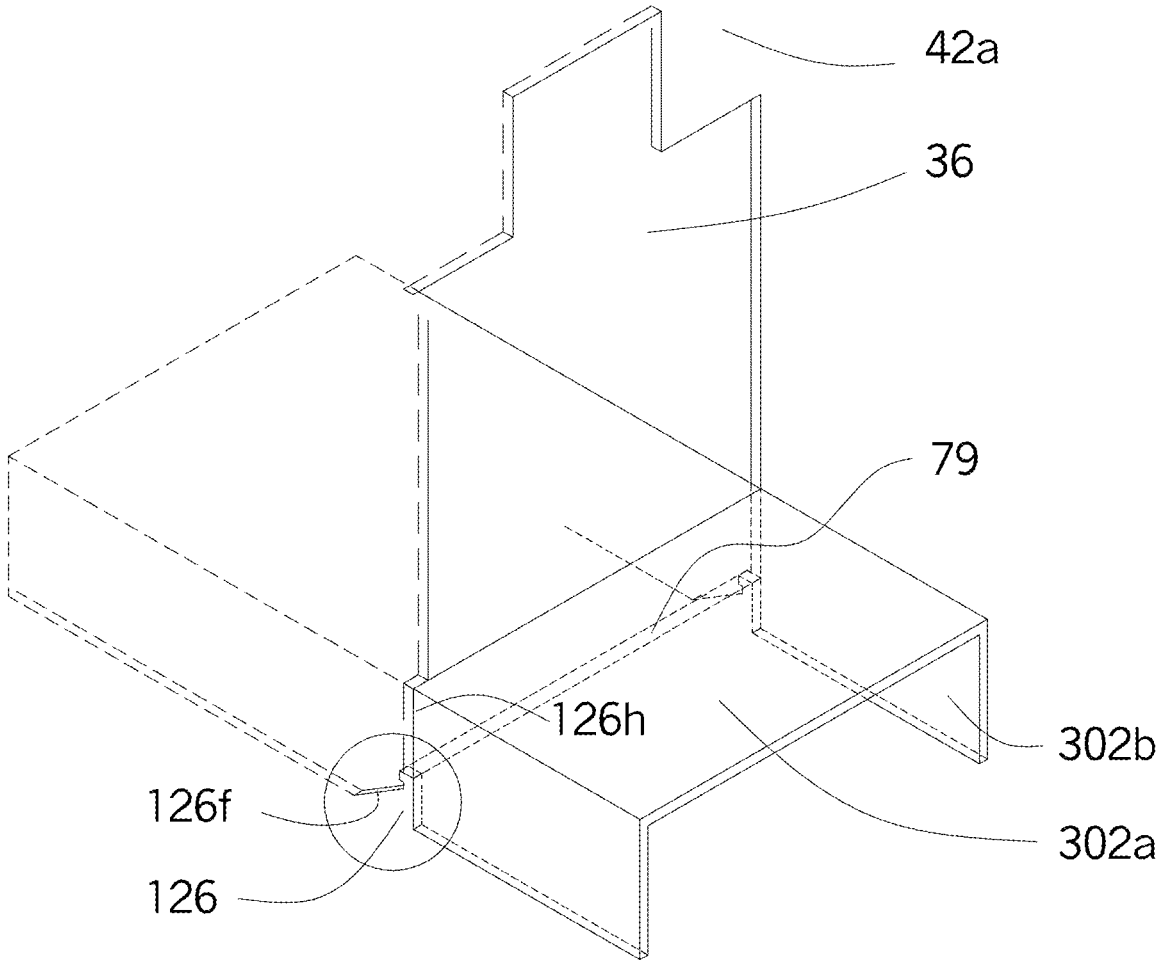
FIG. 95 is an isometric view of an enlargement of FIG. 94 where the notch and notch gap are shown in the flange of the U-shaped spacer brace having the dorsal side facing upward with the flanges extending downward from the web.
Figure 96:
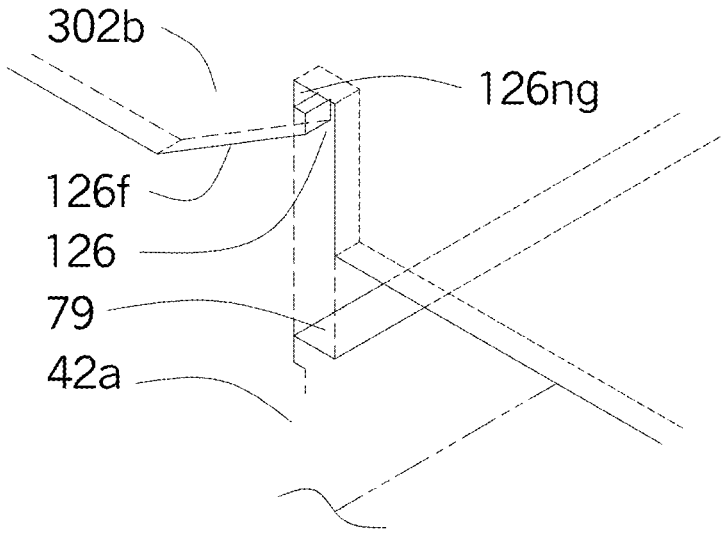

FIG. 95 shows an isometric drawing of the U-shaped bracing channel 302 having one flange 302*b* installed into a hole notch 126*h* shown at the left hole side edge 36*se* of the hole 36, and the right hole side edge 36*se* does not have the hole notch 126*h* but has a straight side edge 36*se* and the ledge 79 is used to secure the U-shaped bracing channel 302 to the support member 42. FIG. 96 is an enlargement of the right hole side edge 36*se* as shown in FIG. 8 95, but is shown as the left hole side edge for clarity purposes.

Figure 97:
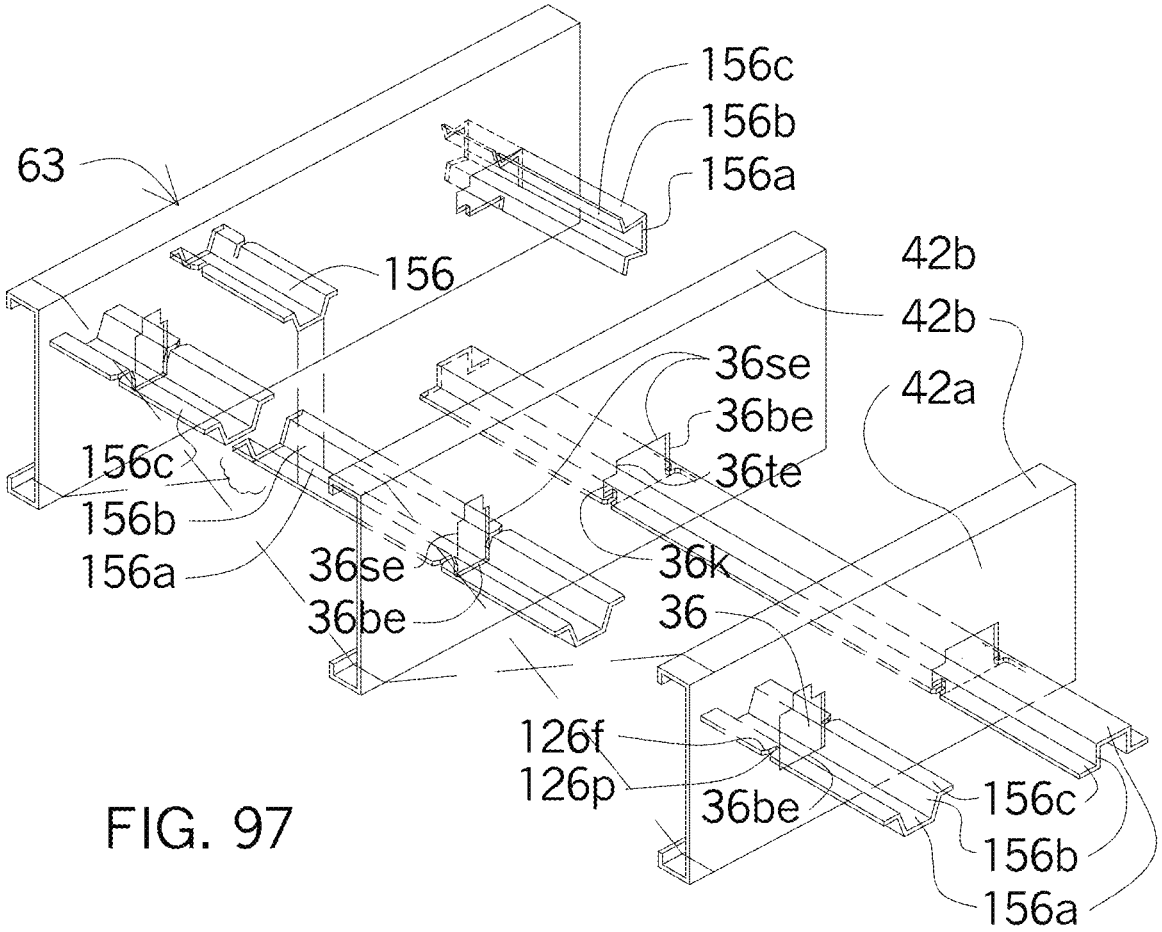
FIG. 97 is the same as FIG. 112 shown in the U.S. Provisional Application 61/628,044 dated Oct. 24, 2011, as attached to this patent application.

FIG. 97 is described in U.S. Provisional Application 61/628,044 dated Oct. 24, 2011 and attached to this patent application shows several metal floor joists 176*b* that can form a wall or roof system and being connected by joist straps (shown in ghost) which have been used to stabilize metal floor joists 176*b* from turning or twisting C channels 42 are used as the metal floor joists 176*b* in FIG. 97. The holes 36 are oriented vertically so the reverse lip channel 47 passes through the web 42*a* in a horizontal position, which is the notches 79*n* in the reverse lip channel 79 are installed in a horizontal position. On the other hand, when the hole 36 is oriented horizontally the reverse lip channel 79 is oriented vertically so the lips 79 car be projected vertically. In addition, the reverse lip channel 47 does have to be installed in shorter segments, a coupling can be used to connect two reverse lip channel 47 together. The coupling can be U-shaped or a flat plated within the reverse lip channel 47 between the two flanges and against the web; or another reverse lip channel 47 that has a smaller web along with longer lips in order to fit within the revere lip channel 47. The hole 36 in a horizontal position shows the horizontal bracing channel 150 passing through the holes 36 of the metal floor joist 176*b*, however the horizontal bracing channel 150 has notches 150*n* in the flanges 150*b* that fit into the holes 36 of the metal floor joists 176*b*. The notches 150*n* do not extend the full depth of the flange 150*v* so the flange 150*v* do not extend the full depth of the flange 150*b*, so the flange 150*v* has part of the flange 150*v* still connected to the web 150*a*. The flange 150*b* can be cut full depth, cut when doing so allow the horizontal channel 150 can bend easier when placing the horizontal bracing channel 150 into place. By installing the notches 150*n* in the horizontal bracing channel 150, the metal floor joist 176*b* will not bend or twist easily and the horizontal bracing channel 150 supports the foam spacer 55. The foam spacers 55 are not included in this application, FIG. 89 shows an enlargement of the original application, however the item numbers for the reverse lip channel 79 show in U.S. Ser. No. 13/398,243 filed Feb. 16, 2012 now abandon and in this application the reverse lip channel 156 is described as a reverse lip spacer brace 301. In addition, the notch 79*n* at the lip 79*c* is described in U.S. 61/629,552 filed on Nov. 22, 2011, in U.S. Ser. No. 13/398, 243 application the lip notch 126 is shown.

Figure 98:
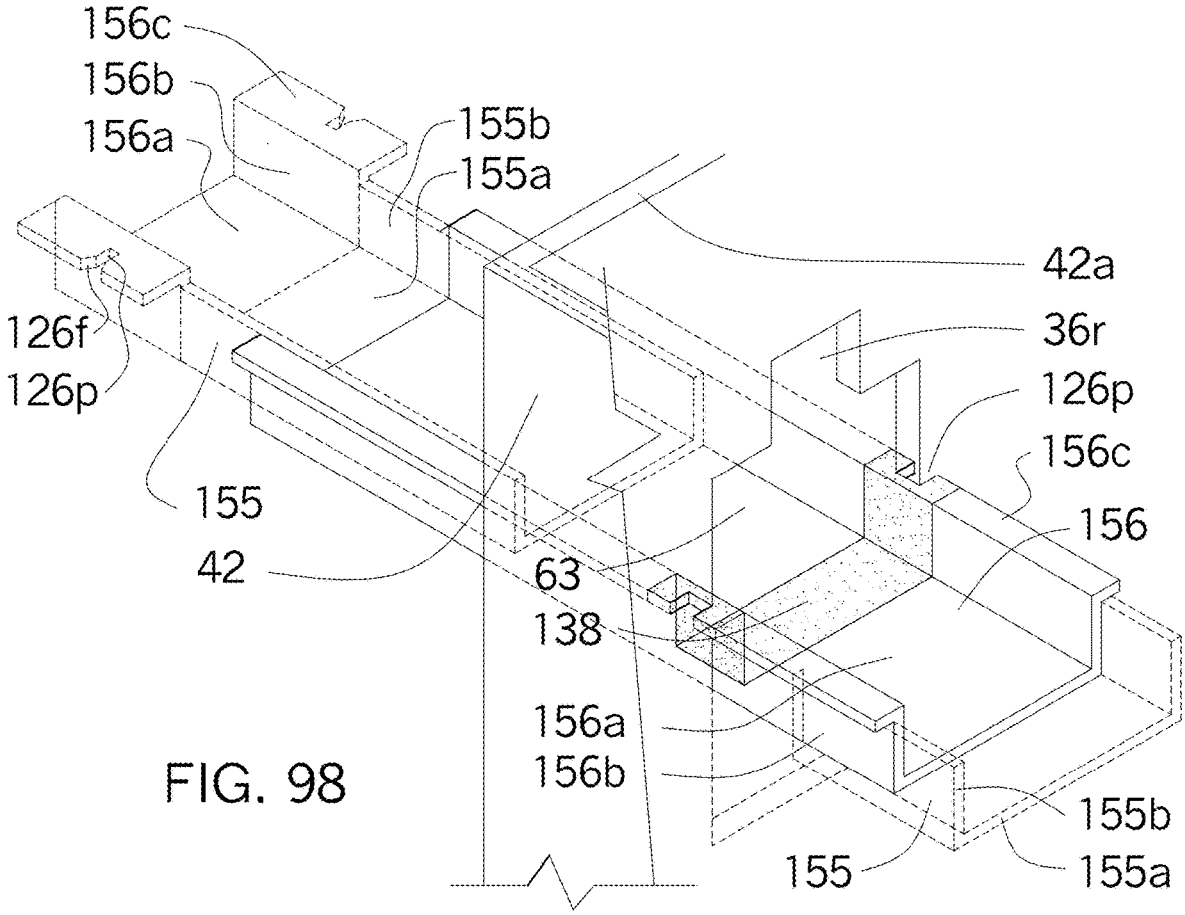
FIG. 98 is an enlargement of FIG. 97 and showing the reverse lip channel 156.

FIG. 98 is shown as FIG. 18 in U.S. Ser. No. 13/398,243 filed Feb. 16, 2012 now abandon as a horizontal reverse lip channel 156; used as a coupling 63 that is secured to the web 42*a* of the support channel by lip notches 126*p* and connects to two other horizontal bracing channels 155 (shown as dashed lines) on either side of the horizontal reverse lip channel 156. The horizontal U channel 155 on the left side rests on the web 156*a* and between the flanges 156*b* and is connected to coupling 63. The opposed end of coupling 63 shows another horizontal U channel 155 installed under the coupling 63 so the web 155*a* and flanges 155*b* are on the inside of the coupling 63 shown as a horizontal reverse lip channel 156. A coupling 63 connects two horizontal bracing channels, however this same horizontal reverse lip channel 156 can be a multi-plane bracket 128. A multi-plane bracket 138 functions differently than a coupling 63. A horizontal bracing channel shown as a horizontal U channel 155 passes through the hole 36 of the support channel on to another support channel and the multi-plane bracket 128 fits over the horizontal U channel 155 and the lip notches 126*p* of the multi-plane bracket 138 fit into the holes 36 of the support channel. The multi-plane bracket 138 is shown shaded to differentiate between the coupling 63 and the multi-plane bracket 128 which is shorter in length. The multi-plane bracket 138 fits into and between the flanges 155*b* and web 155*a* of the horizontal U channel 155. The coupling 63 and multi-plane bracket 138 can be used with the flanges 156 facing upward or downward. On the far left a U channel 155 is shown installed inside a reverse lip channel 156 between the flanges 156*b* if the reverse lip channel is slightly smaller or the flanges 156*b* are angled and secured to the hole side edges 36*se* with lip notches 126*p*. The lip notches 126*p* secure the horizontal bracing channels to the support member and by changing sizes, shapes, orientation there are probably 50 different solution which is impossible to display into this application, but still very easy for competitors to see all the alternative solutions.

Figure 99:
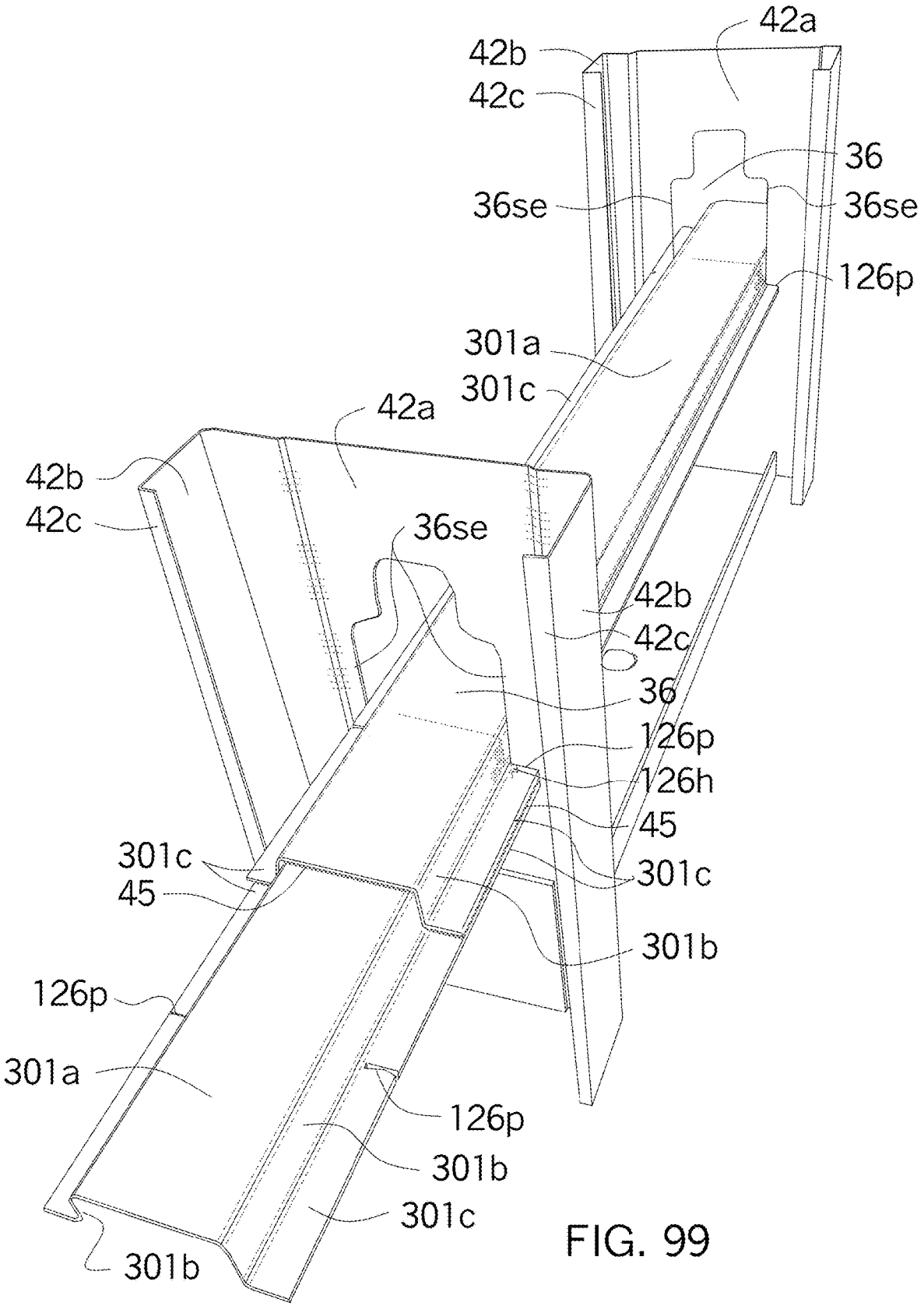
FIG. 99 is FIG. 18 in U.S. Ser. No. 13/398,243 filed Feb. 16, 2012, now abandon showing the horizontal reverse lip channel 156 as attached to this patent application.

FIG. 99 is a perspective drawing showing the prototype mockup of the reverse lip spacer brace 301 photographed on May 9, 2015, with the photograph still used today for marketing purposes. The reverse lip spacer brace 301 shows web 301*a* with attached angled flanges 301*b* and lip 301*c* extending away from the web 301*a* with lip notches 126*p* engaging the hole side edge 36*se*. The reverse lip spacer brace identification number corresponds to the patent application not the early provision application or the abandon application as mentioned previously. This application shows many variations of the original prototype using different and multiple flanges 301*b* or lip notches 126*p* attempting to create more friction. The original protype does not show the perimeter notches 126*h* or the lip notches 126*p* having angles or offset between the first lip notch 126*p* and the second lip notch as shown in other figures. In the perspective drawing a gap 45 is shown as a shadow between the web 301*a*, flange 301*b* and lips 301*c*. When two adjacent reverse lip spacer brace 301 overlap at the web aperture, the hole notch 126*h* opening can be any opening configuration including a double width opening or a single width opening, and depending on the reverse lip spacer brace 301 configuration and the lip notch 126*p* configuration. The flanges are shown at a slight for flange 301*b* to extend over file flange 301*b* to allow for the overlapping of the reverse lip spacer braces. The lip notches 126*p* are aligned in the aperture side edges 36*se* when overlapping each other. The lip notches 126*p* can be angled and offset between the angled lip notches. In addition, the flanges 301*b* will bend when inserted into the aperture side edges 36*se* and can be squeezed together when being removed or disassembled. If compare the stacked hat channels shown in the information disclosure, the overlapping reverse lip space brace 301 has a similar shape except there are no lip notches 126*p* in a hat channel; the standard hat channel is larger in size, making it impossible to secure into the aperture 36 of a support member 42.

Figure 81:
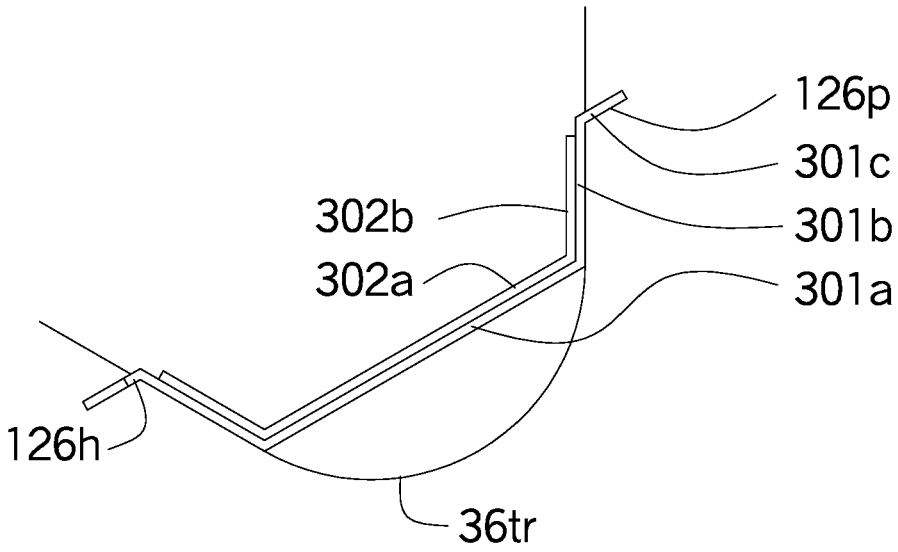
FIGS. 79-81 shows three different spacer brace configurations passing through a triangular shaped hole shown in FIG. 16 in U.S. Ser. No. 14/946,378 filed in Nov. 19, 2015 & FIG. 30-32 in U.S. Ser. No. 15/090,460 filed Mar. 3, 2017 now issued Jun. 16, 1920 as U.S. Pat. No. 10,683,665 and now part of this application.
Figure 102:
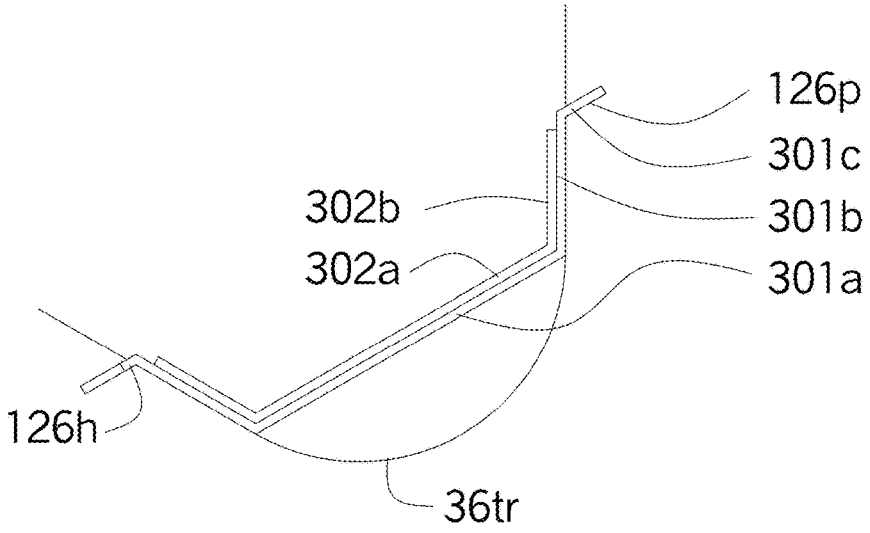
Figure 101:
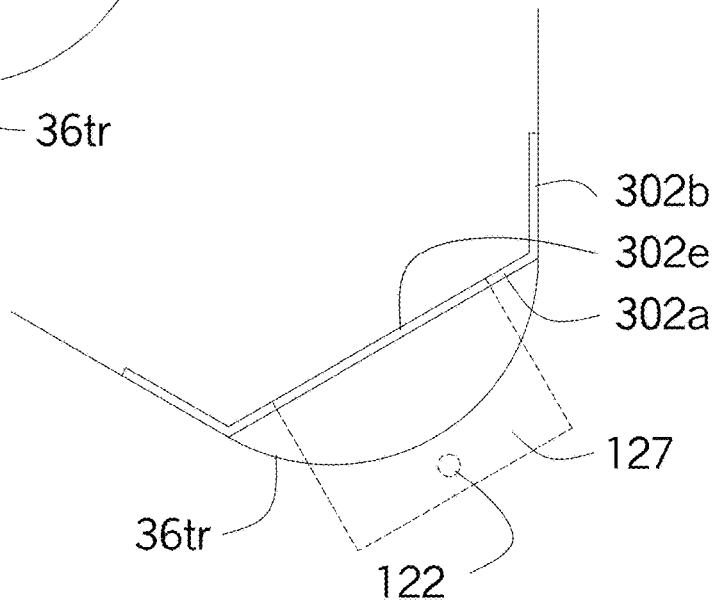
Figure 100:
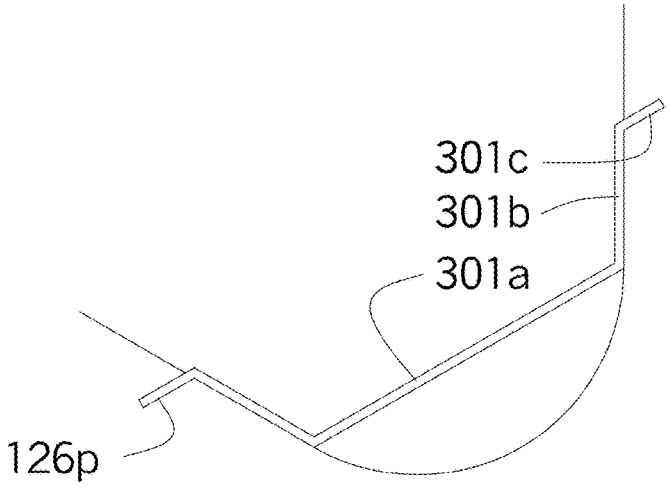
FIG. 100 is a perspective drawing of the photograph taken of the original prototype on May 9, 2015, used to create this patent application well as earlier or later variations of the reverse lip spacer brace.

FIGS. 100-102 are similar to FIGS. 79-81 as they both show the reverse lip spacer brace 301 and the U-shaped spacer brace 302 extending through a triangular shape hole 36*t*. FIGS. 100-102 were originally drawn in Dec. 17, 2014 and were sent to a proposed client on Dec. 14, 2014 and duplicated here as FIG. 79-81. FIG. 100 shows "A continuous hat channel shape as a horizontal bracing channel with grooves in the lip at the holes". FIG. 101 shows "The Braceum Spacer Brace is a U-shape with the web extended down with a hole for a fastener to be connected to the web of the support member". FIG. 102 shows "A bracket having a hat channel shape with grooves in the lip and a continuous U-shaped channel set inserted into the bracket and then fastened to the bracket". At the top of the brochure "The below drawing shows your typical hole shape and how the Bracket or Braceum Spacer Brace can be used in conjunction with your StudRite Wall System". The overlapping reverse lip spacer braces in FIG. 98 along with FIG. 101 shows how the two reverse lip spacer braces 301 will interlock and connect to the triangular shape hole 36*t*. A web extension 301*e* is extended through the triangular shape hole 36*t* then bent to form a flap 129 with a fastener hole 122. The flap 129 is meant to be used as an end connection to the support member 42.

There are many different variations of the connections that have been shown in the figures and when discussed in the claims could be referred to as connectors. Since a notched tab 126*nt* could extend from a web or flange of either a support member or spacer braces the tab as explained in the claims is the first metal framing element. When a crossing member intersects say the notched tab, the notches of the notched tab engage an opening which could be the edge of a lip of a U or C shaped support or spacer brace as well as many of the different types of holes or notches that the notch-tab notch 126*ntn* would connect or engage too. Sometimes a notch for example a hole notch could be considered as a pocket to receive a crossing element that fits into the pocket. In addition, sometimes the construction of the spacer brace being the web, flanges or lips are referred to as a wall. The notch-tab can be installed in various positions where a wall description can be considered in many different locations. The thickness of the framing members are typically 18*ga*-24*ga*, however the early numbered figures are drawn thick, as the inventor, I was worried that the figure thickness would not be legible when this application would be issued. FIG. 100 is an overlay from a photograph taken of a prototype, however the hole 36 shows a hole notch 36*h* interlocking to the lip notch 126*p* shown throughout the application.

The specifications terminology is slightly different than the claims. The application is about a U-shaped spacer brace [302][framing member 2] and a reverse lip spacer brace [301][framing member 3] being connected to a support member [42][framing member 1]. The support member has holes 36 described as an aperture having a perimeter. The perimeter has hole notches 126*h*, web notches 126*w* (notches 126) and the claims noted as perimeter notches and as shoulder notches at the sideedge of the perimeter notch. The U-shaped spacer brace [302][2} and the reverse lip spacer brace [301](3) both have a web (a) two flanges [b][referred to as first side wall and a second side wall] with the side walls having various shapes with straight flanges, curvilinear, multi-plane, bulge shape [301*g*, 302*g*, 303*g*] having angular side walls with an obtuse angle or acute angle notches and configured with many different notch shapes [referred as side wall notches and corner notches at web-flange]. The flanges [301*b*, 301*b*, 303*b*][side walls] bulge flanges [301*g*, 302*g*, 303*g*] or can be longer forming bent flanges [301 *b*'] with the longer flange noted as lips [301*c*] and in both cases having flange notches [126*fg*] or lips notches [126*p*] or bulge notches [126*bg*] with the reverse lip spacer brace 302 or the flanges 302*b*' can form lips [c]. The flange-web notches [126*n*] or bulge notches [126*bg*] are referred to a corner notches. The support member [framing member 1] has a hole 36 [aperture] with a rim [36*r*][perimeter] with the aperture [36] not defined as a rectangular, curvilinear or any specific shape as the perimeter [36*se*] and the perimeter has perimeter notches [126*h*] or slide gaps [46*s*]. The shoulder notches are notches the extend into the side walls of the perimeter notches and the perimeter notches are hole notches [36 *h*]. The corner notches [web-flange notches 126*wg*] referred to corner notches and are located in bulges therefore called bulge notches [126*bg*]. The web-flange notches allow the framing member [2 & 3] to connect to the structural support [42] through the hole [36] with the corner notch engaging the hole bottom edge 36*be* whether the hole bottom edge 36*be* has a diagonal edge or a half circle bottom edge (also a standard bottom edge) or an irregular, curvilinear shape the framing members [2 & 3]. Throughout the application different types of notch shapes, pointed, tapered, flares or notches orientations either diagonal or offset are variables. The connection of the notches in framing member 1 through the notches in the framing member 1 to the notches of the framing member 2 & 3 forms a rigid connection. The framing member 1 can be connected to another framing member 1 by overlapping when the framing member 1 has a wide width opening between the flanges, allowing the flanges to fit over another framing member 1 allowing the flanges to rub against each other causing friction or where the lip notches engage the side edges of the aperture. The perimeter notches, shoulder notches or the flange notches engaging the holes side edges or the side edge of a perimeter notch, and the corner notch engaging the hole bottom edge and hole side edge or the side edge of a perimeter notch. Framing member 2 and framing member 3 can both be inverted with the notch locations being reversed.

FIGURE NUMBER GLOSSARY OF TABLE OF CONTENTS

36 hole: 36*be*—hole bottom edge, 36*se*—hole side edge, 36*te*—hole top edge, 36*tr*—triangular shaped hole, 36*k*—key hole, 36*ws*—web slot holes, 36*b*—bracing hole, 36*kt*—key hole tab, 36*fs*—flange slot holes, 36*rs*—receiver slot hole, 36*tb*—tab holes, 36*v*, 36*v*' & 36*v*"—vertex slot hole, 36*cs*—corner slot hole, 36*r*—rim, 36*s*—slot hole, 36*ws*—web slot hole, 36*st*—slot tab hole,

42 C channel: 42*a*—web, 42*b*—flange, 42*c*—lip, 42*at*—web tab. 42*ai*—web indentation, 42*s*—web shaft

45 gap: 45*j*J-shaped gap, 45*e*—L-shaped gap, 45*s*—slide gap, 45*jt*—J-shaped gap tab

76 flap

79 ledge: 79*i*—ledge indentation, 79*t* ledge tab, 79*s*—ledge shaft,

122 fasteners

126 notches: 126*n*—notch, 126*f*—flare edge, 126*ng*—notch gap, 126*c*—clip notch, 126*r*—receiver notch, 126*h*—hole notches, 126*rm*—rim notch, 126*p*—lip notch, 126*w*—web notch, 126*bg*—bulge notch, 126*wg*—web-bulge notch, 126*wh*—web-hole notch, 126*nt*—notch-tab, 126*hp*—hole lip notch, 126*fg*—flange notch, 126*s*—slide notch, 126*sg*—bulge slide notch, 126*c*—clip notch, 126*nth*—notch-tab head, 126*eg*—leg notch, 126*ntn*—notch tab notch, 126*nts*—notch tab shaft, 126*rn*—rim notch, 126*nte*—notch tab extension, 126*nt* i-notch tab indentation, 126*nt*2-½ notch tab, 126*tt*—bent key hole tab, notch tab slot holes, 126*v*—V-shape notch, 126*va*—first leg, 126*vb*—second leg

127 hook finger, 127*a*—first leg, 127*b*—second leg

128 hook tongue: 128*s*—tongue shat, 128*tt*—hook tongue tab, 128*ti*—hook tongue tab-indentation

129 hook receiver: 129*a*—first leg, 129*b*—second leg, 129*c*—third leg, 129*wr*—*w* web hook receiver, 129*fr*—flange receiver, 129*wr*—web hook receiver, 129*t*—hook receiver tab

155 U shaped channel: 155*a*—web, 155*b*—flange

157 blunt end

201 flat plate

208 reverse lip bracket 208*a*—web, 208*b*—flange,208*c*—lip, 208*ct*—tapered lip, 208*bt*—tapered flange

251 tab forming cut

299 V shaped spacer brace, 299*a*—angular leg

301 reverse lip spacer brace: 301*a*—web, 301*b*—flange, 301*c*—lip, 301*g*—bulge, 301*he*—hole extension

302 U-shaped spacer brace: 302*a* web, 302*b* flange, 302*we*—web extension, 302*be*—extension flange, 302*i*—indentation, 302*g*—bulge, 302*dr*—raised web

303 C shaped spacer brace: 303*a*—web, 303*b*—flange, 303*c*—lip, 303*g*—bulge, 303*ar*—raised web, 303*s*—sloped ledge, 303*ce*—lip extension, 303*ar*—raised web, 303*as*—sloped web edge, 303*sg*—sharp bulge.

307 W-shaped clip: 307*a*—web

312 double reverse clip bracket: 312*a*—web, 312*b*—flange, 312*c*—lip.

320 ridges.

326 punched out tabs: 326*ve*—vented edge, 326*pe*—pivot edge, 326*t*—tab, 326*tw*—wrap around tab.

355 anchor space.

The invention claimed is:

1. A structural framing system comprising: a first metal framing member and a second metal framing member connected by a connector element;

the first metal framing member having an aperture defining a perimeter in a planar wall, the aperture having a first side and a second side opposite the first side, the aperture having a third side and a fourth side opposite the third side, the aperture adapted to receive the connector element, the aperture having a first shoulder proximate an intersection of the first side and the fourth side and a second shoulder proximate an intersection of the second side and the fourth side, a first notch between the first shoulder and the second shoulder and having the fourth side defining a lowermost portion of the first notch, the aperture having a second notch at an intersection of the first side and the third side and a third notch at an intersection of the second side and the third side; the second metal framing member having a first side wall and a second side wall configured to be received between the first shoulder and the second shoulder of the first metal framing member.

2. The structural framing system according to claim 1, wherein the first side wall and the second side wall of said second metal framing member are separated by a web and said first side wall and said second side wall of said second metal framing member each having a longitudinal plane element extending substantially perpendicular to said respective wall.

3. The structural framing system according to claim 1 wherein the connector element is between said first and said second metal framing member, wherein a width of a longitudinal plane of said second metal framing element is wider than a width of the aperture of said first metal framing member with said longitudinal plane having an indentation for the side walls of said second metal framing member to abut the perimeter of said aperture for the longitudinal plane of said second metal framing member to extend over a bottom edge of said aperture.

4. The structural framing system according to claim 2 wherein the first metal framing member has two L-shaped notches formed in a longitudinal end of said web.

5. A structural framing system comprising:

a first metal framing member and a second framing member;

the first metal framing member having an aperture cut into a planar wall, the aperture defining a perimeter and having a first side perimeter wall and a second side perimeter wall opposite the first side perimeter wall, the aperture having a third side perimeter wall and a fourth side perimeter wall, the aperture having a first shoulder extending from said third side perimeter wall proximate said first side perimeter wall defining a first space between said first side perimeter wall and said fourth side perimeter wall, and a second shoulder extending from said third side perimeter wall proximate said second side perimeter wall and defining a second space between said second side perimeter wall and said fourth side perimeter wall;

said aperture with said first space forming a first shoulder opposite said second shoulder, a second metal framing member having a web attached to a first side wall and said web attached to a second side wall with said first and said second side wall having a cut into each of the distal edges forming a first and a second side wall notch configured to engage said first shoulder and said second shoulder to retain said second metal framing member within said aperture.

6. The structural framing system according to claim 5 wherein said first and said second shoulder engage said second metal framing member having said web connected to said first side wall attached to a first lip and said second side wall attached to a second lip, said first lip has a cut into said first lip forming a first lip notch and said second lip has a cut into said second lip forming a second lip notch, with said first and said second lip notch being the connection elements to engage said first shoulder and said second shoulder.

7. The structural framing system according to claim 5 further comprising a third metal framing member connected to the second metal framing member, wherein the second metal framing member has a first end and a second end and said side walls of said second member each having a lip extending from a respective said side edge, each said lip of said second metal framing element may have or not have a notch configured to be received by said perimeter of said aperture of said first metal framing member.

8. The structural framing system according to claim 7 further comprising said second metal framing member to engage said first notch and said second notch connecting at said first metal framing member in said aperture from one direction to overlap the third a metal framing member from the opposing direction with said third metal framing member substantially identical to said second metal framing member each having a first side wall and a second side wall with a first side wall notch and a second side wall notch cut into the distal edge of said first and said second side wall overlap configured to be received between said first side wall notch and said second side wall notch of said first metal framing member.

9. The structural framing system according to claim 7 wherein said second framing member having said first lip and said second lip with a free edge each having a notch cut into said free edge, wherein the notches are offet, said notches are cut at an angle into said free edge to engage said aperture.

10. The structural framing system according to claim 9 wherein said third metal framing member has first and second side extending from a web, said first side wall and said second side wall of said second metal framing member and said third metal framing member are angled with respect to said web thereof forming an acute angle or an obtuse angle between the respective wall and web, said walls having a free edge able to bend using pressure for said free edge to engage said first and said second shoulder or a first and a second perimeter side edge notch in said shoulders of said aperture.

11. The structural framing system according to claim 10 wherein said second and said third framing member each have said first wall and said second side wall, said first and said second side wall each have a first side wall bulge and a second side wall bulge able to engage into said first and said second shoulders, said first and said second side wall bulge has a first bulge notch and a second bulge notch with an indentation cut said first and second bulge forming said first bulge notch and said second bulge notch, each of the bulge notches having an opening center and tapered side edges to engage said shoulders, said first bulge notch offset from said second bulge notch with said first and said second bulge notch being cut at an angle or curvilinear configuration and said first and said second bulge notches offset between the notches.

12. The structural framing system according to claim 11 wherein said first side wall bulge and said second side wall bugle extend away from said first and said second side wall and extend away from said web to form a first web-side wall bulge and a second web-side wall bulge may or may not have an indentation opening cut into said first and said second web-side wall bulge to engage into said first notch and said second notch in said aperture.

13. A structural framing system comprising:

a first metal framing member and a second metal framing member;

the first metal framing member having an aperture in a planar wall, the aperture defining a perimeter and having a first side and a second side opposite the first side, the aperture having a third side and a fourth side opposite the third side, the aperture having a raised shoulder in a center portion of said fourth side wherein said raised shoulder having a first notch in a first sidewall facing said first side and a second notch in a second side wall facing said second side;

said aperture having a first shoulder at an intersection of said first side and said third side and a second shoulder at an intersection of said second side and said third side, said first shoulder and said second shoulder having a gap there between;

the second metal framing member having a first side wall and a second side wall configured to be received-between said raised shoulder and said fourth side of the first metal framing member.

14. The structural framing system according to claim 13 wherein said second framing member having a first lip extending from said first side wall and a second lip extending from said second side wall, a first notch cut into said first lip and a second notch cut into said second lip, said first and said second lip notch to engage said raised shoulder.

* * * * *